US012440715B2

(12) United States Patent
Lewis-Dove

(10) Patent No.: US 12,440,715 B2
(45) Date of Patent: Oct. 14, 2025

(54) VARIABLE MASS DUMBBELL SYSTEMS

(71) Applicant: Stacey M. Lewis-Dove, Moncks Corner, SC (US)

(72) Inventor: Stacey M. Lewis-Dove, Moncks Corner, SC (US)

(73) Assignee: Gym-in-a-Box LLC, Goose Creek, SC (US)

( * ) Notice: Subject to any disclaimer, the term of this patent is extended or adjusted under 35 U.S.C. 154(b) by 263 days.

(21) Appl. No.: 18/266,944

(22) PCT Filed: Sep. 30, 2021

(86) PCT No.: PCT/US2021/052782
§ 371 (c)(1),
(2) Date: Jun. 13, 2023

(87) PCT Pub. No.: WO2022/072582
PCT Pub. Date: Apr. 7, 2022

(65) Prior Publication Data

US 2024/0325814 A1 Oct. 3, 2024

Related U.S. Application Data

(60) Provisional application No. 63/225,521, filed on Jul. 25, 2021, provisional application No. 63/151,893, (Continued)

(51) Int. Cl.
*A63B 21/075* (2006.01)
*A63B 21/072* (2006.01)

(52) U.S. Cl.
CPC ..... *A63B 21/075* (2013.01); *A63B 21/0726* (2013.01); *A63B 21/0728* (2013.01); *A63B 21/0724* (2013.01)

(58) Field of Classification Search
CPC ..... A63B 21/072; A63B 21/0724; A63B 21/0726; A63B 21/0728; A63B 21/075
See application file for complete search history.

(56) References Cited

U.S. PATENT DOCUMENTS 5,779,604 A * 7/1998 Towley, III ..... A63B 21/0728 482/107
7,011,611 B1 * 3/2006 Ripley ..... A63B 21/0728 482/107

(Continued)

OTHER PUBLICATIONS

Unpublished U.S. Appl. No. 19/206,826 (46 pages).

(Continued)

*Primary Examiner* — Joshua Lee
(74) *Attorney, Agent, or Firm* — Jeremy M. Stipkala; Thrive IP®

(57) ABSTRACT

Dumbbell systems provide a grip; a weight-engagement device having weight-engagement ports; a plurality of weight plates, each weight plate having a grip-engagement port; wherein the plurality of weight plates provides an incrementally-variable mass of weights. Further, a telescoping dumbbell system provides a cylindrical base comprising a grab and optionally a circular bearing race rotationally supporting the grab; a base weight selecting pin slidably attached to the cylindrical base; a first plurality of nested weight cylinders; and wherein the first plurality of nested weight cylinders provides an incrementally-expandable mass of weights. A dumbbell comprises a grip, a weight plate permanently affixed to the grip, the weight plate defining an opening about the grip sufficient in size for a human hand to grasp the grip, and two or more stacking structures on the weight plate. A barbell system engaging any of the foregoing dumbbell systems, dumbbells, or telescoping dumbbell system also appears.

20 Claims, 34 Drawing Sheets

Related U.S. Application Data filed on Feb. 22, 2021, provisional application No. 63/085,306, filed on Sep. 30, 2020.

(56) References Cited

U.S. PATENT DOCUMENTS

| | | | | |
|---|---|---|---|---|
| 7,491,157 | B1 * | 2/2009 | Lin | A63B 21/072 482/107 |
| 8,021,282 | B2 | 9/2011 | Polevoy et al. | |
| 9,616,270 | B2 | 4/2017 | Towley et al. | |
| 10,035,037 | B2 | 7/2018 | Towley | |
| 10,953,264 | B2 * | 3/2021 | Towley, III | A63B 21/0726 |
| 2009/0062085 | A1 * | 3/2009 | Polevoy | A63B 21/0728 482/93 |

OTHER PUBLICATIONS

International Search Report for PCT/US2021/052782, dated Jan. 6, 2022 (3 pages).
International Preliminary Report of Patentability for PCT/US2021/052782, dated Apr. 13, 2023 (5 pages).

* cited by examiner

VARIABLE MASS DUMBBELL SYSTEMS

CROSS-REFERENCE TO RELATED APPLICATIONS

This application represents the National Phase under 35 U.S.C. § 371 of International Application No. PCT/US2021/052782, entitled. VARIABLE MASS DUMBBELL SYSTEMS, and filed internationally on Sep. 30, 2021, which claims benefit of priority under PCT Chapter I, Article 8, and 35 U.S.C. § 119 (e) of: U.S. Provisional Patent Application No. 63/085,306 entitled VARIABLE MASS DUMBBELL SYSTEMS, which was filed on Sep. 30, 2020;

- U.S. Provisional Patent Application No. 63/151,893 entitled, VARIABLE MASS DUMBBELL SYSTEMS, which was filed on Feb. 22, 2021; and U.S. Provisional Patent Application No. 63/225,521 entitled, VARIABLE MASS DUMBBELL SYSTEMS, which was filed on Jul. 25, 2021. Each of the foregoing International Application No. PCT/US2021/052782, U.S. Provisional Patent Application Nos. 63/085,306, 63/151,893, and 63/225,521 is incorporated herein in its entirety.
- U.S. Provisional Patent Application No. 63/085,306 entitled, VARIABLE MASS DUMBBELL SYSTEMS, which was filed on Sep. 30, 2020;
- U.S. Provisional Patent Application No. 63/151,893 entitled, VARIABLE MASS DUMBBELL SYSTEMS, which was filed on Feb. 22, 2021; and
- U.S. Provisional Patent Application No. 63/225,521 entitled, VARIABLE MASS DUMBBELL SYSTEMS, which was filed on Jul. 25, 2021.

Each of the foregoing U.S. Provisional Patent Application Nos. 63/085,306, 63/151,893, and 63/225,521 is incorporated herein in its entirety.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF INVENTION

This invention relates to exercise equipment for strength training and weight-assisted cardio exercise, such as dumbbells and barbells.

BACKGROUND OF THE INVENTION

Dumbbells that can attach varying masses are known. In some cases, plates can be held in place with removable cuffs that use friction or other forces to hold the plates on the ends of the dumbbells. In other cases, complicated mechanisms allow an athlete to select a desired mass in the form of specially-designed plates or other structures. However, known systems may take considerable time and effort to change the amount of mass attached to a dumbbell between sets and between exercises. Dumbbell technology can use improvement.

Dumbbell and barbell technology that fits easily and unobtrusively into a home or office, and yet can afford a wide variety of weights deployed in a broad range of exercises, is needed in the marketplace. The recent pandemic has thrown considerable doubt on the future of large gyms where numerous people gather. The increased cardiopulmonary demands of strength training and weight-assisted cardio exercise mean that traditional gyms, with their high turnover of clientele, present an exceptionally risky environment for the transmission of upper respiratory illnesses such as colds, the flu, and COVID-19. Thus, sprawling arrays of dumbbells and barbells, the hallmark of a well-equipped gym, will be off-limits to those who wish to socially distance while exercising. Compact and versatile systems for strength training and weight-assisted cardio exercise are needed for that additional reason.

SUMMARY OF THE INVENTION

Unexpectedly, Applicant has invented new dumbbell and barbell technology. In some embodiments, dumbbell systems for exercising with an incrementally-variable mass of weights appear, one such system comprising: a grip, comprising a handle portion and a weight-selecting portion; a weight-engagement device, comprising a plurality of weight-engagement ports configured to receive the weight-selecting portion of the grip; a plurality of weight plates, each weight plate in the plurality of weight plates comprising a grip-engagement port configured to receive the weight-selecting portion of the grip, wherein each grip-engagement port aligns with a weight-engagement port in the plurality of weight-engagement ports; wherein the plurality of weight plates provides the incrementally-variable mass of weights.

Other embodiments provide telescoping dumbbell systems for exercising with an incrementally-expandable mass of weights, one such system comprising a cylindrical base comprising a grab and optionally a circular bearing race rotationally supporting the grab; a base weight selecting pin slidably attached to the cylindrical base; a first plurality of nested weight cylinders, wherein each weight cylinder in the first plurality of nested weight cylinders comprises a first pin engagement port adapted to receive the base weight selecting pin; wherein each first pin engagement port of each weight cylinder is adapted to align with the first pin engagement ports of the other weight cylinders in the first plurality of nested weight cylinders; and wherein the first plurality of nested weight cylinders provides the incrementally-expandable mass of weights.

Still other embodiments provide dumbbell systems for exercising with an incrementally-variable mass of weights, one such embodiment comprising a grip comprising a handle portion optionally enclosing a pin-receiving portion; a weight-engagement device having a first end opposite a second end, comprising a plurality of weight-engagement ports dispersed between the first end and the second end, each weight-engagement port in the plurality of weight-engagement ports being configured to receive a weight-retaining pin; a first plurality of weight plates, each weight plate in the first plurality of weight plates comprising at least one grip-engagement port configured to also receive the weight-retaining pin, wherein each of the at least one grip-engagement port is adapted to align with a weight-engagement port in the plurality of weight-engagement ports; wherein the plurality of weight plates provides the incrementally-variable mass of weights.

Further embodiments relate to dumbbell systems for exercising with an incrementally-variable mass of weights, one such system comprising one or more weight engagement rods, each comprising a shaft having a top tip and a bottom tip, and a screw thread along at least a portion of the shaft; a hold comprising a gripping portion adjacent one or more rod engagement openings, each of the one or more rod engagement openings comprising a complementary screw thread for engaging the screw thread of the one or more weight engagement rods; and a plurality of weight plates, each weight plate comprising one or more rod engagement ports for receiving the one or more weight engagement rods, and an opening dimensioned to receive a human hand grasping the hold.

Yet additional embodiments provide a dumbbell system for exercising with an incrementally-variable mass of weights, comprising:

(a) an inner weight-engagement device comprising:

an inner first end opposite an inner second end;

a plurality of inner weight-engagement ports dispersed between the inner first end and the inner second end, each inner weight-engagement port in the plurality of inner weight-engagement ports being configured to receive a weight-retaining pin or optionally a grip-retaining pin;

(b) an outer weight-engagement device, wherein the inner weight-engagement device is adapted to fit incrementally within the outer weight-engagement device, the outer weight-engagement device comprising:

an outer first end opposite an outer second end;

a plurality of outer weight-engagement ports dispersed between the outer first end and the outer second end, each outer weight-engagement port in the plurality of outer weight-engagement ports being configured to receive the weight-retaining pin;

(c) a grip comprising a handle portion optionally enclosing a pin-receiving portion adapted to receive the weight-retaining pin or optionally the grip-retaining pin;

(d) a first plurality of weight plates, each weight plate in the first plurality of weight plates comprising at least one pin-engagement port configured to also receive the weight-retaining pin, wherein each of the at least one pin-engagement port is adapted to align with an outer weight-engagement port in the plurality of outer weight-engagement ports;

wherein the plurality of weight plates provides the incrementally-variable mass of weights.

Still other embodiments provide dumbbells of unique design and functionality. One such dumbbell comprises a grip; a weight plate permanently affixed to the grip, the weight plate defining an opening about the grip sufficient in size for a human hand to grasp the grip; and two or more stacking structures on the weight plate. Optionally, such a dumbbell includes a filling port adapted to receive and retain at least one filling material to establish a desired mass in the dumbbell.

In some further embodiments, barbell systems appear, such as, for example, a barbell system for exercising with an incrementally-variable mass of weights, comprising: a barbell comprising a first barbell end opposite a second barbell end, and a gripping portion disposed between the first barbell end and the second barbell end; wherein the first barbell end is configured to engage the dumbbell systems described herein, the dumbbells described herein, the telescoping dumbbell systems described herein, or a combination thereof; and wherein the second barbell end is configured to engage the dumbbell systems described herein, the dumbbells described herein, the telescoping dumbbell systems described herein, or a combination thereof.

While the disclosure provides certain specific embodiments, the invention is not limited to those embodiments. A person of ordinary skill will appreciate from the description herein that modifications can be made to the described embodiments and therefore that the specification is broader in scope than the described embodiments. All examples are therefore non-limiting.

DETAILED DESCRIPTION

Figure 1:
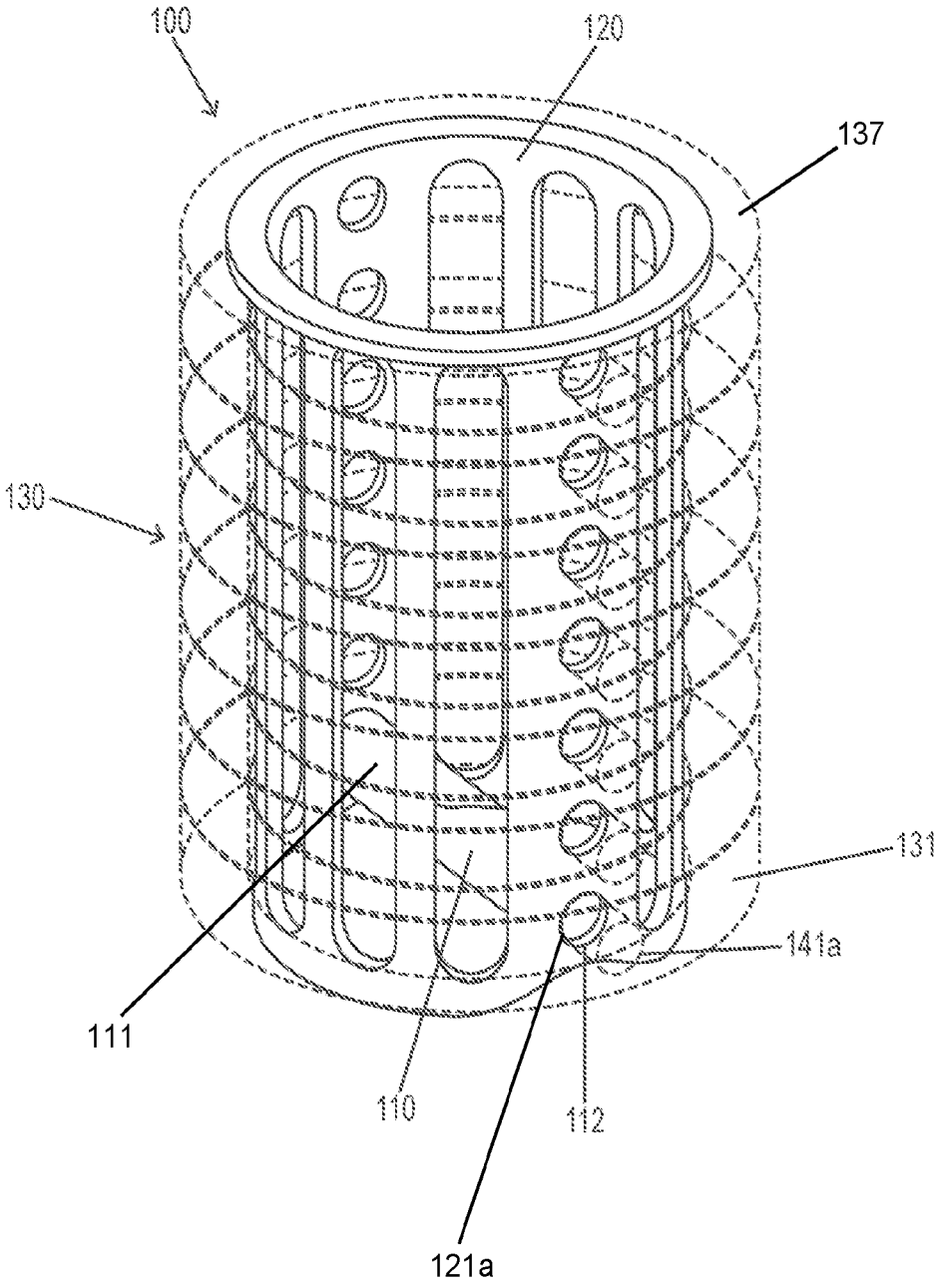
FIGS. 1-3 depict one embodiment of the invention comprising dumbbell system 100.

As required, detailed embodiments of the present invention are disclosed herein; however, it is to be understood that the disclosed embodiments are merely exemplary of the invention that may be embodied in various forms. The figures are not necessarily to scale, and some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Unless defined otherwise, all technical and scientific terms used herein have the same meaning as is commonly understood by one of ordinary skill in the art to which this disclosure belongs. In the event that there is a plurality of definitions for a term herein, those in this disclosure prevail unless stated otherwise.

Wherever the phrase "for example," "such as," "including" and the like are used herein, the phrase "and without limitation" is understood to follow unless explicitly stated otherwise. Similarly "an example," "exemplary" and the like are understood to be non-limiting.

The term "substantially" allows for deviations from the descriptor that don't negatively impact the intended purpose. Descriptive terms are understood to be modified by the term "substantially" even if the word "substantially" is not explicitly recited.

The term "about" when used in connection with a numerical value refers to the actual given value, and to the approximation to such given value that would reasonably be inferred by one of ordinary skill in the art, including approximations due to the experimental and or measurement conditions for such given value.

The terms "comprising" and "including" and "having" and "involving" (and similarly "comprises", "includes," "has," and "involves") and the like are used interchangeably and have the same meaning. Specifically, each of the terms is defined consistent with the common United States patent law definition of "comprising" and is therefore interpreted to be an open term meaning "at least the following," and is also interpreted not to exclude additional features, limitations, aspects, etc. Thus, for example, "a device having components a, b, and c" means that the device includes at least components a, b and c. Similarly, the phrase: "a method involving steps a, b, and c" means that the method includes at least steps a, b, and c.

Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

Any discussion of the prior art throughout the specification should in no way be considered as an admission that such prior art is widely known or forms part of common general knowledge in the field.

It is an object of the present invention to overcome or ameliorate at least one of the disadvantages of the prior art, or to provide a useful alternative.

As stated before, some embodiments of the present invention provide a dumbbell system for exercising with an incrementally-variable mass of weights, comprising:

a grip, comprising a handle portion and a weight-selecting portion;

a weight-engagement device, comprising a plurality of weight-engagement ports configured to receive the weight-selecting portion of the grip;

a plurality of weight plates, each weight plate in the plurality of weight plates comprising a grip-engagement port configured to receive the weight-selecting portion of the grip, wherein each grip-engagement port aligns with a weight-engagement port in the plurality of weight-engagement ports;

wherein the plurality of weight plates provides the incrementally-variable mass of weights.

As used herein, "weights" indicates structures having mass designed to provide a gravity-assisted resistance against which a person can exercise. In some cases, "weights" refers to weight plates. Weights and weight plates can appear in any suitable increment. One pound, 5 pounds, 10 pounds, 20 pounds, 25 pounds, 50 pounds, 100 pounds can be mentioned as suitable increments. One kilogram, 5 kg 10 kg, 20 kg 25 kg, 50 kg, even 100 kilograms also can be mentioned as suitable increments. Fractions of pounds and fractions of kilograms also can be used, such as, for example, 2.5-pound increments. A 2.5 pound increment provides weights at, for example, 2.5 pounds, 5 pounds, 7.5 pounds, 10 pounds, 12.5 pounds, and 15 pounds. Increments need not be uniform. For example, a plurality of weight plates could have a smaller increment between the first weight plates to be used in a plurality, but a larger increment between the last weight plates in the plurality. To illustrate, a plurality of weight plates could have weight plates weighing 2.5 pounds, 5 pounds, 10 pounds, 20 pounds, and 30 pounds.

Any suitable materials can be used in the dumbbell systems, dumbbells, and the telescoping dumbbell systems of the present invention. For example, the handle portion of the grip may include a polymer foam, rubbery material, or a combination thereof. In that way, the grip can assist an athlete to hang onto the grip during exercise. For another example, weight plates can include any suitable metal, such as, for example, iron, lead, aluminum, titanium, copper, alloys thereof, and combinations thereof. Various steels may be mentioned in particular. Exotic but high-density metals such as gold and silver also may be used. High-strength plastics such as, for example, high density polyethylenes, nylons, polyurethanes, and the like can be used to enclose another substance having mass in the form of a weight plate. Sand-filled and water-filled weight plates may be mentioned in this regard. When water-filled weight plates are used, the dumbbell system can be transported with the weight plates empty, for example when an athlete is traveling. When the athlete reaches her destination, she can fill the weight plates with water and exercise against the increased mass.

Certain embodiments allow for a dumbbell comprising a grip a weight plate permanently affixed to the grip, the weight plate defining an opening about the grip sufficient in size for a human hand to grasp the grip, and two or more stacking structures on the weight plate. Optionally, such a dumbbell includes a filling port adapted to receive and retain at least one filling material to establish a desired mass in the dumbbell. Any suitable filling port technology can be used. For example, a screw cap can allow access to the interior of the dumbbell. In another example, a snap cap can be pried off, a filling material can be added to the dumbbell, and the snap cap can be re-affixed to the filling port. Any suitable filling material can be used. in addition to the sand and water mentioned above, powder, pellets, pebbles, liquids, and combinations thereof may be mentioned. The powder, pellets, pebbles, and liquids can include any suitable substances. Metal ball bearings, ceramic pellets, rocks, glass beads, polymer pellets, oil, water, sand, and combinations thereof can be used. One pair of barbells can be filled with sand, for example, and another pair of barbells can have water added to the sand.

A grip allows an athlete to hold and exercise with the dumbbell system. A grip, through its weight-selecting portion or with a weight-retaining pin, also interfaces with the weight-engagement device and selects one or more weight plates from the plurality of weight plates. Any suitable weight-selecting portion can be used. In some cases, the weight-selecting portion of the grip comprises a single retractable rod configured to selectively retract into the handle portion and to selectively emerge from the handle portion to engage a chosen weight-engagement port in the plurality of weight-engagement ports and a grip-engagement port aligned with the chosen weight-engagement port. The weight-selecting portion, such as the single retractable rod, can be operated according to any suitable mechanism. In some cases, the single retractable rod is spring-loaded. In other cases, the single retractable rod is electromagnetically activated. Electromagnetic activation indicates the use of any suitable mechanism. One or more solenoids or electric motors can be used to push and pull a rod as the weight-selecting portion in and out of the handle portion of the grip. In still other cases, the single retractable rod can be activated by rotating a rod deployment mechanism relative to the handle portion. One way to do that is to employ a screw thread on the single retractable rod with a rotating bezel on the handle portion of the grip. Rotating the bezel in one direction or another engages the screw thread, propelling or retracting the single retractable rod from the handle portion. In still other cases, the weight-selecting portion of the grip comprises dual retractable rods coaxially arranged and configured to selectively retract into the handle portion and to selectively emerge from the handle portion to engage a chosen pair of weight-engagement ports in the plurality of weight-engagement ports and a pair of grip-engagement ports aligned with the chosen pair of weight-engagement ports. As used herein, "rod" includes any suitable structure, such as, for example, a solid cylinder, a hollow tube, a cylinder or tube with screw threading or other structure or texture affixed thereon, and combinations thereof. In some cases, a grip comprises only a handle portion, and the weight-selecting portion function is replaced by a weight-retaining pin or two.

The dumbbell systems described herein further comprise at least one weight-engagement device. By function, the weight-engagement device provides an interface between the grip and the plurality of weight plates. To an extent, the weight-engagement device also protects the athlete's hand, and organizes the weight plates. Certain instances provide a weight-engagement device having a cylindrical device shape. The cylindrical device shape accommodates a circular opening in the weight plates. In some cases, a weight engagement device can include one or more weight-stabilizing protrusions that engage corresponding weight-stabilizing recesses in weight plates. The weight-engagement ports can be dispersed on the weight stabilizing protrusions.

In some cases, a dumbbell system can include to weight engagement devices that slide one inside of the other. The inner weight-engagement device has inner weight-engagement ports that can align with outer weight-engagement ports on the outer weight-engagement device. The grip, inner weight-engagement device, outer weight-engagement device, and one or more weight plates can be configured in a wide variety of ways to afford many different exercises. Usually, the inner weight engagement device is dimensioned so that a human hand can fit inside to grasp the grip. The outer weight-engagement device accordingly is dimensioned to fit over the inner weight-engagement device. The position of the inner weight engagement device relative to the outer weight-engagement device can be secured, for example, when an inner weight-engagement port aligns with an outer weight-engagement port, and a weight-retaining pin, a grip-retaining pin, or even a secondary weight-retaining pin (if there is a second weight plate surrounding a first weight plate) can enter the aligned weight engagement ports. In the presence of a plurality of weight-engagement ports, that position can be changed incrementally, as desired. Any desired inner weight-engagement port is aligned with any desired outer weight-engagement port as the inner weight-engagement device slides into the outer weight engagement device, to configure the system for a variety of exercise experiences. In this way, it can be said that the inner weight-engagement device is adapted to fit incrementally within the outer weight-engagement device.

The weight plates used in the dumbbell systems of the present invention can have any suitable shape. In some cases, each weight plate in the plurality of weight plates defines a cylindrical weight shape.

The present invention also provides telescoping dumbbell systems for exercising with an incrementally-expandable mass of weights. Such a system might include a cylindrical base comprising a grab and optionally a circular bearing race rotationally supporting the grab; a base weight selecting pin slidably attached to the cylindrical base; a first plurality of nested weight cylinders, wherein each weight cylinder in the first plurality of nested weight cylinders comprises a first pin engagement port adapted to receive the base weight selecting pin; wherein each first pin engagement port of each weight cylinder is adapted to align with the first pin engagement ports of the other weight cylinders in the first plurality of nested weight cylinders; and wherein the first plurality of nested weight cylinders provides the incrementally-expandable mass of weights.

As used herein, a dumbbell system "telescopes" when a first plurality of nested weight cylinders can fit within and engage a second plurality of nested weight cylinders. Similarly, weight cylinders are "nested" when one weight cylinder fits inside and engages a second weight cylinder. Engagement ports and other holes "align" when a pin can be sent into them. This is useful, for example, when more than one nested weight plate is desired for an exercise, and a base weight selecting pin slides into the aligned engagement ports. "Weight cylinders" need not be perfectly cylindrical in all respects. Cylindrical "weight cylinders" are shown in the drawings, but the exterior shape of a weight cylinder is not critical, provided that one weight cylinder can nest within another in the plurality of nested weight cylinders. A weight cylinder can have any suitable shape with that caveat. Oval, oblong, rectangular, square, polygonal, and even irregular shapes may be mentioned.

As in the dumbbell systems described above and below, any suitable increment can be used for the telescoping dumbbell systems described herein. One pound, 5 pounds, 10 pounds, 20 pounds, 25 pounds, 50 pounds, 100 pounds can be mentioned as suitable increments. One kilogram, 5 kg, 10 kg, 20 kg, 25 kg, 50 kg, even 100 kilograms also can be mentioned as suitable increments. Fractions of pounds and fractions of kilograms also can be used, such as, for example, 2.5-pound increments. Increments need not be uniform. For example, a first plurality of nested weight cylinders can use a smaller increment, while a second plurality of nested weight cylinders uses a larger increment. The first plurality of nested weight cylinders could use weight cylinders weighing 2.5 pounds, 5 pounds, 7.5 pounds and 10 pounds; while the second plurality of nested weight cylinders could use weight cylinders weighing 10 pounds, 20 pounds, 30 pounds, and 40 pounds.

Any suitable material can be used in the telescoping dumbbell systems of the present invention. For example, the grab may include a polymer foam, rubbery material, or a combination thereof. In that way, the grab can assist an athlete to hang onto the system during exercise. For another example, weight cylinders can include any suitable metal, such as, for example, iron, lead, aluminum, titanium, copper, alloys thereof, and combinations thereof. Various steels may be mentioned in particular. Exotic but high-density metals such as gold and silver also may be used. High-strength plastics such as, for example, high density polyethylenes, nylons, polyurethanes, and the like can be used to enclose another substance having mass in the form of a weight cylinder. Sand-filled and water-filled weight cylinders may be mentioned in this regard.

The cylindrical base comprises a grab, and optionally a circular bearing race rotationally supporting the grab. This bearing race allows the grab to rotate independently of the rest of the system, and may reduce joint strain for the athlete in certain exercises. Any suitable bearings can be used in the bearing races. In some cases, a bearing race comprises ball bearings, cylindrical bearings, conical bearings, or a combination thereof.

Telescoping dumbbell systems comprise at least one base weight selecting pin slidably attached to the cylindrical base. That weight selecting pin slides into one or more weight cylinders at a first pin engagement port. If desired, two, three, four, five, or six base weight selecting pins slidably attached to the cylindrical base alternatively could be used. Correspondingly, a suitable number of pin engagement ports would be required in the first plurality of nested weight cylinders.

In some cases, the cylindrical base and each weight cylinder in the plurality of nested weight cylinders comprise a barbell engagement port, and the barbell engagement ports of the cylindrical base and of each weight cylinder is adapted to align with each other. This allows the end of a barbell to be inserted into the telescoping dumbbell system. Any desirable number of weight cylinders can be added to a barbell end in this way. In other words, some or all of the mass of a telescoping dumbbell system can be attached to the end of a barbell for further exercises. A pair of telescoping dumbbell systems can provide balance incremental mass for both ends of a barbell. As used herein, "dumbbell" indicates a device usually held in one hand, while "barbell" indicates a two-handed device. Of course, if desired, an athlete can use two hands on a dumbbell and one hand on a lightly-weighted barbell.

When a barbell enters a barbell engagement port, in some cases, the telescoping dumbbell system can be secured to the barbell. This can be accomplished in any suitable manner. In some cases, one or more barbell engagement pins slidably attached to the interior surface of the cylindrical base proximal to the barbell engagement port, slide into and engage a weight engagement port on the end of the barbell.

Some embodiments of the present invention allow for the addition of significant mass through the concept of "telescoping." As explained herein, a first plurality of weight cylinders can fit within a second plurality of weight cylinders. The athlete can select a suitable number of weight cylinders in the second plurality to obtain a desirable mass with which to exercise. If the second plurality does not afford sufficient mass for the athlete, a third plurality of nested weight cylinders can be added, and so on. Telescoping can be accomplished in any suitable manner. In some instances, a telescoping dumbbell system includes a second weight selecting pin slidably attached to an outermost weight cylinder in the first plurality of nested weight cylinders; a second plurality of nested weight cylinders, wherein each weight cylinder in the second plurality of nested weight cylinders comprises a second pin engagement port adapted to receive the second weight selecting pin; wherein each second pin engagement port is adapted to align with other second pin engagement ports of the weight cylinders in the second plurality of nested weight cylinders; and wherein the second plurality of nested weight cylinders adds to the incrementally-expandable mass of weights.

If a third plurality of nested weight cylinders is desired, the system may include a third weight selecting pin slidably attached to an outermost weight cylinder in the second plurality of nested weight cylinders; a third plurality of nested weight cylinders, wherein each weight cylinder in the third plurality of nested weight cylinders comprises a third pin engagement port adapted to receive the third weight selecting pin; wherein each third pin engagement port is adapted to align with other third pin engagement ports of the weight cylinders in the third plurality of nested weight cylinders; and wherein the third plurality of nested weight cylinders adds to the incrementally-expandable mass of weights.

Where present, pluralities of nested weight cylinders can include in each weight cylinder a barbell engagement port adapted to align with each other barbell engagement port in the system. In this way, a significant range of mass can be exercised with a single hand in dumbbell form, or the telescoping dumbbell system can be attached to a barbell, and exercises performed against that significant range of mass in barbell form.

Several embodiments herein employ a grip, a grab, or a handle portion that comprises an ergonomic shape. As used herein, "an ergonomic shape" means a thicker middle and thinner ends. An oblate ellipsoid is one possible ergonomic shape. The ergonomic shapes account for the space enclosed when the fingers curl around to touch the tip of the thumb. Since the middle finger and ring finger are longer, together, than the index finger and the pinky, together, an ergonomic shape accounts for that enclosed space. In some cases, it can be said the ergonomic shape is an improvement over a right cylinder when it comes to a shape for the human hand to grab.

As stated before, certain additional embodiments relate to dumbbell systems for exercising with an incrementally-variable mass of weights, comprising: a grip comprising a handle portion optionally enclosing a pin-receiving portion; a weight-engagement device having a first end opposite a second end, comprising a plurality of weight-engagement ports dispersed between the first end and the second end, each weight-engagement port in the plurality of weight-engagement ports being configured to receive a weight-retaining pin; a first plurality of weight plates, each weight plate in the first plurality of weight plates comprising at least one grip-engagement port configured to also receive the weight-retaining pin, wherein each of the at least one grip-engagement port is adapted to align with a weight-engagement port in the plurality of weight-engagement ports; wherein the plurality of weight plates provides the incrementally-variable mass of weights.

Often, a weight-engagement port partners with another weight-engagement port to stabilize a weight plate on the weight-engagement device. In some cases, therefore, a plurality of weight-engagement ports comprises a left plurality of engagement ports opposite a right plurality of engagement ports, wherein each engagement port in the left plurality of engagement ports aligns with an engagement port in the right plurality of engagement ports.

The weight-engagement device, and the weight plates used with that device, can have any suitable shape. For example, the weight-engagement device can exhibit a cylindrical device shape, and the weight plates are circular where they engage the cylinder of the weight-engagement device. In another example, the weight-engagement device comprises a stand comprising a horizontal stabilizer joining two risers providing the plurality of weight-engagement ports; the horizontal stabilizer joining the two risers proximal to the first end. The horizontal stabilizer and risers can have any suitable shape, consistent with their function of connecting the athlete's hand to one or more weight plates. In some instances, the two risers each exhibit a curved cross section, a square cross section, an angular cross section, or any desired cross section. Optionally, a circumferential stabilizer can connect the two risers some distance from the first end for greater stability of the weight engagement device.

The grip can be affixed to the weight-engagement device in any suitable manner. Certain cases provide a grip permanently affixed to the weight-engagement device proximal to the first end. In other cases, the grip is adjustable relative to the weight-engagement device. For example, in further cases the grip is adapted to be selectively secured to any of the weight-engagement ports in the plurality of weight engagement ports. Applicant has also discovered a way to keep the grip from rotating, or to control the rotation as desired, in some embodiments. This can be accomplished, for example, by including one or more rotation guides adapted to minimize rotation of the grip within the weight-engagement device. The rotation guide can eliminate rotation of the grip during exercise, or it can allow a desired amount of rotation. Optionally, a rotation guide may include one or more weight stabilization ports that can receive a weight-selection pin that also engages a weight plate and/or a weight engagement device.

It has been found that a strengthened weight-engagement port further stabilizes the weight-retaining pin and therefore the weight plate on the weight-engagement device. In certain instances, the weight-engagement ports in the plurality of weight-engagement ports each include a pin support collar. A pin support collar can form any suitable shape. In some cases, it is a small cylinder of material dimensioned large enough to receive the weight-retaining pin, and welded, molded, or otherwise attached to the weight-engagement device about the weight-engagement port.

As in other systems described herein, nested weights can be used to increase the resistance against which exercises are performed. In those cases, a first plurality of weight plates engages the weight-engagement device around the device, and then a second plurality of weight plates engages around the first plurality of weight plates. Thus, in certain cases, a second plurality of weight plates appears, each weight plate in the second plurality of weight plates being dimensioned to fit around at least one weight plate in the first plurality of weight plates; wherein each weight plate in the second plurality of weight plates comprises at least one grip engagement port configured to receive the weight-retaining pin, a secondary weight-retaining pin, or both.

Any suitable weight-retaining pins can be used. In some instances, the weight-retaining pin and/or the secondary weight-retaining pin comprises a spring-loaded ball bearing, a spring-loaded post, or a combination of both. In certain embodiments of a spring-loaded ball bearing, the ball bearing provides enough structure to retain the pin in the weight-engagement device, thereby holding the weight plates to the device. Then, the pin can be tugged firmly, causing the ball bearing to give way, and the pin can be removed. In other cases, a spring-loaded post presents a greater obstacle to removing the pin. It is possible to provide a retraction grip for releasing the weight-retaining pin or the secondary weight-retaining pin from the grip-engagement port. In some cases, a single weight-retaining pin holds a weight plate to a weight-engagement device. Optionally, that is possible because the pin is strong enough to hold the weight from one side of the device. Or, the pin extends across the weight-engagement device, for example, through a pin-receiving portion of a grip. In that case, the pin-receiving portion is a hollow tube extending through the grip so the pin enters the grip on one side of the weight-engagement device, and emerges on the other side of the weight-engagement device, entering a weight plate's grip engagement port(s) on one or both sides of the weigh plate. In other cases, a weight plate is held to the weight-engagement device with two or more than two weight-retaining pins. A weight-retaining pin can have any suitable dimensions. For example, 0.25", 0.33", 0.5", 0.66", 0.75", 0.8", 1.0", less than 0.25", or greater than 1.0" diameters having a circular cross section may be mentioned. Alternatively, square, triangular, polygonal, oval, irregular, or any desired cross section may be used. In some cases, the largest dimension of the cross section may be 0.25", 0.33", 0.5", 0.66", 0.75", 0.8", 1.0", less than 0.25", or greater than 1.0".

Any suitable weight plates can be used in the embodiments of the present invention. Those weight plates can have any suitable shape, dimensions, and materials. Weight plates can interface with each other with flat surfaces, or with stacking structures that support and separate adjacent weight plates. Those stacking structures can have any suitable shapes and dimensions. Having weight plates that are separated by stacking structures can allow easier manipulation of those weight plates as the system is being configured for the next exercise.

Another dumbbell system for exercising with an incrementally-variable mass of weights includes one or more weight engagement rods, each comprising a shaft having a top tip and a bottom tip, and a screw thread along at least a portion of the shaft, a hold comprising a gripping portion adjacent one or more rod engagement openings, each of the one or more rod engagement openings comprising a complementary screw thread for engaging the screw thread of the one or more weight engagement rods, and a plurality of weight plates, each weight plate comprising one or more rod engagement ports for receiving the one or more weight engagement rods, and an opening dimensioned to receive a human hand grasping the hold. The weight engagement rods connect the weight plates to the hold. The hold has one, two, or more than two rod engagement openings so the rods can be screwed onto the hold to a desired position. Then weight plates are added to the weight engagement rods as desired. Optionally, the weight engagement rods have stabilizing end caps on the bottom tips. The stabilizing end caps can be any suitable structure, usually offering at least some stability to the rods standing on a flat surface. The stabilizing end caps can be removably affixed, permanently affixed, or integrally affixed to the bottom tip. "Removably affixed" indicates a stabilizing end cap that can be removed by hand or with simple tools. "Permanently affixed" indicates a separately-manufactured part that is attached to the rod in any suitable manner, such as with fasteners such as bolts, or by welding or with adhesive, or combinations thereof. "Integrally affixed" stabilizing end caps are manufactured as part of the rod itself, such as by molding, casting, forging, and the like.

Each weight engagement rod can have one or two or more weight keepers. Weight keepers have a body and a rod receiving port, typically a circular hole, with keeper screw thread suitable for engaging the screw thread of the engagement rod. Weight keepers can have any suitable shape. In some cases, the body of a weight keeper includes finger knobs for manipulating the weight keeper. Once the weight plates are added to the rods, weight keepers can be screwed onto the rods to retain the weights. Optionally, a weight keeper can be positioned below a weight plate to position the weight plate where desired, and to keep the weight plate on the rod, especially if there is no stabilizing end cap or if the stabilizing end cap is not strong enough to hold the weight plate. In other circumstances, weight keepers can be positioned between weight plates if desired. In some cases, the weight plates themselves may include two or more stacking structures to support and separate adjacent weight plates.

Further embodiments of the present invention allow for barbells that allow the dumbbell systems described herein to join together to exercise larger muscle groups. In some cases, a barbell system for exercising with an incrementally-variable mass of weights, comprises a barbell comprising a first barbell end opposite a second barbell end, and a gripping portion disposed between the first barbell end and the second barbell end; wherein the first barbell end is configured to engage any one of the dumbbell systems described herein, the telescoping dumbbell systems described herein, or any combination thereof; and wherein the second barbell end is configured to engage any one of the dumbbell systems described herein, the telescoping dumbbell systems described herein, or any combination thereof. The dumbbell systems and telescoping dumbbell systems can attach to the barbell in any suitable manner. In some cases, the first barbell end comprises one or more first dumbbell engagement ports adapted to receive at least one first dumbbell engagement pin; and the second barbell end comprises at least one second dumbbell engagement port adapted to receive at least one second dumbbell engagement pin. Dumbbell engagement pins can be the same as, or resemble, the weight-retaining pins also described. Or, paired dumbbell engagement docks and dumbbell engagement locks can be used. Generally, a dock is a hole or recess into which the lock fits. The docks and locks optionally include additional structure, such as a post that fits into a groove, optionally with turns in the groove to capture the post to prevent the lock and dock from unintentionally disengaging.

The systems of the present invention can be made in any suitable manner. Methods, such as those known in the art for constructing strength-training equipment, can be used. For example, the weight plates and weight cylinders can be cast, forged, injection molded, stamped, welded, sintered, milled, cut, or precipitated out, as desired.

The systems of the present invention can be used in any suitable manner, such as, for example, in accordance with strength training techniques already known in that art. For example, a set of ten repetitions can be performed at one mass on the system; the mass increased and a set of eight repetitions then performed; and the mass increased again for a set of five repetitions. In some cases, the systems of the present invention make it easier or faster to transition between sets and exercises.

Detailed Description of the Drawings

Further embodiments of the present invention can be described by reference to the accompanying drawings.

Figure 2:
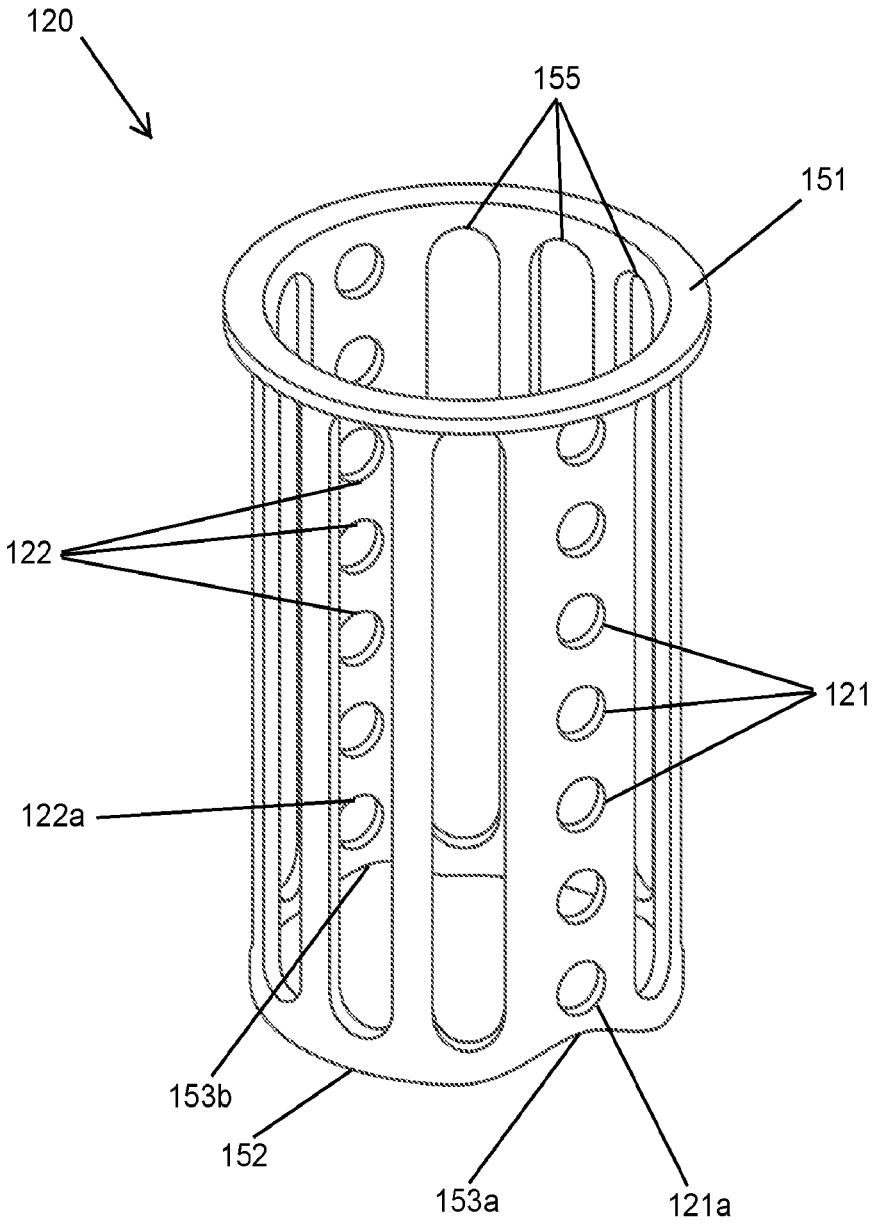
Figure 3:
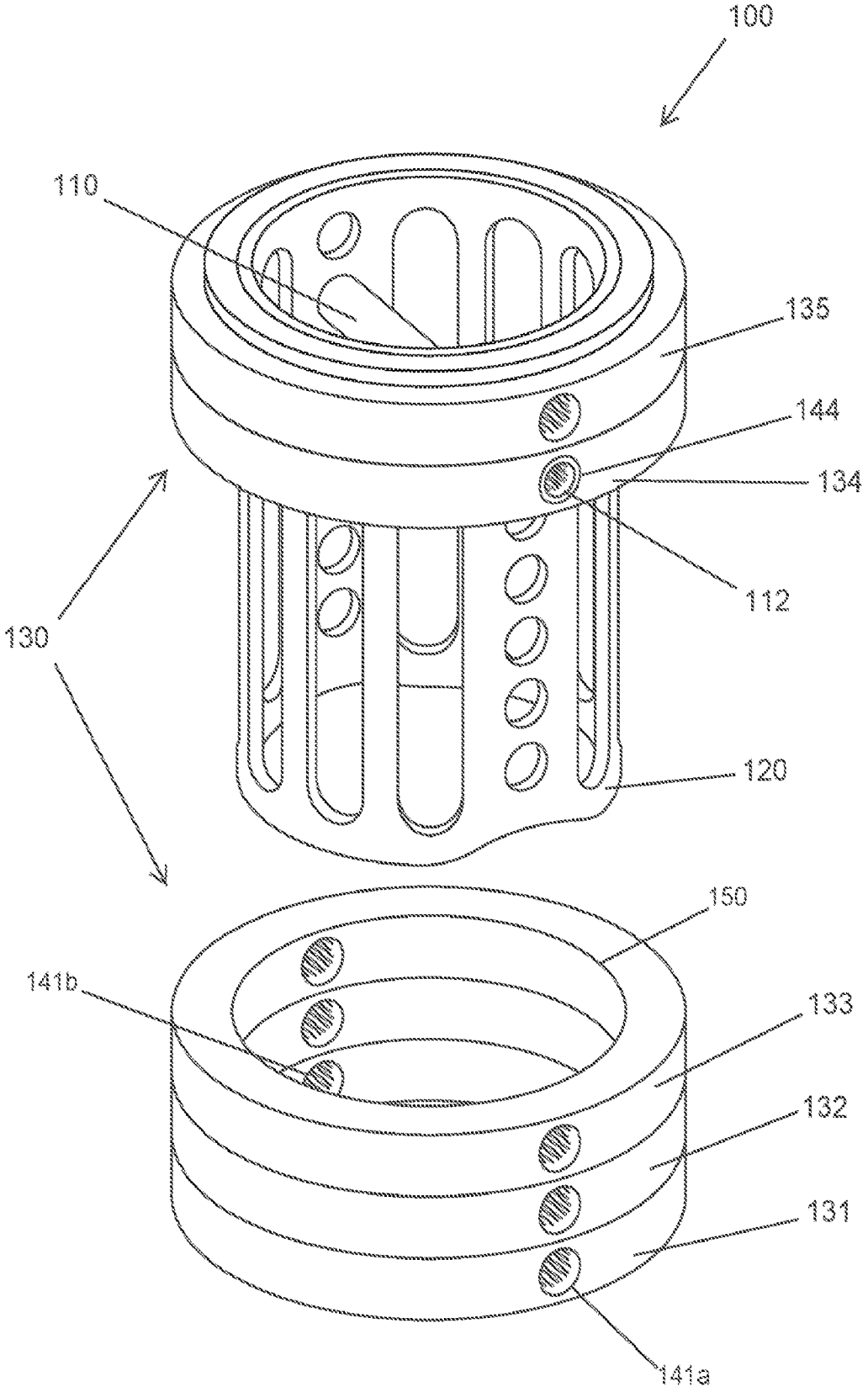

FIGS. 1-3 depict one embodiment of the invention comprising dumbbell system 100. Dumbbell system 100 for exercising within incrementally-variable mass of weights comprises grip 110, which comprises handle portion 111 and weight-selecting portion 112. Handle portion 111 includes a polymer foam. Weight-selecting portion 112 can be a single retractable rod configured to selectively retract into handle portion 111 and to selectively emerge from handle portion 111. Dumbbell system 100 further comprises weight-engagement device 120, which has a plurality of weight-engagement ports 121 configured to receive weight-selecting portion 112 of grip 110. The plurality of weight-engagement ports includes weight-engagement ports 121*a*, 122*a*, and 122. Dumbbell system 100 still further includes a plurality of weight plates 130. Weight-selecting portion 112 also can comprise dual retracting rods coaxially arranged and configured to selectively retract into handle portion 111 and to selectively emerge from handle portion 111 to engage a chosen pair of weight-engagement ports 121*a*, 122*a*. Weight plate 131, for example, comprises grip-engagement port 141*a* configured to receive weight-selecting portion 112 of grip 110. Grip-engagement port 141*a* aligns with weight-engagement port 121*a*. Weight plate 131 also comprises grip-engagement port 141*b* also configured to receive a weight-selecting portion (not seen) of grip 110. Plurality of weight plates 130 provides an incrementally-variable mass of weights for dumbbell system 100. Weight-engagement device 120 further comprises a weight-retaining rim 151 configured to assist in retaining at least one weight plate 137 of the plurality of weight plates 130 on the weight-engagement device 120. Certain other embodiments do not include a weight-retaining rim. Alternatively, grip 110 could be replaced with grip 3610, for example, and weight retaining pin 3661, or optionally grip 3610 with weight retaining pins 1361, 1363.

Weight-engagement device 120 has a cylindrical device shape. In FIG. 2, it can be seen that weight-engagement port 121*a* is positioned above the bottom edge 152 of weight-engagement device 120 so that an athlete grabbing grip 110 can fit her fingers between the grip 110 and a floor or other hard surface on which system 100 stands. Finger recesses 153*a*, 153*b* allow for that accommodation. Weight engagement device 120 further comprises finger holds 155, which are features of the weight engagement device 120 that allows an athlete to lift system 100 with one or more fingertips, thereby strength-training the hand. FIG. 3, in particular, shows that weight plate 133 defines a circle 150 proximate to weight-engagement device 120. In addition, weight plate 133 defines a cylindrical weight shape.

FIG. 3 shows dumbbell system 100 in operation. Grip 110 has been positioned within weight-engagement device 120, and weight-selecting portion 112 has been deployed to emerge through one of weight-engagement ports 121 and grip-engagement port 144 of weight plate 134. Grip 110 has been lifted vertically, causing weight-engagement device 120 and grip 110 to lift weight plates 134, 135 from plurality of weight plates 130. The position of grip 110 has caused dumbbell system 100 to leave behind weight plates 131, 132, 133 from the plurality of weight plates 130. Exercise can commence with grip 110, weight-engagement device 120, and weight plates 134, 135.

Figure 4:
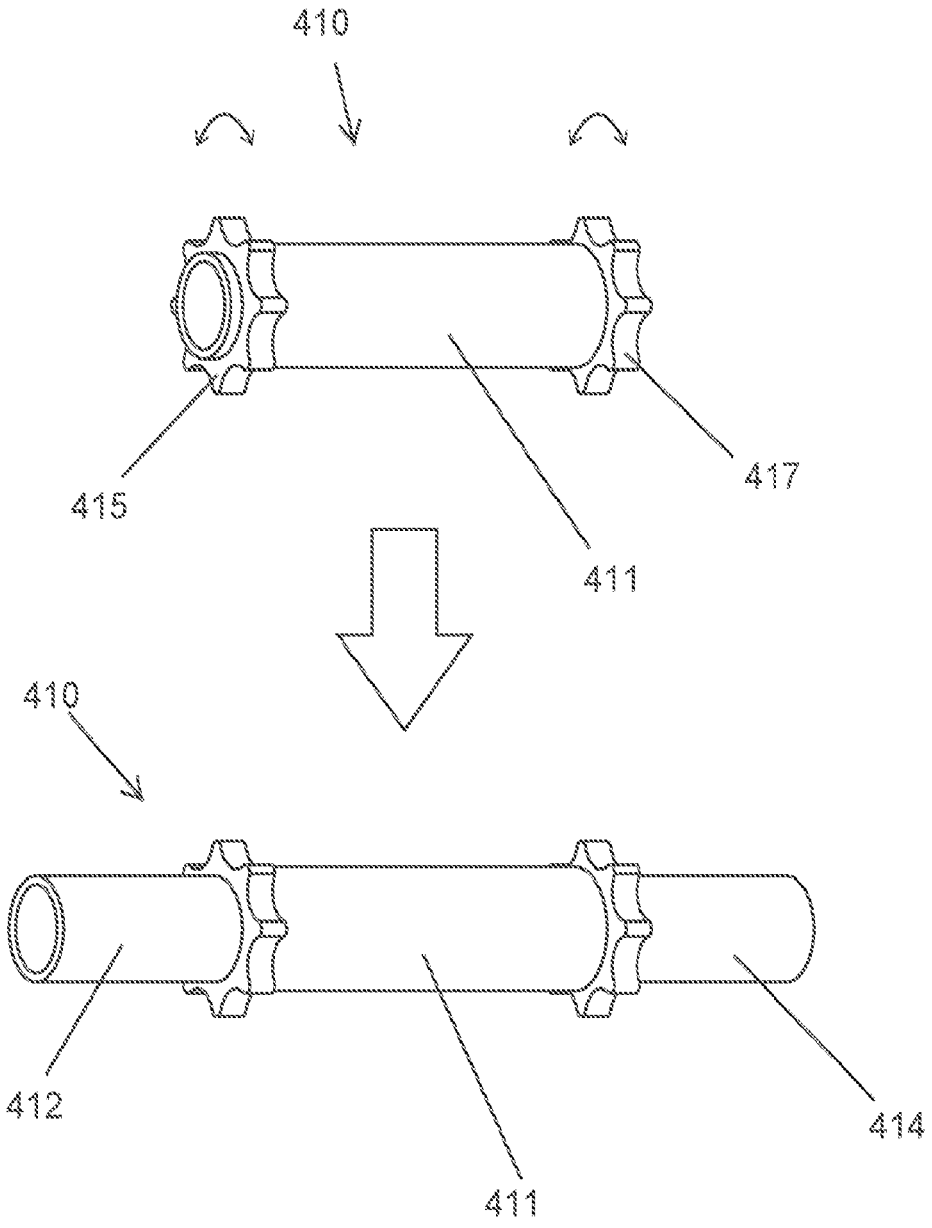
FIG. 4 depicts another embodiment comprising grip 410.

FIG. 4 depicts another embodiment comprising grip 410. Grip 410 comprises handle portion 411 and rod deployment mechanisms in the form of rotating bezels 415, 417. Rotating bezels 415, 417 cause weight-selecting portions in the form of dual coaxial rods 412, 414 to emerge from handle portion 411 of grip 410. Opposite rotation of bezels 415, 417 retract dual coaxial rods 412, 414 into handle portion 411. Grip 410 can be used in place of grip 110, for example, to secure a weight-engagement device such as weight-engagement device 120, and thereby select a number of weight plates such as those of the plurality of weight plates 130. See FIGS. 1-3. It can be said that the weight-selecting portion of grip 410 comprises dual retractable rods 412, 414 coaxially arranged and configured to selectively retract into the handle portion 411 and to selectively emerge from handle portion 411 to engage a chosen pair of weight-engagement ports (e.g., 121*a*, 122*a*) in a plurality of weight-engagement ports (e.g., 121, 122) and a pair of grip-engagement ports (e.g., 141*a*, 141*b*) other grip-engagement port not seen) aligned with the chosen pair of weight-engagement ports (e.g., 121*a*, 122*a*).

Figure 5:
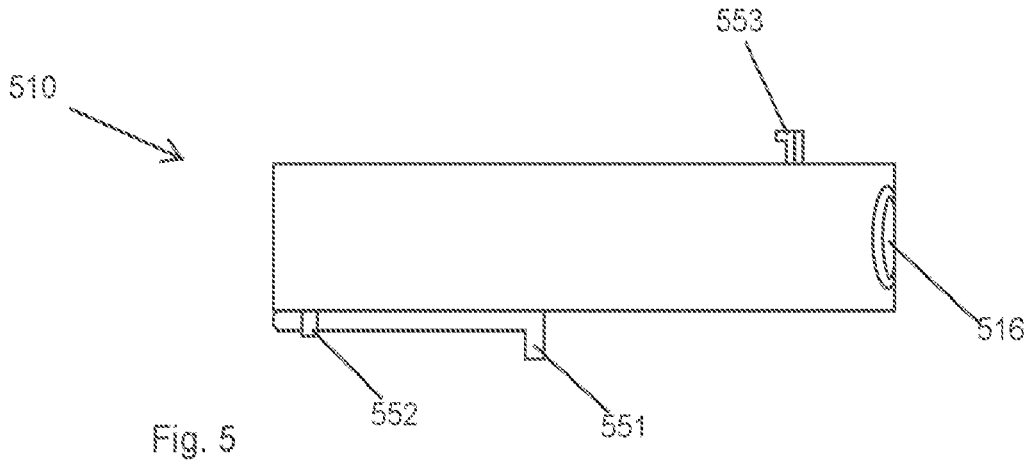
FIG. 5 depicts cylindrical base 510 of telescoping dumbbell system 500 in a side elevation view.
Figure 6:
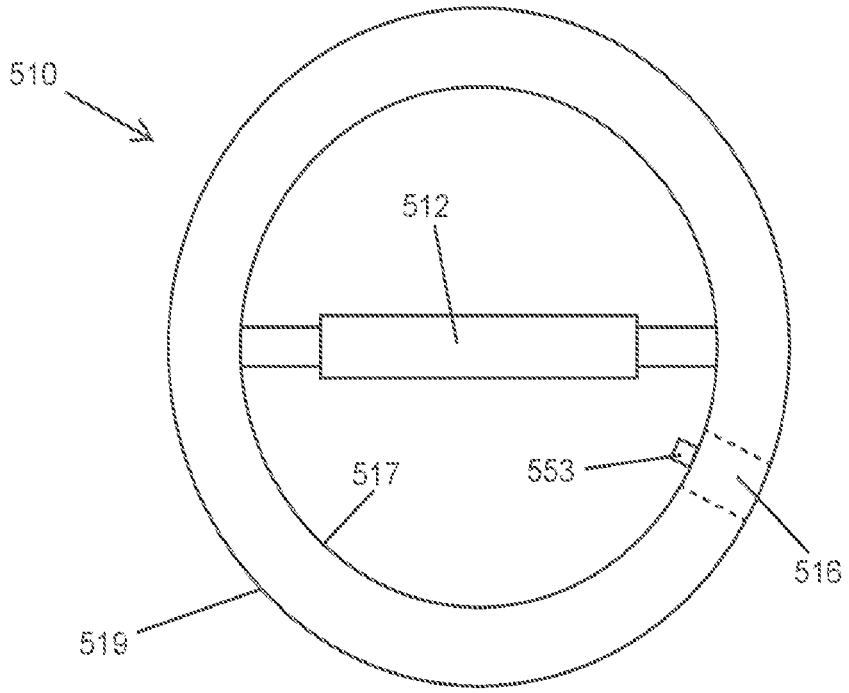
FIG. 6 depicts cylindrical base 510 in a top-down plan view.
Figure 7:
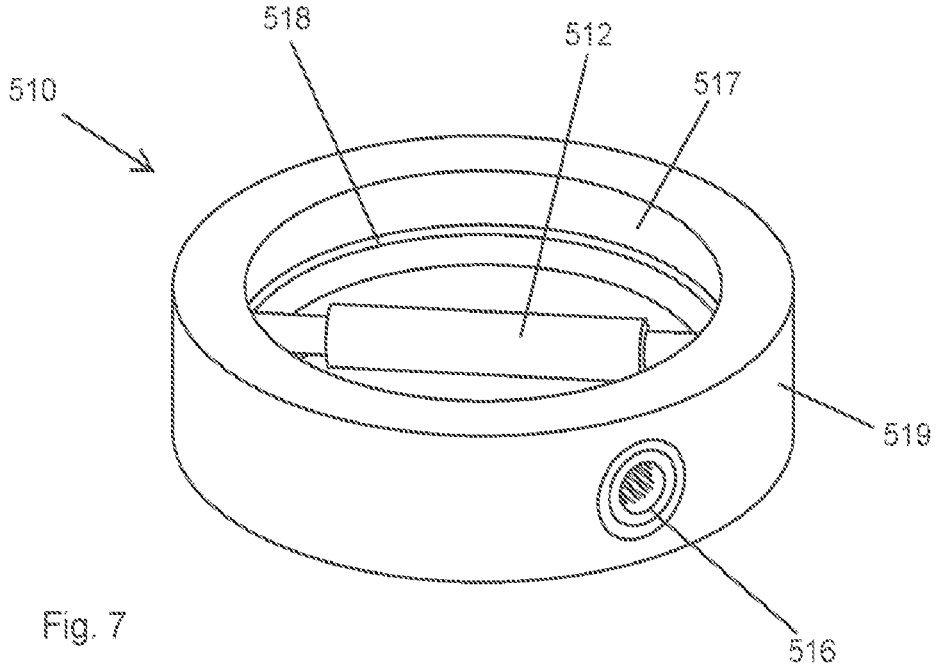
FIG. 7 provides a perspective view of cylindrical base 510 from above.
Figure 8:
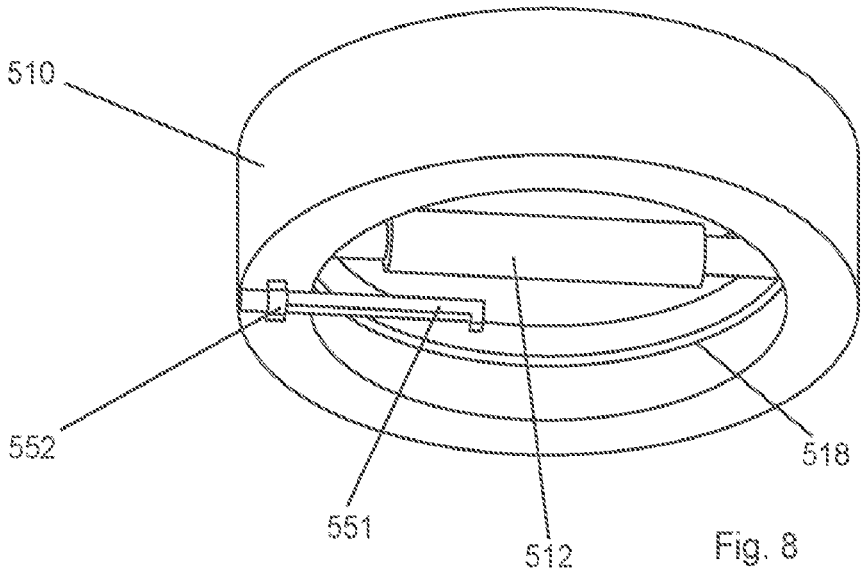
FIG. 8 provides a perspective view of cylindrical base 510 from below.
Figure 9:
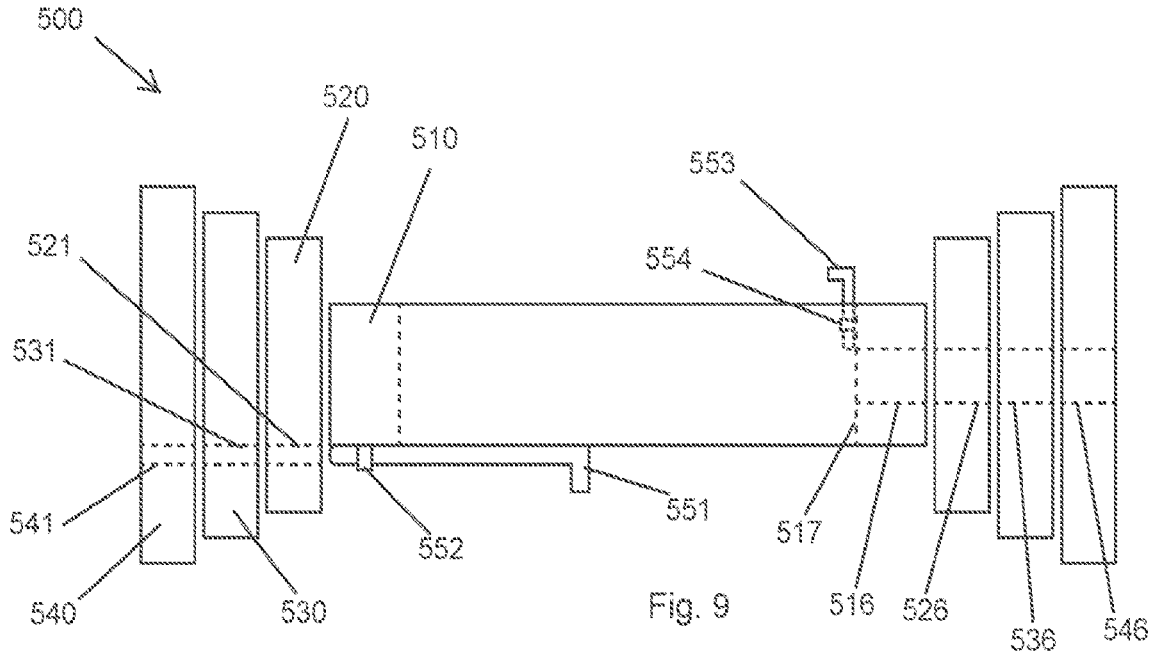
FIG. 9 shows telescoping dumbbell system 500 in a partially cut-away side elevation view.
Figure 10:
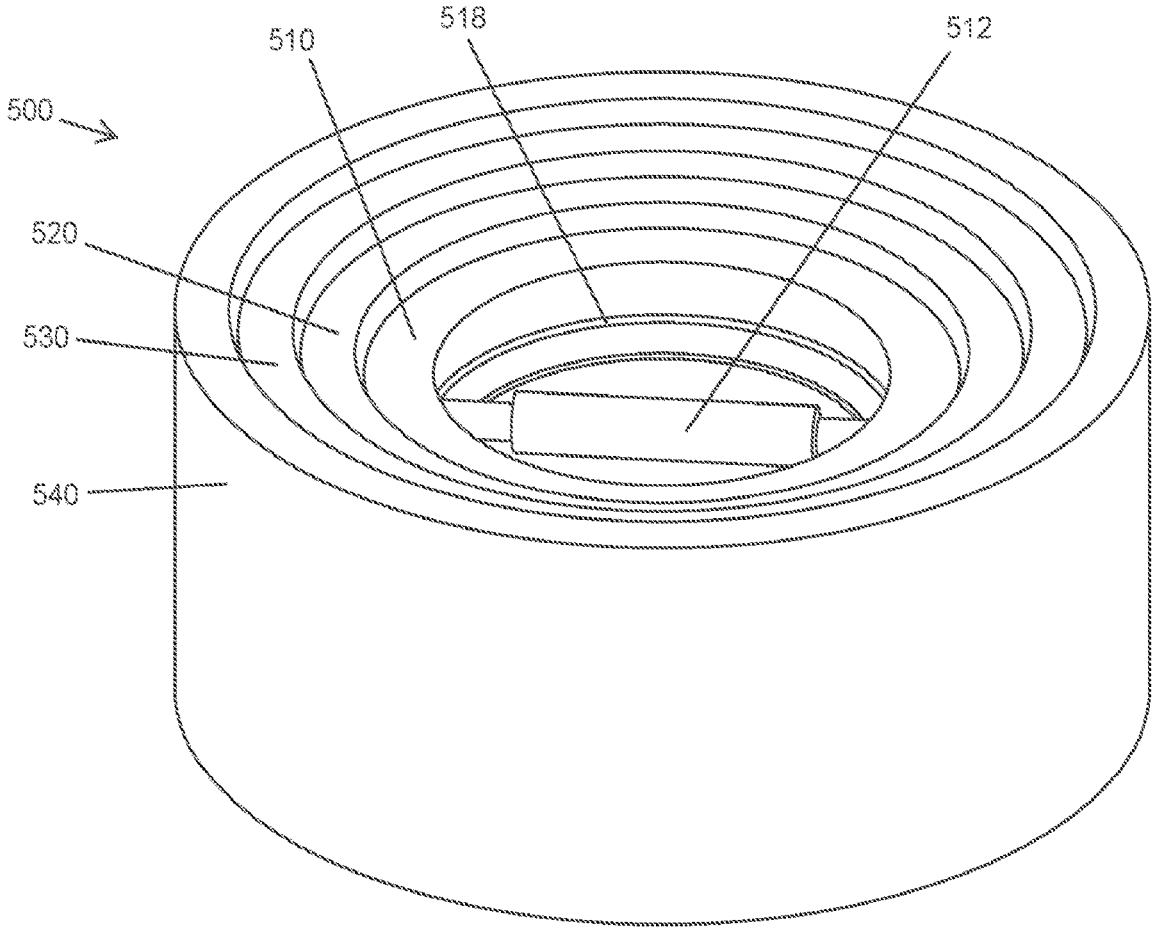
FIG. 10 depicts telescoping dumbbell system 500 in a perspective view from above.

FIG. 5 depicts cylindrical base 510 of telescoping dumbbell system 500 in a side elevation view. FIG. 6 depicts cylindrical base 510 in a top-down plan view. FIG. 7 provides a perspective view of cylindrical base 510 from above. FIG. 8 provides a perspective view of cylindrical base 510 from below. FIG. 9 shows telescoping dumbbell system 500 in a partially cut-away side elevation view. FIG. 10 depicts telescoping dumbbell system 500 in a perspective view from above. Telescoping dumbbell system 500 for exercising with an incrementally-expendable mass of weights, comprises cylindrical base 510 comprising circular bearing race 518 rotationally supporting grab 512. Grab 512 comprises a polymer foam, a rubbery material, or a combination thereof. The bearing race 518 comprises ball bearings, cylindrical bearings, conical bearings, or a combination thereof (not seen). Grab 512 can freely rotate within cylindrical base 510, that is, within the plane of the page of FIG. 6 about an axis normal to the page. Telescoping dumbbell system 500 also includes base weight selecting pin 551 slidably attached to cylindrical base 518 with base weight selecting pin bracket 552. A first plurality of nested weight cylinders 520, 530, 540 includes, in each weight cylinder 520, 530, 540 a first pin engagement port 521, 531, 541, respectively. Each first pin engagement port 521, 531, 541, are adapted to receive base weight selecting pin 551, and are aligned with each other. Each weight cylinder 520, 530, 540 includes barbell engagement ports 526, 536, 546, respectively, which align with each other. Cylindrical base 510 also includes barbell engagement port 516 aligned with barbell engagement ports 526, 536, 546. Cylindrical base 510 also includes barbell engagement pin 553 slidably attached by barbell engagement pin bracket 554 on the interior surface 517 of cylindrical base 510 proximal to barbell engagement port 516. Barbell engagement pin 553 is adapted to engage a weight engagement port (not shown) on a barbell (not shown) when such barbell is present in barbell engagement port 516. Cylindrical base 510 has an exterior surface 519 and fits just inside weight cylinder 520. FIGS. 9 and 10 show how weight cylinders 520, 530, 540 nest one inside the other. FIG. 9 shows weight cylinders 520, 530, 540 cut away to reveal cylindrical base 510. Internal structures such as first pin engagement ports 521, 531, 541, and barbell engagement ports 526, 536, and 546 are shown in dotted-line format.

Figure 11:
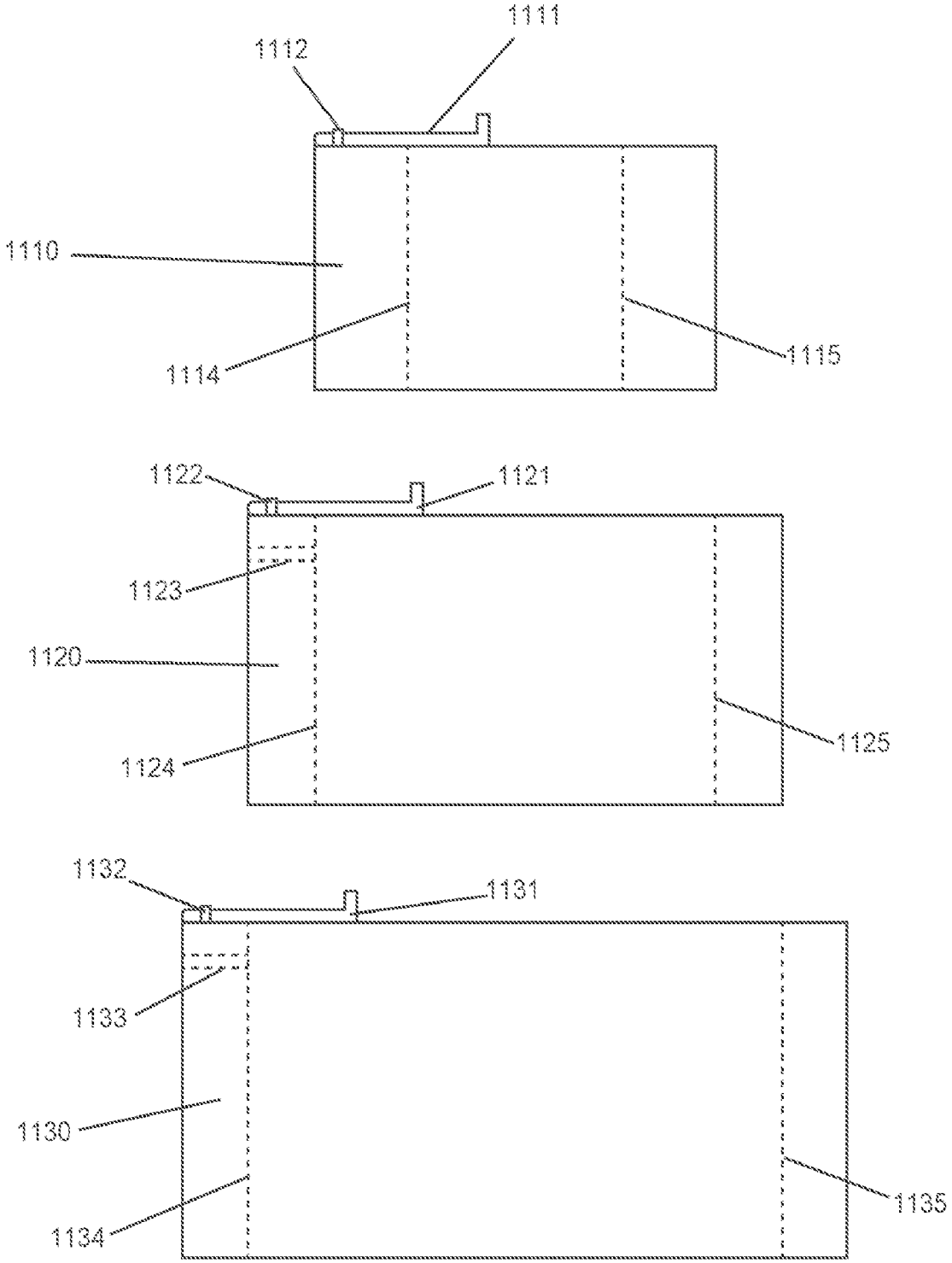
FIG. 11 shows first plurality of nested weight cylinders 1110, second plurality of nested weight cylinders 1120, and third plurality of nested weight cylinders 1130.

FIG. 11 shows first plurality of nested weight cylinders 1110, second plurality of nested weight cylinders 1120, and third plurality of nested weight cylinders 1130. The individual way cylinders of each plurality are not indicated, for clarity. First plurality of nested weight cylinders 1110 has an interior surface shown by lines 1114, 1115 that accommodate a cylindrical base (not shown) similar to cylindrical base 510. First plurality of nested weight cylinders 1110 comprises second weight selecting pin 1111 slidably attached to an outermost weight cylinder in the first plurality of nested weight cylinders 1110 by second weight selecting pin bracket 1112. Second plurality of nested weight cylinders 1120 comprises a number of second pin engagement ports 1123, aligned with each other, and adapted to receive second weight selecting pin 1111. Second plurality of nested weight cylinders 1120 has an interior surface shown by lines 1124, 1125 that accommodates first plurality of nested weight cylinders 1110. Second plurality of nested weight cylinders 1120 also has a third weight selecting pin 1121 slidably attached to an outermost weight cylinder in the second plurality of nested weight cylinders 1120 by third weight selecting pin bracket 1122. Third plurality of nested weight cylinders 1130 includes a number of third pin engagement ports 1133 adapted to receive third weight selecting pin 1121. Third plurality of nested weight cylinders 1130 has an interior surface shown by lines 1134, 1135 that accommodates second plurality of nested weight cylinders 1120. Third plurality of nested weight cylinders 1130 also has a fourth weight selecting pin 1131 slidably attached to an outermost weight cylinder in the third plurality of nested weight cylinders 1130 by fourth weight selecting pin bracket 1132. Fourth weight selecting pin 1131 is adapted to engage a fourth plurality of nested weight cylinders (not shown).

It can be said that a first plurality of nested weight cylinders 520, 530, 540 or 1110 provides an incrementally-expandable mass of weights for exercising. It can be said further that additional pluralities of nested weight cylinders, such as second plurality of weight cylinders 1120, and third plurality of nested weight cylinders 1130, can add to the incrementally-expandable mass of weights.

Figure 12:
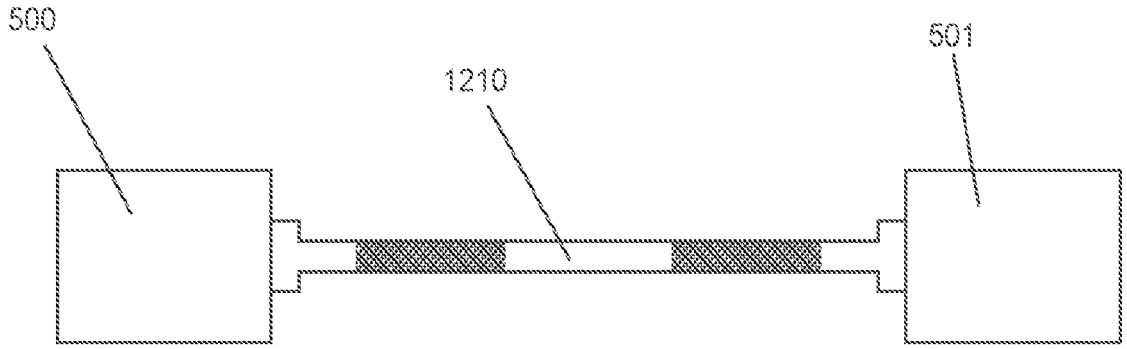
FIG. 12 depicts telescoping dumbbell system 500 attached to barbell 1210.

FIG. 12 depicts telescoping dumbbell system 500 attached to barbell 1210. Also, telescoping dumbbell system 501 is attached to barbell 1210 as well. Telescoping dumbbell systems 500, 501 are substantially identical. Barbell 1210 has been inserted into barbell engagement ports 516, 526, 536, 546, and barbell engagement pin 553 has slid into a weight engagement port (not seen) on barbell 1210 to secure telescoping dumbbell system 500 to barbell 1210.

Figure 13:
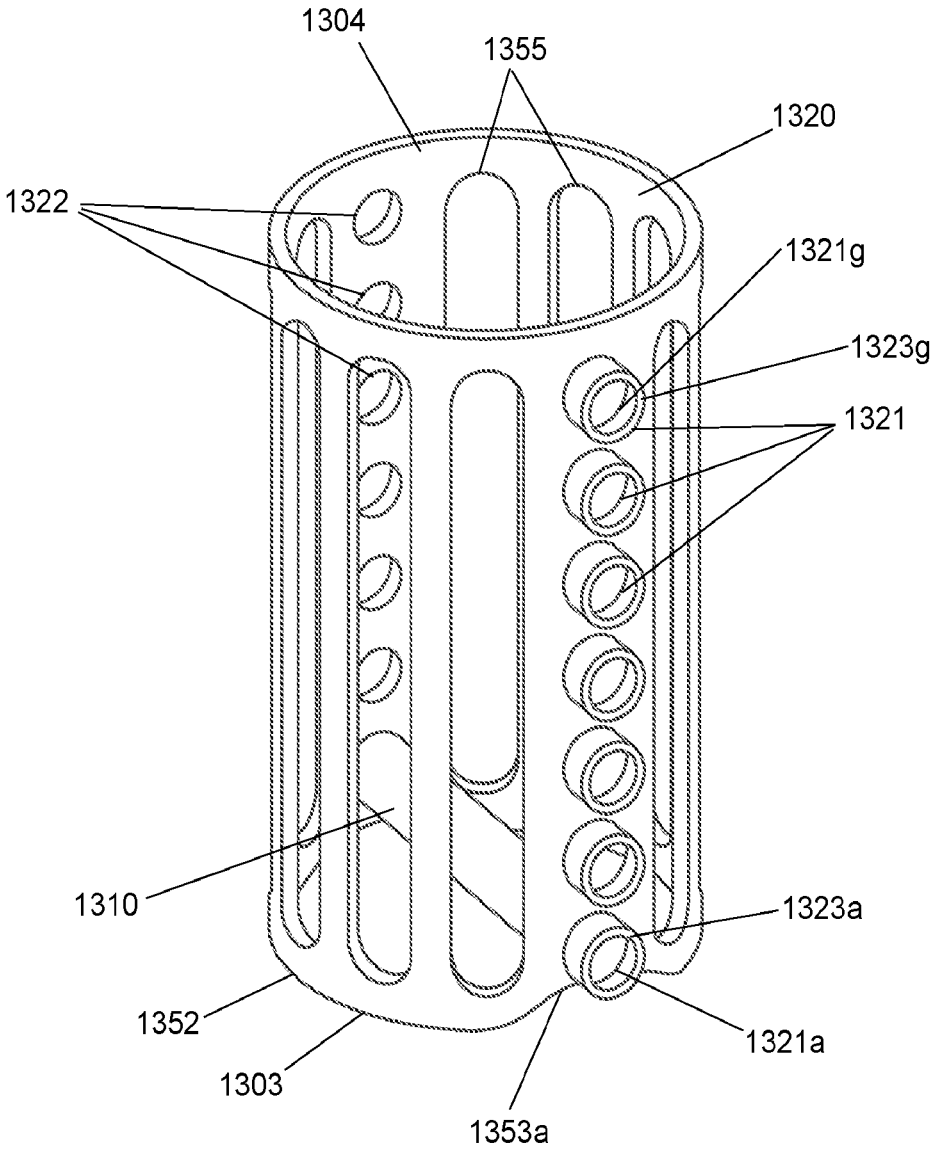
FIGS. 13-15 show dumbbell system 1301 and components thereof.
Figure 14:
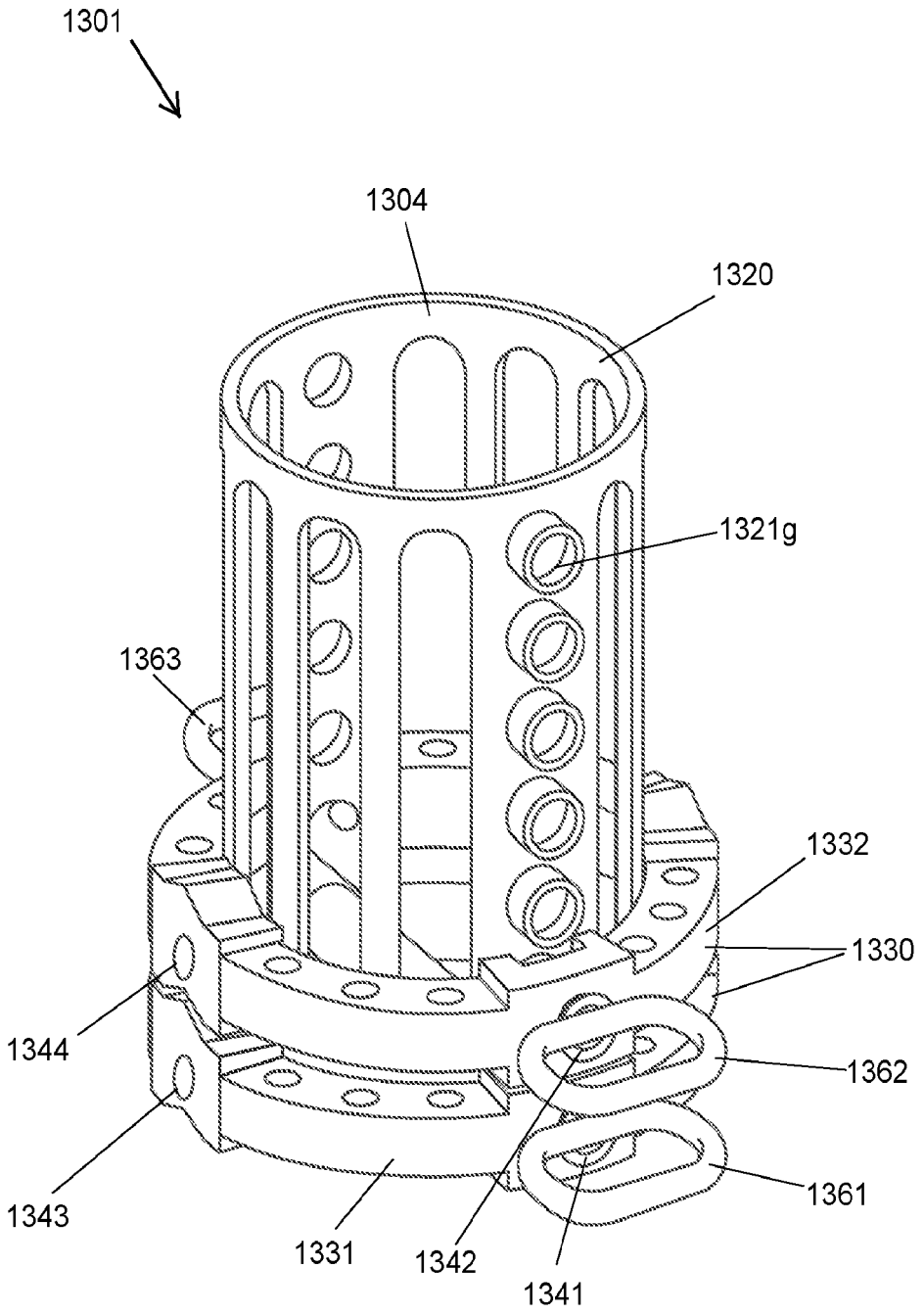
Figure 15:
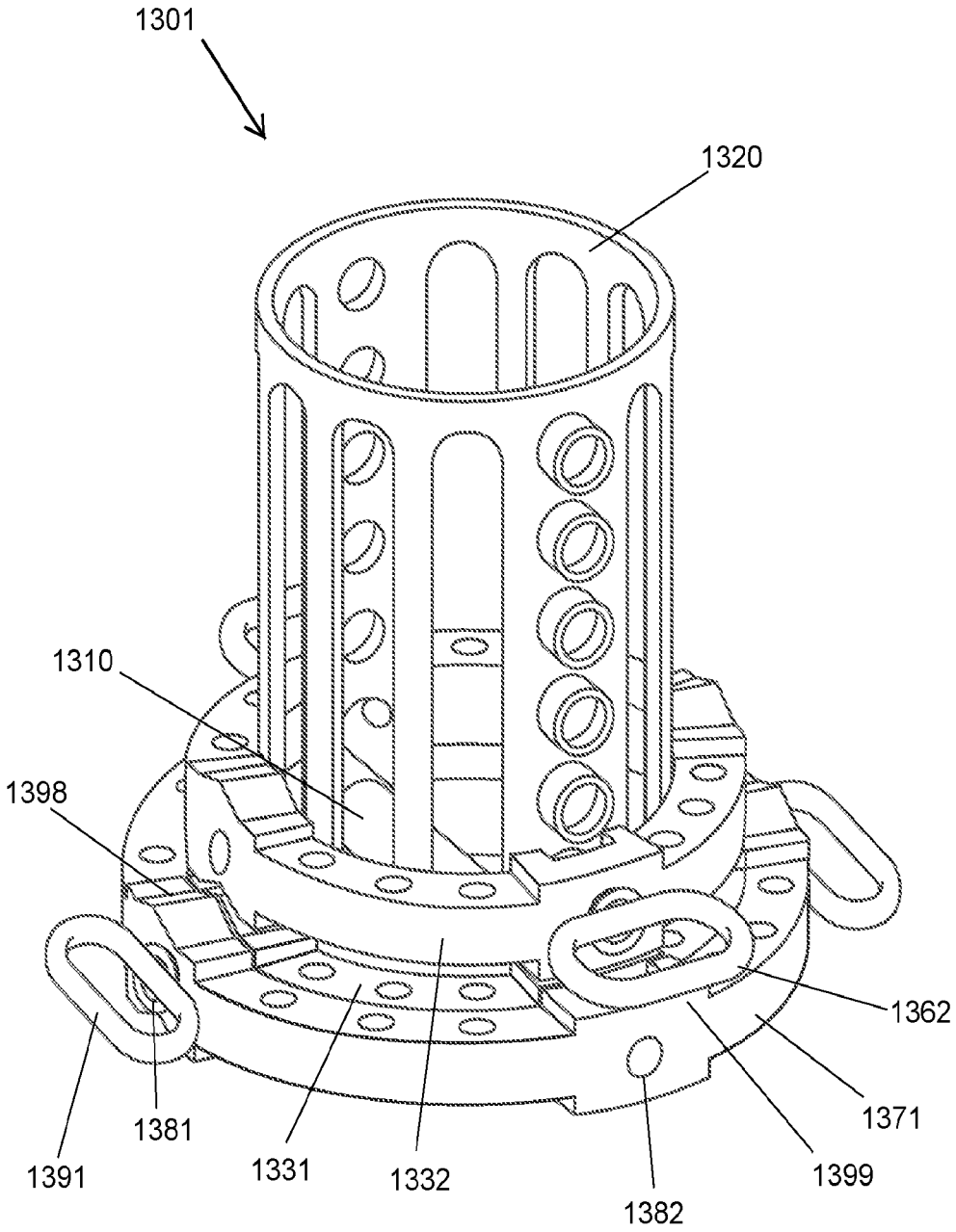

FIGS. 13-15 show dumbbell system 1301 and components thereof. Dumbbell system 1301 comprises weight-engagement device 1320 having a first end 1303 opposite a second end 1304. Grip 1310 comprises a handle portion enclosing a pin-receiving portion (not visible here) and is permanently affixed proximal to first end 1303 and finger recess 1353*a*. It can be seen that grip 1310 is positioned above the bottom edge 1352 of weight-engagement device 1320 so that an athlete grabbing grip 1310 can fit her fingers between the grip 1310 and a floor or other hard surface on which system 1301 stands. A plurality of weight-engagement ports 1321 is dispersed between first end 1303 and second end 1304. Each weight-engagement port in the plurality of weight engagement ports 1321 is configured to receive, for example, weight-retaining pins 1361, 1362, 1363. Each right weight engagement port 1321 aligns with a left weight engagement port 1322. Weight engagement device 1320 further comprises finger holds 1355, which are features of the weight engagement device 1320 that allows an athlete to lift system 1301 with one or more fingertips, thereby strength-training the hand. First plurality of weight plates 1330 includes weight plates 1331, 1332. Weight plate 1331 includes grip-engagement port 1341 configured to receive weight-retaining pin 1361 when grip-engagement port 1341 is aligned with weight-engagement port 1321*a*. Weight-engagement port 1321*g* comprises pin support collar 1323*g*. The plurality of weight plates 1330 provides an incrementally-variable mass of weights. As can be seen, weight-engagement device 1320 exhibits a cylindrical device shape. Weight plate 1332, for example, defines a circle proximate to weight-engagement device 1320.

Dumbbell system 1301 can further comprise a second plurality of weight plates. As shown in FIG. 15, second weight plate 1371 is dimensioned to fit around weight plate 1331. Further weight plates having the same dimensions as second weight plate 1371 can be provided to form a second plurality weight plates for dumbbell system 1301. Second weight plate 1371 includes grip engagement port 1381 which aligns with grip engagement port 1343 of weight plate 1331 to receive secondary weight-retaining pin 1391. Grip engagement port 1382 aligns with grip engagement port 1341, and could receive weight-retaining pin 1361. Second angled stacking structure 1398 and second flat stacking structure 1399 can be seen on second weight plate 1371 in FIG. 15.

Figure 16:
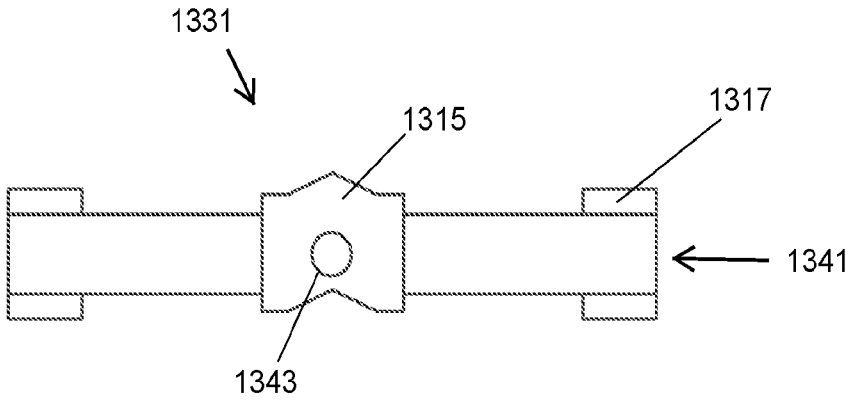
FIGS. 16-17 depict weight plate 1331.
Figure 17:
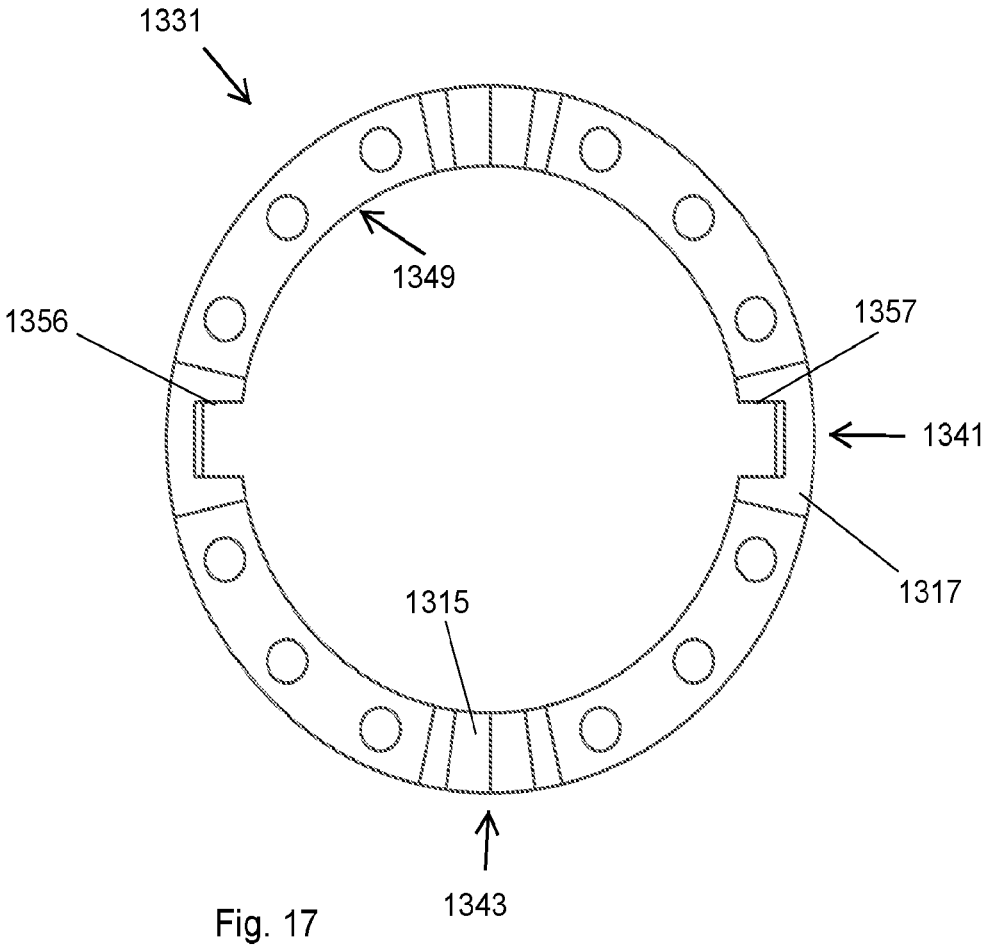
Figure 18:
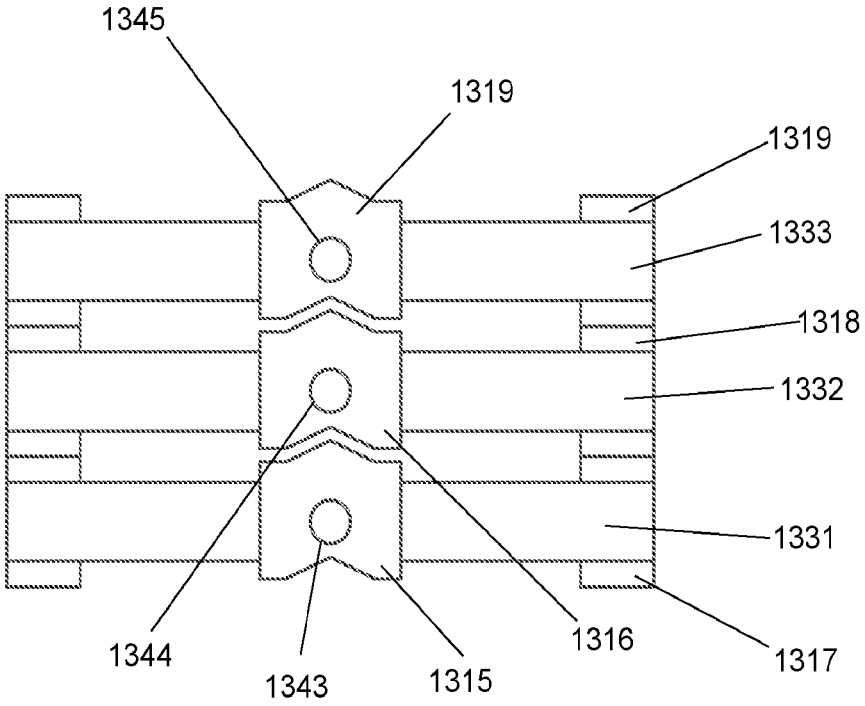
FIG. 18 depicts weight plate 1331 in a plurality of weight plates.

FIGS. 16-17 depict weight plate 1331. FIG. 16 provides a side elevation, and FIG. 17 provides a plan view. Weight plate 1331 has first angled stacking structure 1315 and first flat stacking structure 1317. FIG. 18 depicts weight plate 1331 in a plurality of weight plates. Similarly, weight plate 1332 has first angled stacking structure 1316 add first flat stacking structure 1318. Weight plate 1333 comprises first angled stacking structure 1319 having grip-engagement port 1345, and first flat stacking structure 1329. First angled stacking structures 1315, 1316, 1319 and first flat stacking structures 1317, 1318, 1329 support and separate adjacent weight plates 1331, 1332, 1333 in the first plurality of weight plates 1330. It can be seen that weight plate 1331 defines circle 1349, which is proximate to weight-engagement device 1320 when weight plate 1331 is deployed thereon. Weight plate 1331 also shows weight stabilizing recesses 1356, 1357, that stabilize weight plate 1331 relative to weight-engagement device 1320, and accommodate pin support collars such as pin support collar 1323*a*.

Figure 19:
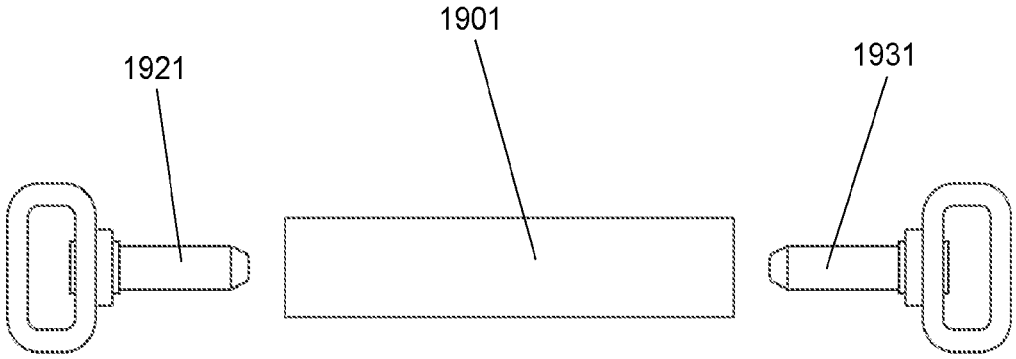
FIG. 19 depicts grip 1901 with weight-retaining pins 1921 and 1931.
Figure 20:
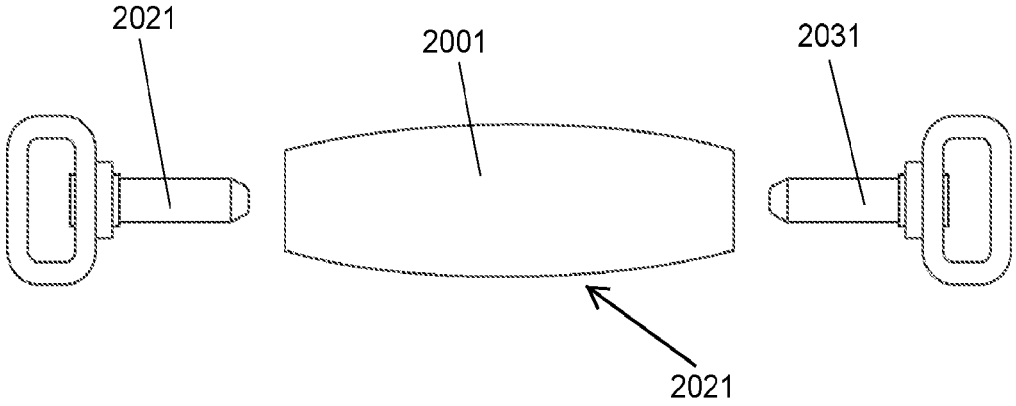
FIG. 20 depicts grip 2001 having an ergonomic shape.

FIG. 19 depicts grip 1901 with weight-retaining pins 1921 and 1931. Grip 1901 could be used, for example, in place of grip 1310 in dumbbell system 1301. Weight-retaining pins 1921, 1931 could be used, for example, in place of weight-retaining pins 1361, 1363. FIG. 20 depicts grip 2001 having an ergonomic shape 2021, along with weight-retaining pins 2021, 2031. Grip 2001 could be used, for example, in place of grip 1310 in dumbbell system 1301. The ergonomic shape of grip 2001 reflects the shape the fingers adopt when closed around an object. The space between the fingers and the thumb is not cylindrical but rather curved, as the middle finger and the ring finger together are longer than the pointer finger and pinky.

Figure 21:
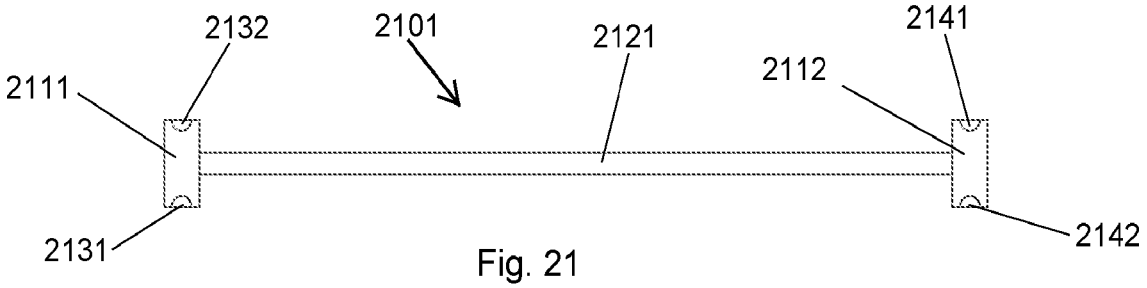
FIG. 21 depicts barbell 2101.

FIG. 21 depicts barbell 2101. Barbell 2101 comprises first barbell end 2111 and second barbell end 2112, both of which are configured to engage any of the dumbbell systems or telescoping dumbbell systems described herein. Gripping portion 2121 appears disposed between first barbell end 2111 and second barbell end 2122. First barbell end 2111 comprises first dumbbell engagement ports 2131, 2132 adapted to receive dumbbell engagement pins (not shown). Second barbell end 2112 comprises second dumbbell engagement ports 2141, 2142 adapted to receive dumbbell engagement pins (not shown). Optionally, first dumbbell engagement ports 2131, 2132 are first dumbbell engagement docks adapted to receive dumbbell engagement locks (not shown; see FIGS. 28-30). Similarly, second dumbbell engagement ports 2141, 2142 may be second double engagement docks adapted to receive dumbbell engagement locks (not shown).

Figure 22:
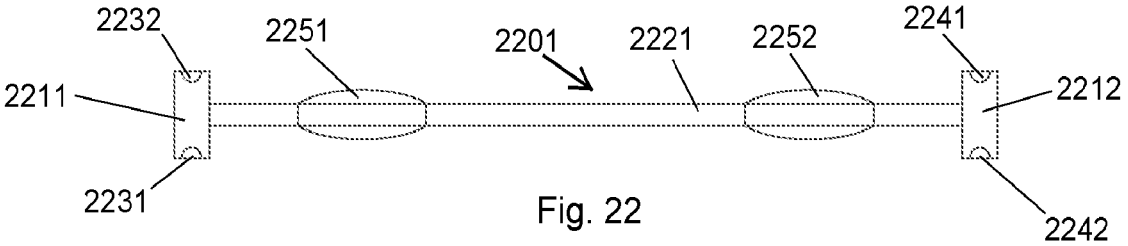
FIG. 22 depicts barbell 2201.

FIG. 22 depicts barbell 2201. Barbell 2201 comprises first barbell end 2211 and second barbell end 2212, both of which are configured to engage any of the dumbbell systems or telescoping dumbbell systems described herein. Gripping portion 2221 appears disposed between first barbell end 2211 and second barbell end 2222. First barbell end 2211 comprises first dumbbell engagement ports 2231, 2232 adapted to receive dumbbell engagement pins (not shown). Second barbell end 2212 comprises second dumbbell engagement ports 2241, 2242 adapted to receive dumbbell engagement pins (not shown). Optionally, first dumbbell engagement ports 2231, 2232 are first dumbbell engagement docks adapted to receive dumbbell engagement locks (not shown; see FIGS. 28-30). Similarly, second dumbbell engagement ports 2241, 2242 may be second double engagement docks adapted to receive dumbbell engagement locks (not shown). Ergonomic grips 2251, 2252 are shown on gripping portion 2221.

Figure 23:
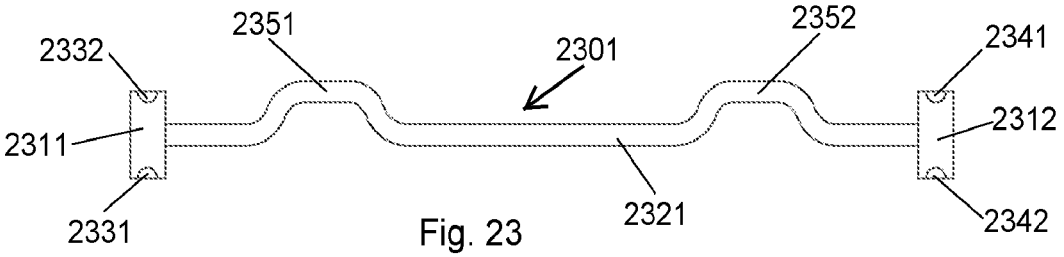
FIG. 23 depicts barbell 2301.

FIG. 23 depicts barbell 2301. Barbell 2301 comprises first barbell end 2311 and second barbell end 2312, both of which are configured to engage any of the dumbbell systems or telescoping dumbbell systems described herein. Gripping portion 2321 appears disposed between first barbell end 2311 and second barbell end 2322. First barbell end 2311 comprises first dumbbell engagement ports 2331, 2332 adapted to receive dumbbell engagement pins (not shown). Second barbell end 2312 comprises second dumbbell engagement ports 2341, 2342 adapted to receive dumbbell engagement pins (not shown). Optionally, first dumbbell engagement ports 2331, 2332 are first dumbbell engagement docks adapted to receive dumbbell engagement locks (not shown; see FIGS. 28-30). Similarly, second dumbbell engagement ports 2341, 2342 may be second double engagement docks adapted to receive dumbbell engagement locks (not shown). Non-coaxial grips 2351, 2352 are shown on gripping portion 2321.

Figure 24:
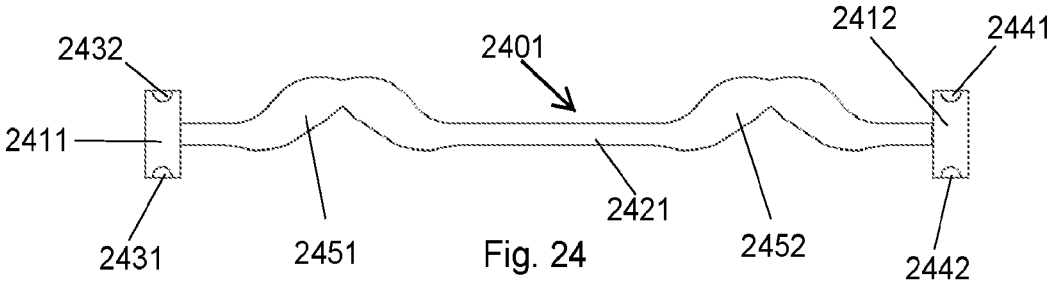
FIG. 24 depicts barbell 2401.

FIG. 24 depicts barbell 2401. Barbell 2401 comprises first barbell end 2411 and second barbell end 2412, both of which are configured to engage any of the dumbbell systems or telescoping dumbbell systems described herein. Gripping portion 2421 appears disposed between first barbell end 2411 and second barbell end 2422. First barbell end 2411 comprises first dumbbell engagement ports 2431, 2432 adapted to receive dumbbell engagement pins (not shown). Second barbell end 2412 comprises second dumbbell engagement ports 2441, 2442 adapted to receive dumbbell engagement pins (not shown). Optionally, first dumbbell engagement ports 2431, 2432 are first dumbbell engagement docks adapted to receive dumbbell engagement locks (not shown; see FIGS. 28-30). Similarly, second dumbbell engagement ports 2441, 2442 may be second double engagement docks adapted to receive dumbbell engagement locks (not shown). Non-coaxial ergonomic grips 2451, 2452 are shown on gripping portion 2421.

Figure 25:
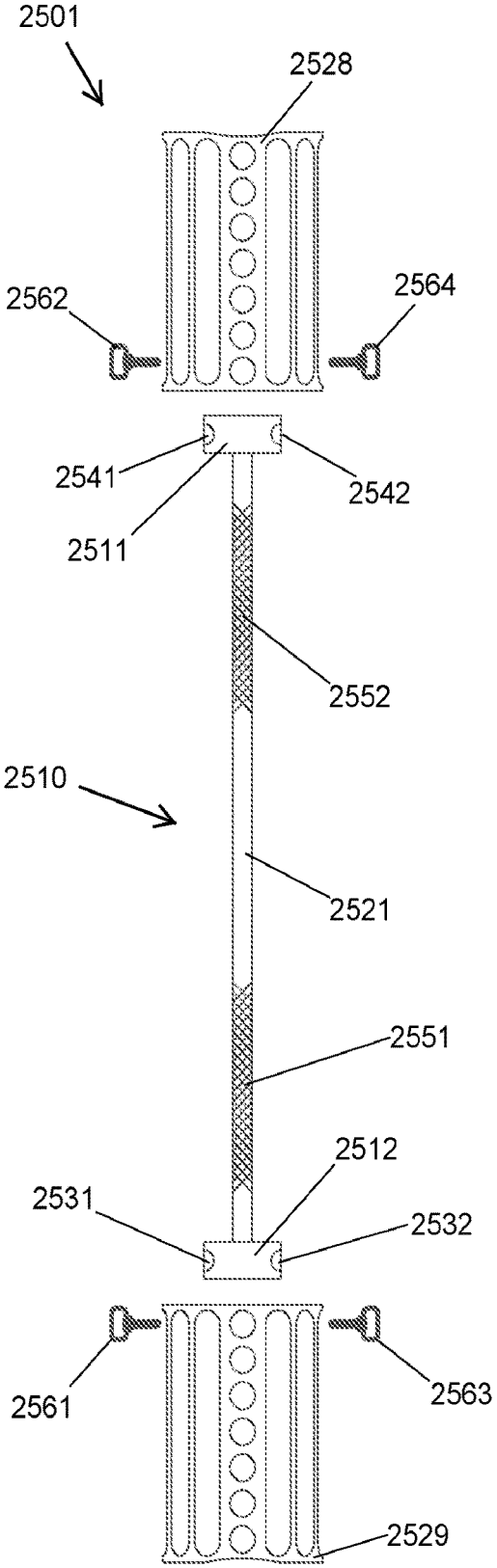
FIG. 25 depicts barbell system 2501.

FIG. 25 depicts barbell system 2501. Barbell 2510 comprises first barbell end 2511 and second barbell end 2512, both of which are configured to engage any of the dumbbell systems or telescoping dumbbell systems described herein. Weight engagement devices 2528 and 2529, similar to weight engagement device 1320, are depicted. Gripping portion 2521 appears disposed between first barbell end 2511 and second barbell end 2512. First barbell end 2511 comprises first dumbbell engagement ports 2531, 2532 adapted to receive dumbbell engagement pins 2561, 2563, respectively. Second barbell end 2512 comprises second dumbbell engagement ports 2541, 2542 adapted to receive dumbbell engagement pins 2562, 2564, respectively. Textured grips 2551, 2552 are shown on gripping portion 2521.

Figure 26:
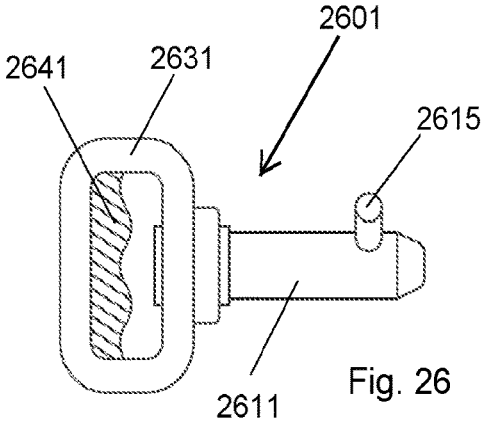
FIG. 26 illustrates weight-retaining pin 2601.

FIG. 26 illustrates weight-retaining pin 2601. Shank 2611 holds spring-loaded post 2615, which is operated by retraction grip 2641 located in fingerhold 2631. When it is time to remove the weight-retaining pin 2601, the athlete squeezes retraction grip 2641 to withdraw spring-loaded post 2615 into shank 2611. That action releases the weight-retaining pin 2601 from a grip-engagement port (not shown), and weight-retaining pin 2601 can be pulled out.

Figure 27:
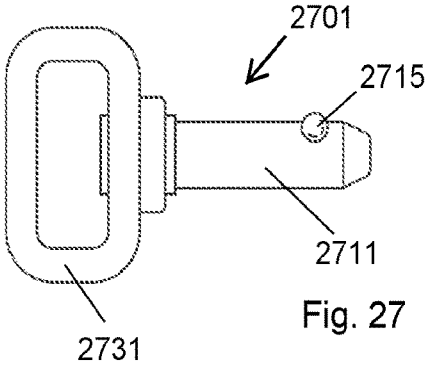
FIG. 27 illustrates weight-retaining pin 2701.

FIG. 27 illustrates weight-retaining pin 2701. Shank 2711 holds spring-loaded ball bearing 2715. Fingerhold 2731 allows an athlete to grab weight-retaining pin 2701 and remove it from a grip engagement port (not shown), a weight-engagement port, or both, for example.

Figure 28:
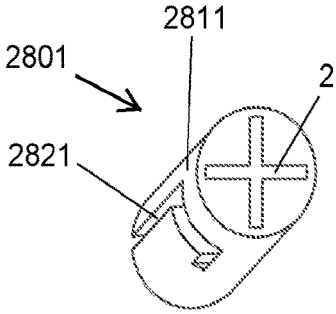
FIG. 28 provides a perspective view of dumbbell engagement lock 2801.

FIG. 28 provides a perspective view of dumbbell engagement lock 2801. Dumbbell engagement lock 2801 is shaped to fit within a dumbbell engagement dock (not shown) conforming to its cylindrical shape 2811. A compatible dumbbell engagement dock would include a dumbbell locking post (not shown) configured to fit into dumbbell locking groove 2821. Screw driver structure 2831 is adapted to allow a Phillips-head screwdriver to assist in joining and removing dumbbell engagement lock 2801 with a compatible dumbbell engagement dock.

Figure 29:
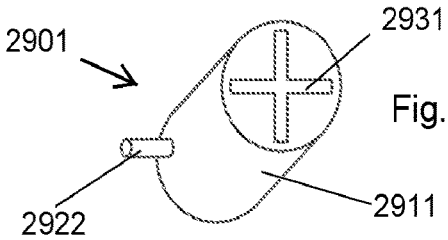
FIG. 29 provides a perspective view of dumbbell engagement lock 2901.
Figure 30:
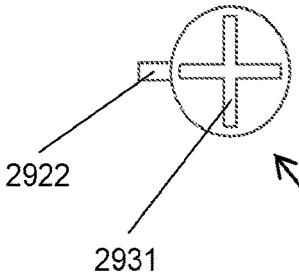
FIG. 30 provides an elevation view of dumbbell engagement lock 2901.

FIG. 29 provides a perspective view of dumbbell engagement lock 2901. FIG. 30 provides an elevation view of dumbbell engagement lock 2901. Dumbbell engagement lock 2901 is shaped to fit within a dumbbell engagement dock (not shown) conforming to its cylindrical shape 2911. A compatible dumbbell engagement dock would include a dumbbell locking groove (not shown) configured to receive dumbbell locking post 2922. Screw driver structure 2931 is adapted to allow a Phillips-head screwdriver to assist in joining and removing dumbbell engagement lock 2901 with a compatible dumbbell engagement dock.

Figure 31:
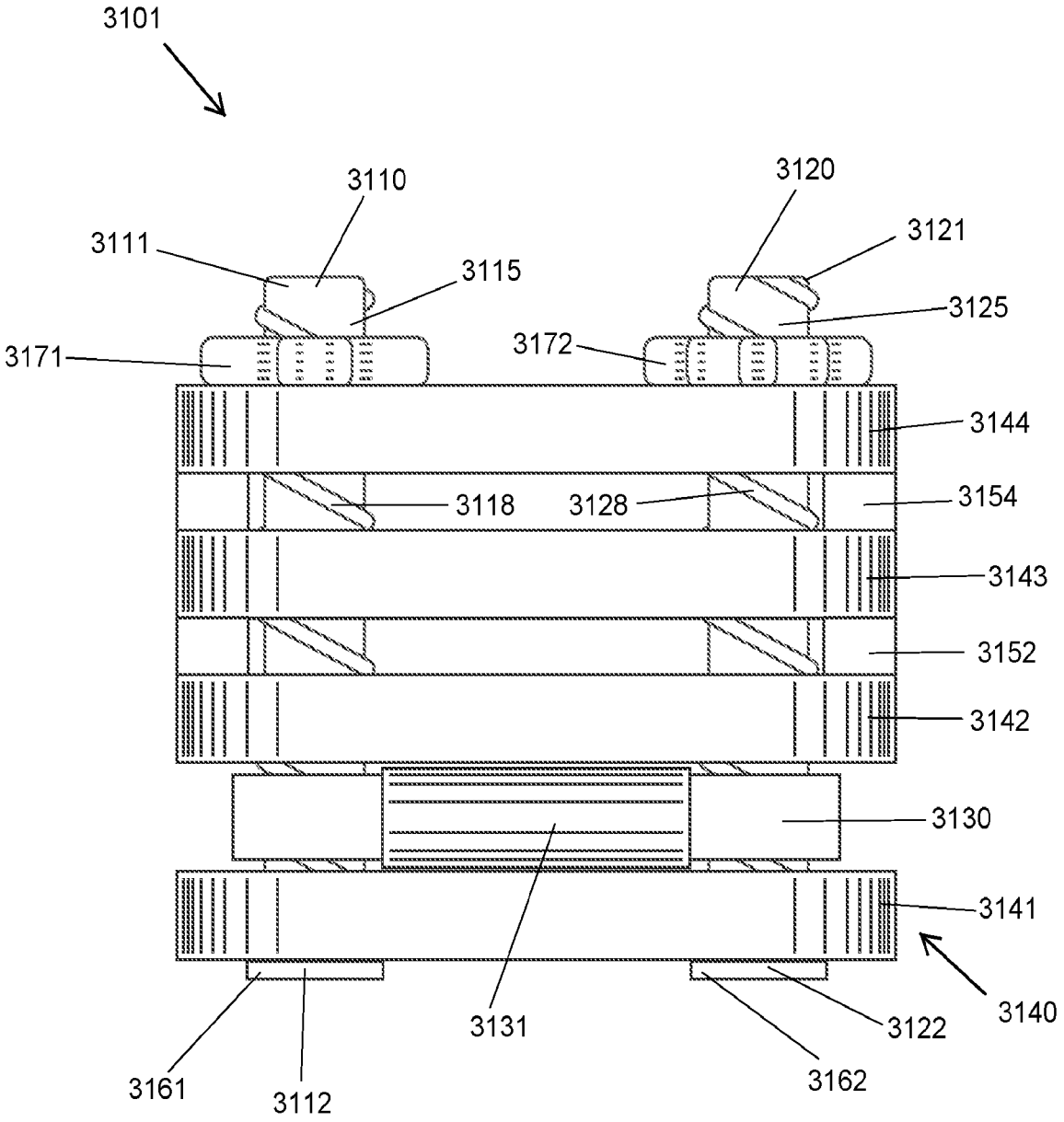
FIGS. 31-35 show dumbbell system 3101 and components thereof.
Figure 32:
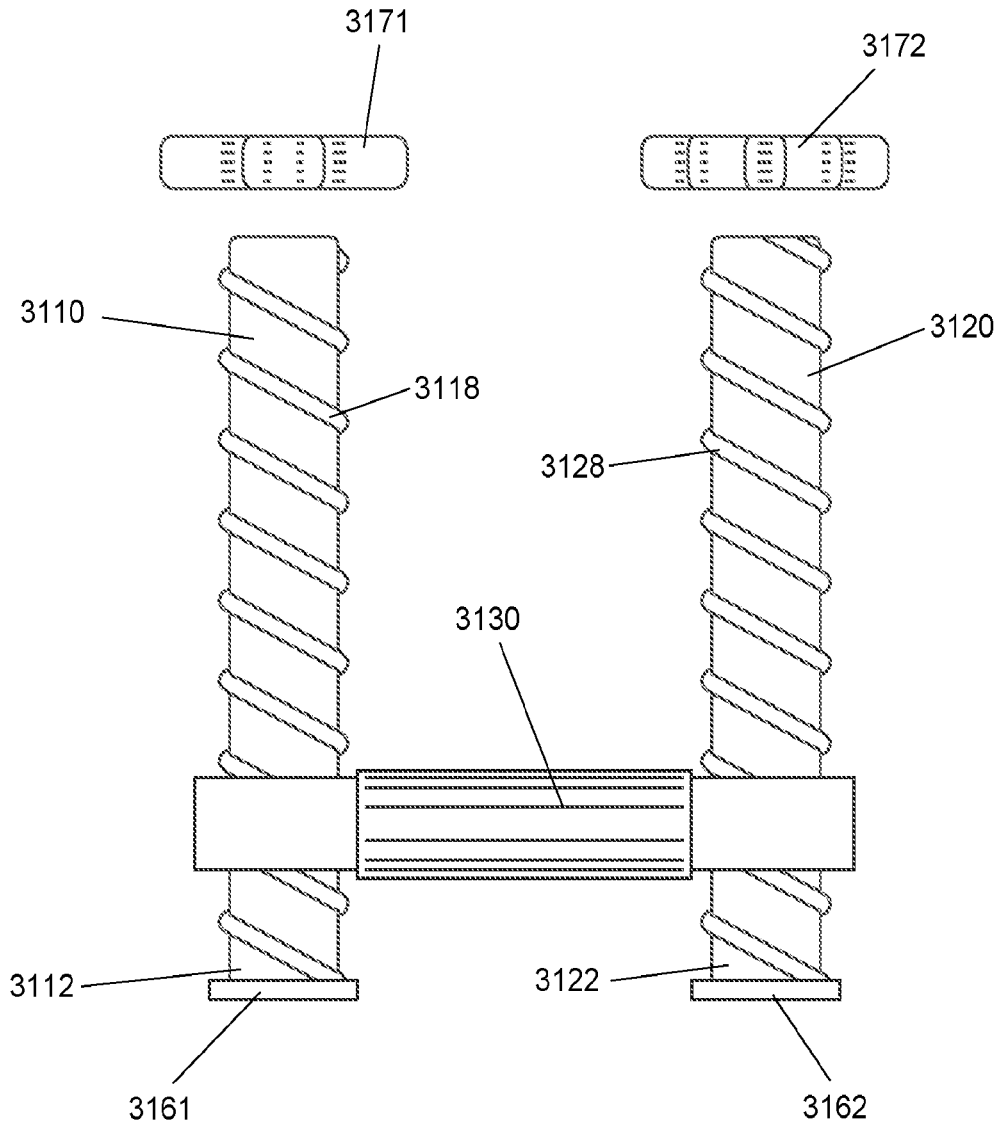
Figure 33:
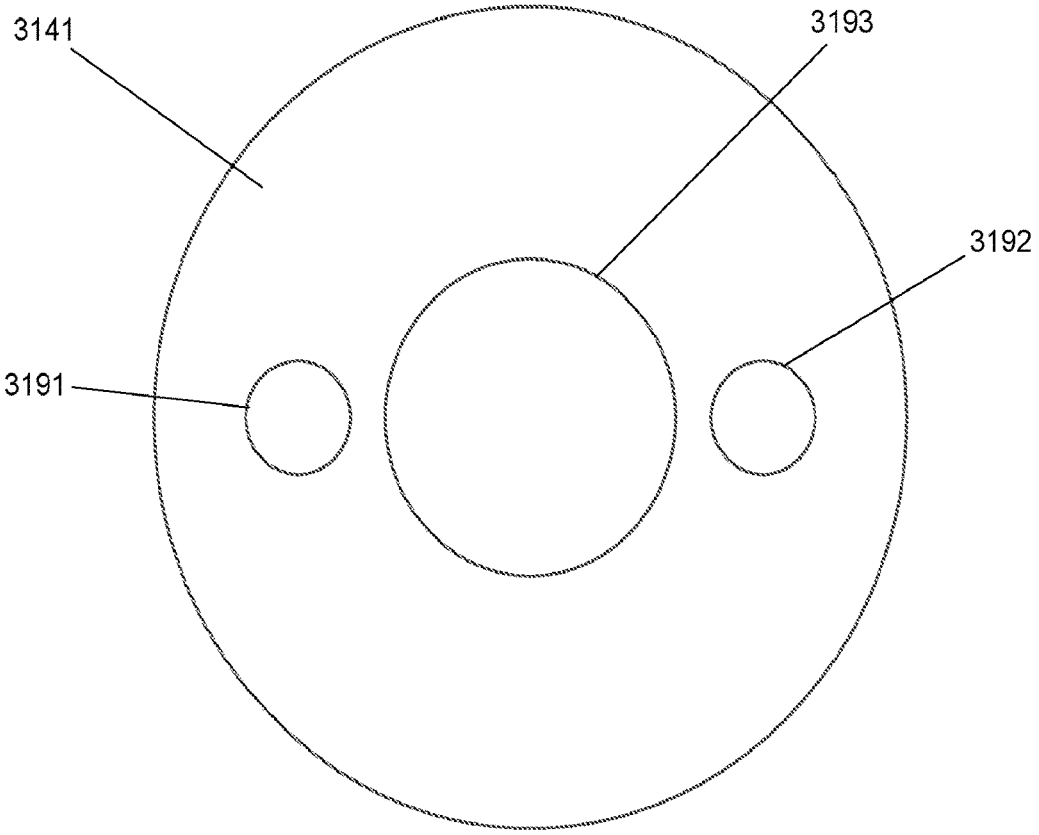
Figure 34:
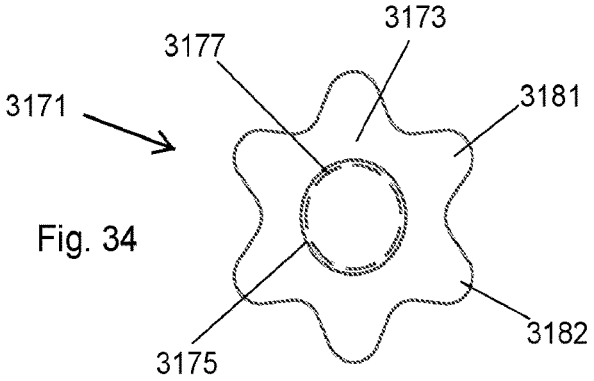
Figure 35:
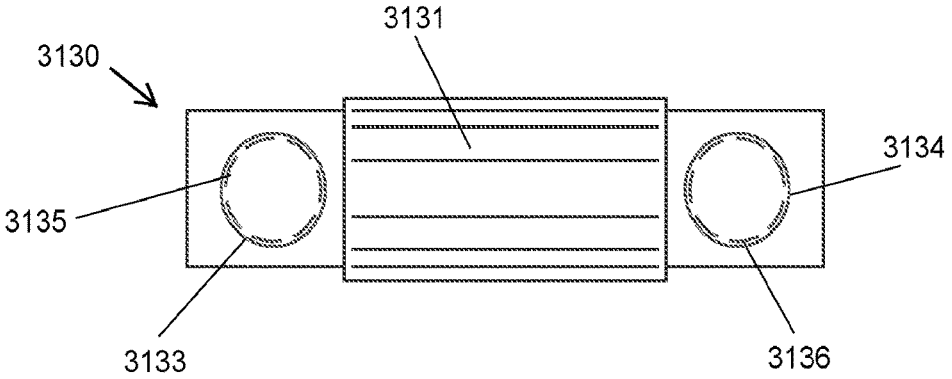

FIGS. 31-35 show dumbbell system 3101 and components thereof. FIG. 31 provides a side elevation view of system 3101. FIG. 32 shows a side elevation view of the system without the plurality of weight plates 3140. FIG. 33 shows a plan view of weight plate 3141. FIG. 34 depicts weight keeper 3171 in a plan view. FIG. 35 depicts hold 3130 in a plan view. Dumbbell system 3101 for exercising with an incrementally-variable mass of weights comprises left weight engagement rod 3110 and right engagement rod 3120. Left weight engagement rod 3110 has shaft 3115 having top tip 3111 and bottom tip 3112, and screw thread 3118 along at least a portion of shaft 3115. Right weight engagement rod 3120 has shaft 3125 having top tip 3121 and bottom tip 3122, and screw thread 3128 along at least a portion of shaft 3125. Hold 3130 includes gripping portion 3131 adjacent left rod engagement opening 3133 and right rod engagement opening 3134. Left rod engagement opening 3133 includes complementary screw thread 3135 for engaging screw thread 3118 of left weight engagement rod 3110. Right rod engagement opening 3134 includes complementary screw thread 3134 for engaging screw thread 3128 of right weight engagement rod 3120.

Plurality of weight plates 3140 in dumbbell system 3101 includes weight plates 3141, 3142, 3143, 3144. Weight plate 3141 includes weight engagement ports 3191, 3192 for receiving weight engagement rods 3110, 3120, respectively. Opening 3193 is dimensioned to receive a human hand grasping hold 3130. Left stabilizing end cap 3161 is integrally affixed to bottom tip 3112 of shaft 3115. Right stabilizing end cap 3162 is integrally affixed to bottom tip 3122 of shaft 3125. Weight keepers 3171, 3172 appear on weight engagement rods 3110, 3120, respectively. Weight keepers 3171, 3172, stabilizing end caps 3161, 3162, and hold 3130 keep the plurality of weight plates 3140 on the weight engagement rods 3110, 3120. Weight keeper 3171 includes body 3173 with rod receiving port 3175 having keeper screw thread 3177 for engaging screw thread 3118 of left engagement rod 3110. Finger knobs 3181, 3182 appear for manipulating weight keeper 3171. Weight plates 3142, 3143 include stacking structures 3152, 3154 to support and separate adjacent weight plates 3142, 3143, 3144 in the plurality of weight plates 3140.

Figure 36:
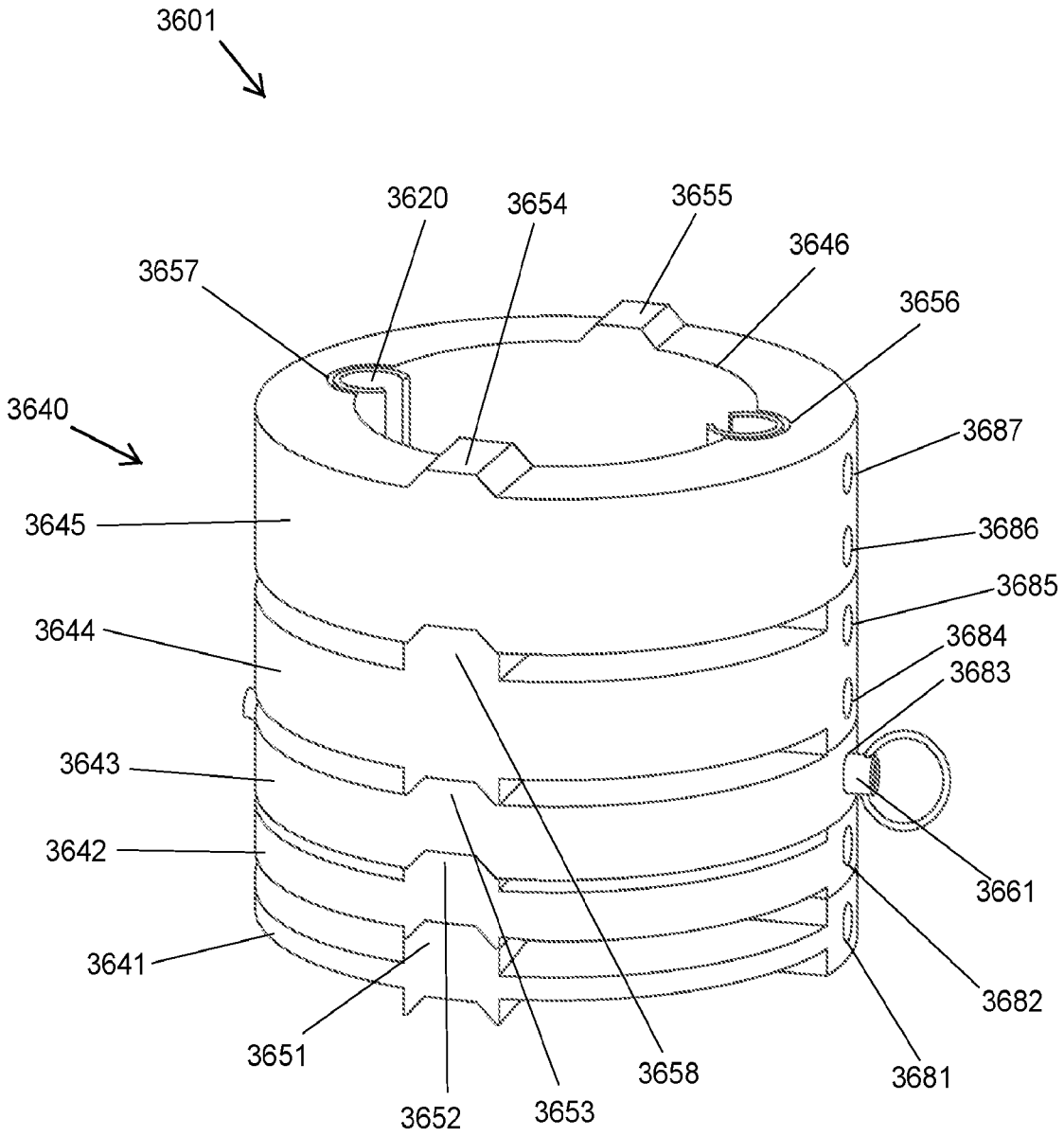
FIGS. 36-40 depict dumbbell system 3601 and components thereof.
Figure 37:
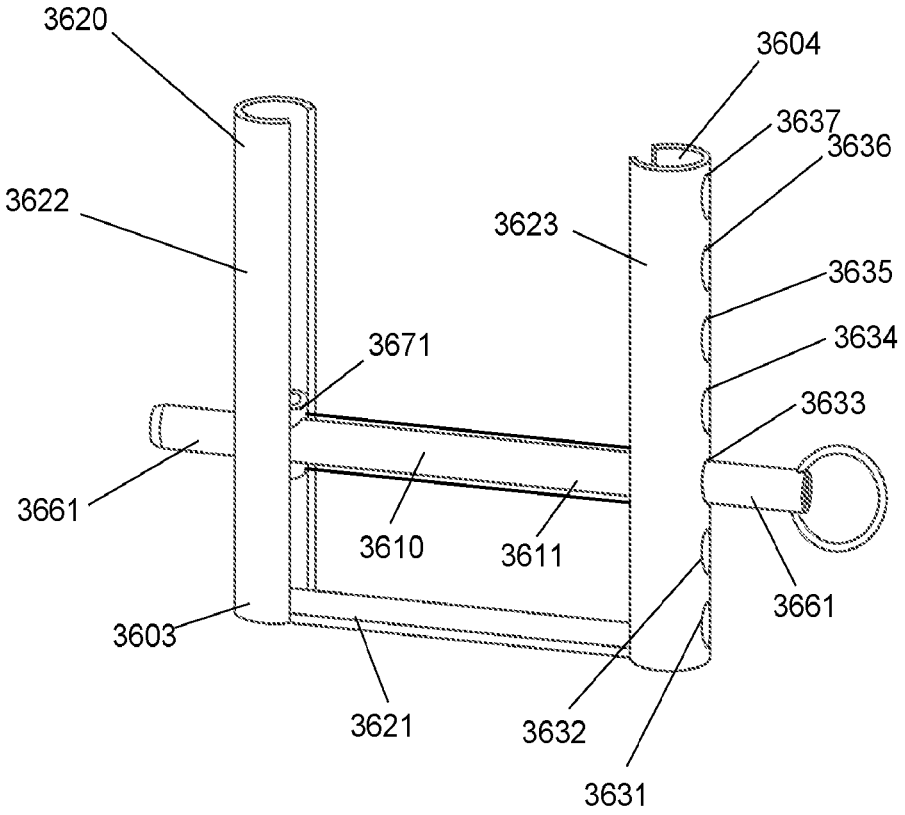
Figure 38:
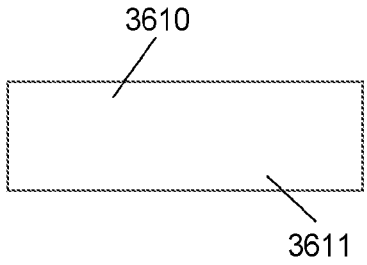
Figure 39:
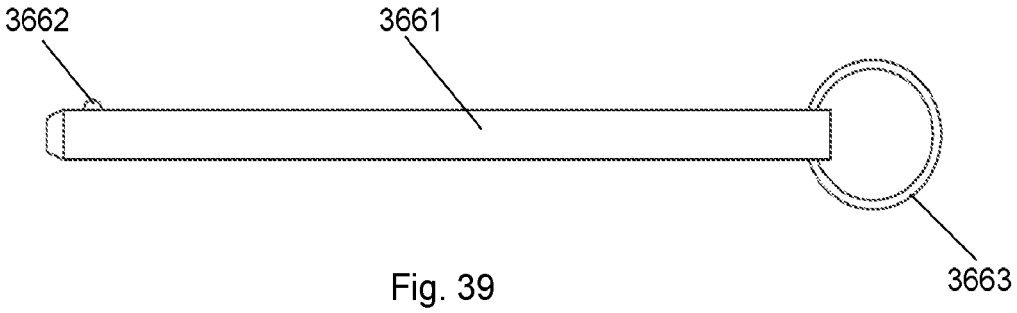
Figure 40:
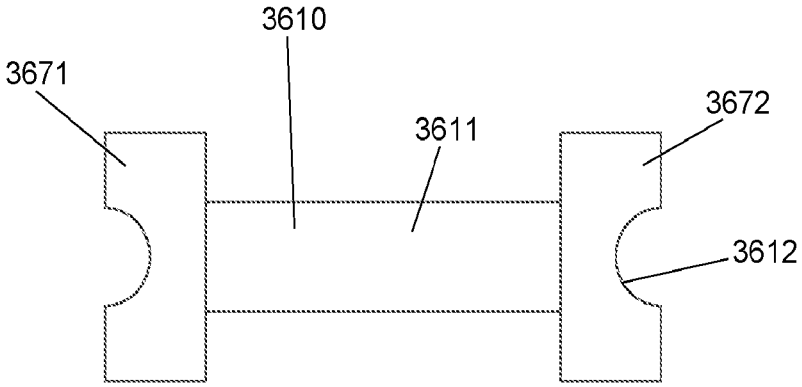

FIGS. 36-40 depict dumbbell system 3601 and components thereof. FIG. 36 provides a perspective view of dumbbell system 3601. FIG. 37 provides a perspective view of the system without the plurality of weight plates 3640. FIG. 38 shows a part of grip 3610, namely the handle portion 3611 enclosing pin-receiving portion 3612. FIG. 39 depicts weight retaining pin 3661. FIG. 40 depicts grip 3610 with rotation guides 3671, 3672. Dumbbell system 3601, for exercising with an incrementally-variable mass of weights, comprises grip 3610 comprising handle portion 3611 enclosing pin-receiving portion 3612. Weight engagement device 3620 has first end 3603 opposite second end 3604, and includes a plurality 3630 of weight engagement ports 3631, 3632 3633, 3634, 3635, 3636, 3637 dispersed between first end 3603 and second end 3604. Each of the weight-engagement ports 3631-3637 are configured to receive weight-retaining pin 3661. As can be appreciated, single weight-retaining pin 3661 could be replaced, for example, by two weight-retaining pins 1361, 1363.

Dumbbell system 3601 also comprises a first plurality 3640 of weight plates 3641, 3642, 3643, 3644, 3645, which include grip-engagement ports 3681, 3682, 3683, 3684, 3685, 3686, 3687, as shown, each configured to also receive weight-retaining pin 3661. Grip-engagement port 3683 is adapted to align with weight-engagement port 3633 and receive weight retaining pin 3661. The first plurality of weight plates 3640 provides an incrementally-variable mass of weights for exercise. Weight plates 3641, 3642, 3643, 3644, 3645 include flat stacking structures 3651, 3652, 3653, 3658, 3654, 3655 as shown, to support and separate adjacent weight plates in the first plurality of weight plates 3640. Weight plate 3645 defines a circle 3646 proximate to weight-engagement device 3620. Weight plate 3645 also illustrates weight-stabilizing recesses 3656, 3657 proximal to weight-engagement device 3620.

Dumbbell system 3601 includes weight-engagement device 3620 that comprises a stand having horizontal stabilizer 3621 joining left riser 3622 and right riser 3623 proximal to first end 3603. Weight-engagement ports 3631, 3632 3633, 3634, 3635, 3636, 3637 on right riser 3623 represent a right plurality of weight engagement ports that aligns with a left plurality of weight engagement ports (not visible) on left riser 3622. The two risers 3622, 3623 each exhibit a curved cross-section as shown. Grip 3610, which could be substituted with grip 110, grip 410, grip 1901, or grip 2001, for example, also includes rotation guides 3671, 3672 adapted to minimize rotation of grip 3610 within weight-engagement device 3620. Weight-retaining pin 3661 comprises Spring-loaded ball bearing 3662, and finger ring 3663 to allow extraction of weight-retaining pin 3661 from weight-engagement device 3620.

Figure 41:
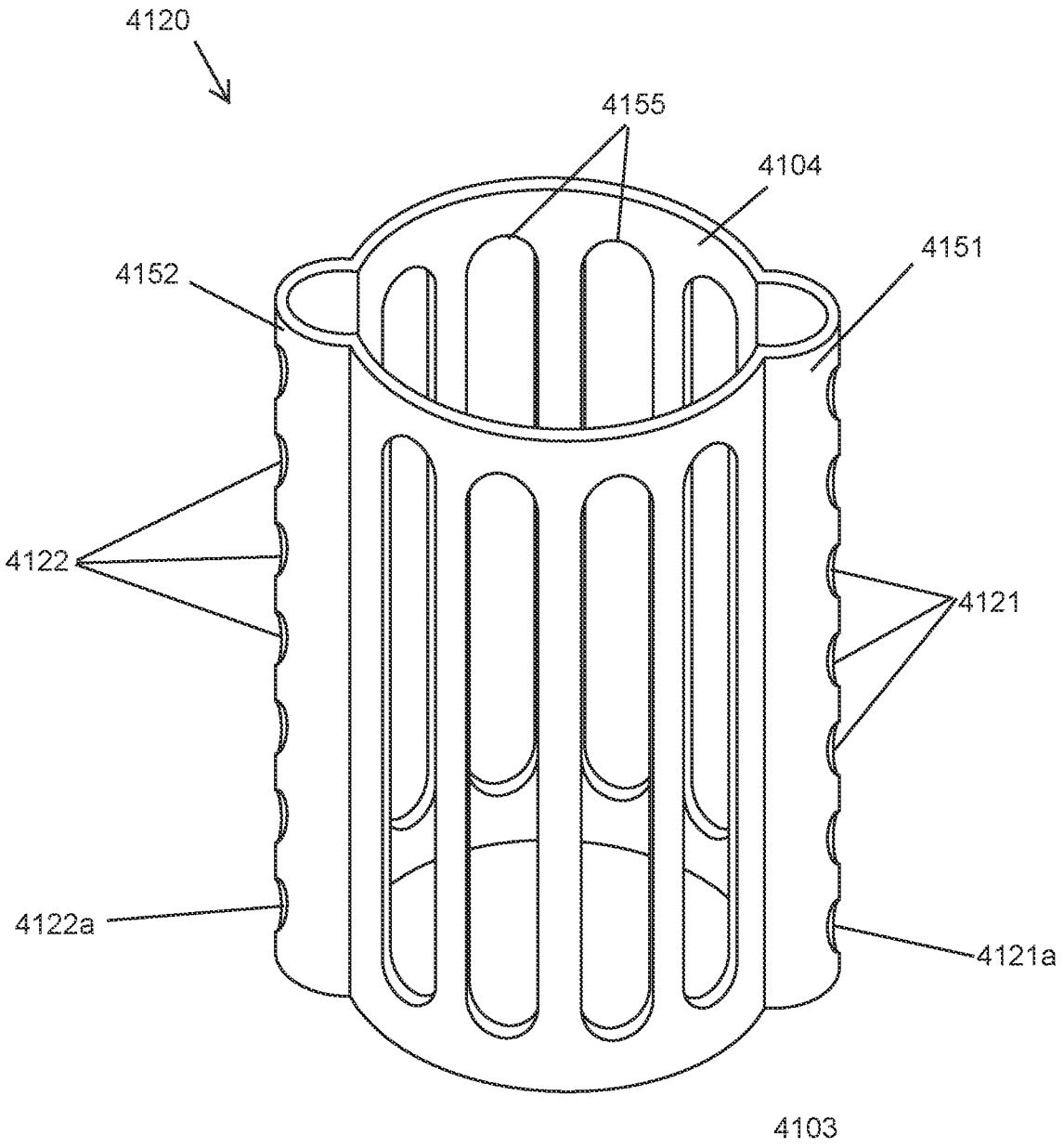
FIG. 41 provides a perspective view of weight engagement device 4120.

FIG. 41 provides a perspective view of weight engagement device 4120. Weight-engagement device 4120 can be used, for example, with dumbbell system 1301 in place of weight-engagement device 1320. Weight-engagement device 4120 comprises first end 4103 opposite second end 4104, with a plurality of weight-engagement ports 4121, 4122 dispersed therebetween. Right engagement port 4121*a* aligns with left weight engagement port 4122*a*. Weight-engagement device 4120 comprises right weight stabilizing protrusion 4151 and left weight stabilizing protrusion 4152. Right weight engagement ports 4121 are dispersed on right weight stabilizing protrusion 4151. Left weight engagement ports 4122 are dispersed on left weight stabilizing protrusion 4152. Weight-engagement device 4120 exhibits a cylindrical device shape.

Figure 42:
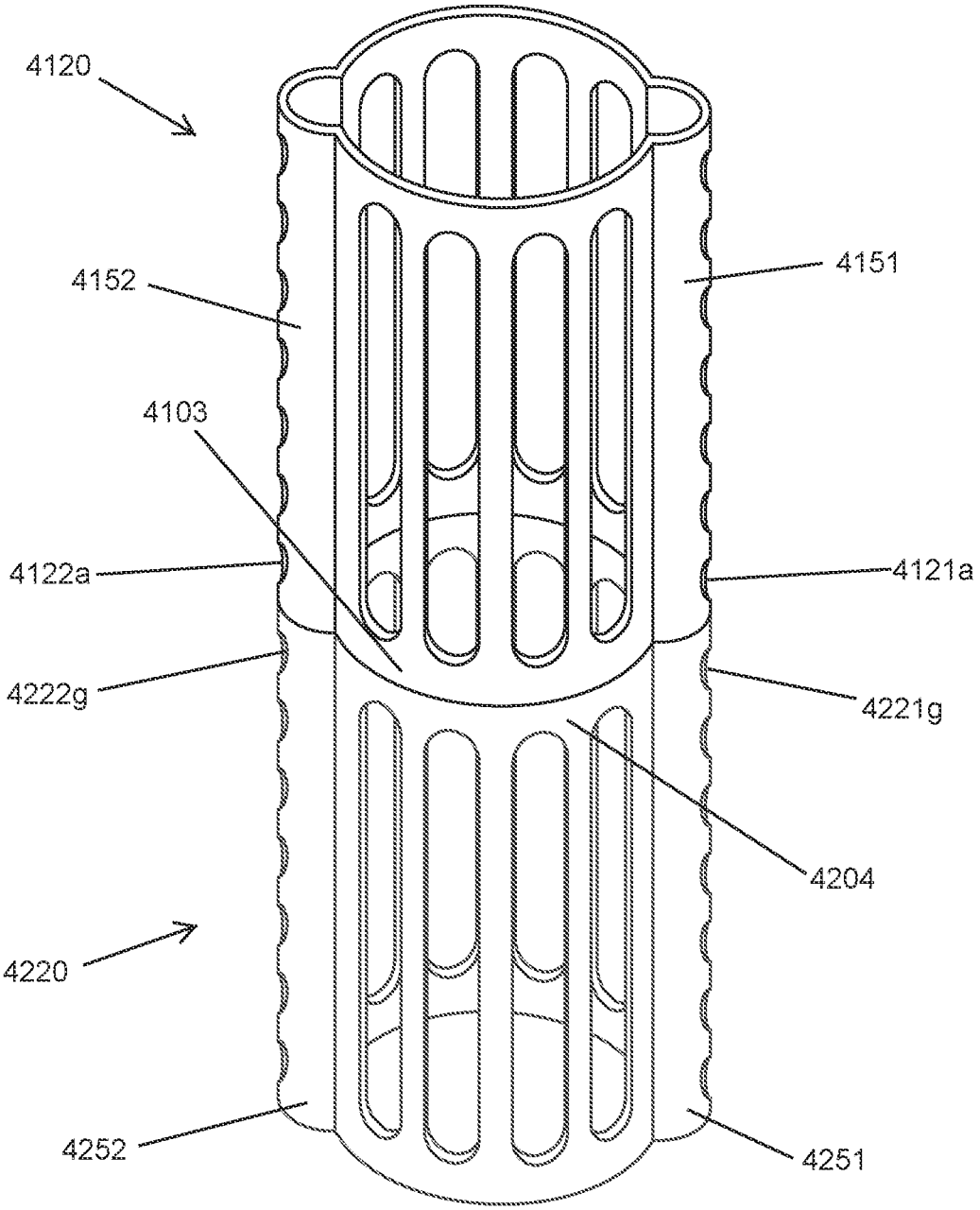
FIG. 42 shows a perspective view of weight engagement device 4120 and weight engagement device 4220.

FIG. 42 shows a perspective view of weight engagement device 4120 and weight engagement device 4220. Weight-engagement device 4220 is substantially identical to weight-engagement device 4120. By stacking two weight-engagement devices as shown in FIG. 42, the variety of exercises and amount of weight can be expanded. Weight-engagement device 4220 has a first end 4203 opposite a second end 4204, and a plurality of weight-engagement ports 4221, 4222 dispersed therebetween. Weight-engagement device 4220 comprises right weight stabilizing protrusion 4251 and left weight stabilizing protrusion 4252. With first end 4103 of weight engagement device 4120 contacting second end 4204 of weight-engagement device 4220, weight-engagement ports 4221*g*, 4121*a*, 4222*g*, and 4122*a* can be used to secure the weight-engagement devices 4120, 4220 together. One possible way to do that employs grip 4310, shown in FIG. 43-44.

Figure 43:
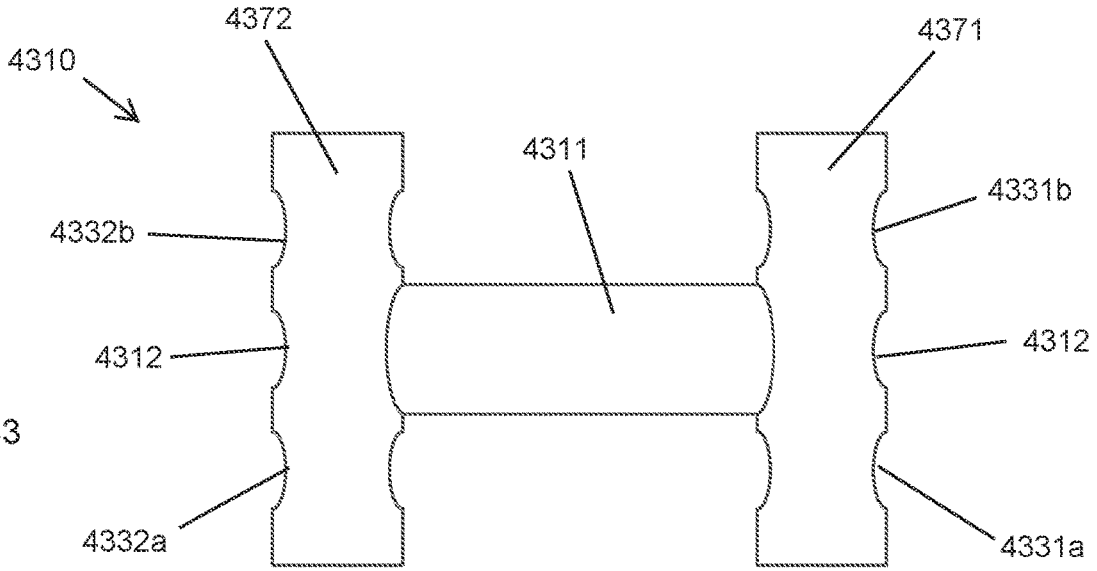
FIGS. 43-44 show grip 4310.
Figure 44:
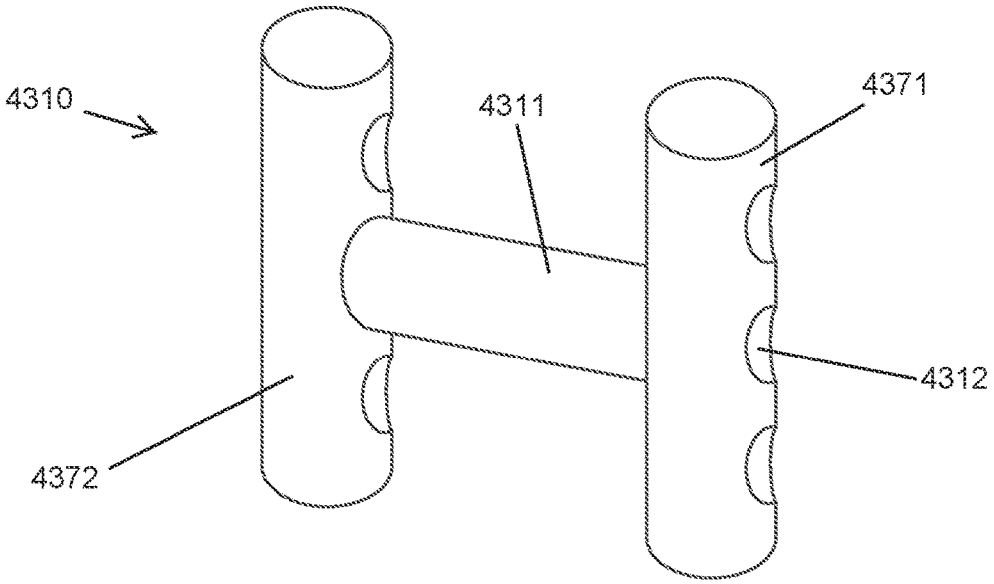

FIGS. 43-44 show grip 4310. FIG. 43 shows a front elevation view, and FIG. 44 provides a perspective view. Grip 4310 comprises handle portion 4311 that encloses a pin receiving portion 4312. Right rotation guide 4371 and left rotation guide 4372 help stabilize grip 4310, for example, in a weight-engagement device 4120. Right rotation guide 4371 also includes right weight stabilization ports 4331*a*, 4331*b*. Left rotation guide 4372 includes left weight stabilization ports 4332*a*, 4332*b*. Referring to FIG. 42, grip 4310 can be inserted into weight-engagement devices 4120, 4220 so that right rotation guide 4371 slides into right weight stabilization protrusion 4151, while left rotation guide 4372 slides into left weight stabilization protrusion 4152. Right weight stabilization port 4331*b* can align with right weight engagement port 4121*a*, while right weight engagement port 4221*g* aligns with pin receiving portion 4312 of grip 4310. A plurality of weight-retaining pins (not shown) can secure weight-engagement devices 4120, 4220 to grip 4310 at those aligned ports (4121*a* and 4331*b*; 4221*g* and 4312). Similarly, left weight stabilization port 4332*b* can align with weight-engagement port 4122*a* and be secured by a weight-retaining pin (not shown). Left weight engagement port 4222*g* can align with pin receiving portion 4312 on the left side of grip 4310, and also be secured with another weight-retaining pin (not shown).

Figure 45:
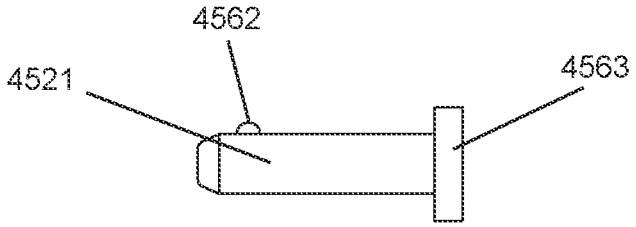
FIGS. 45-47 show weight-retaining pins 4521, 4621, and 4721, respectively.
Figure 46:
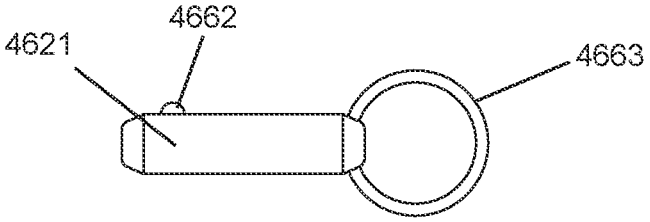
Figure 47:
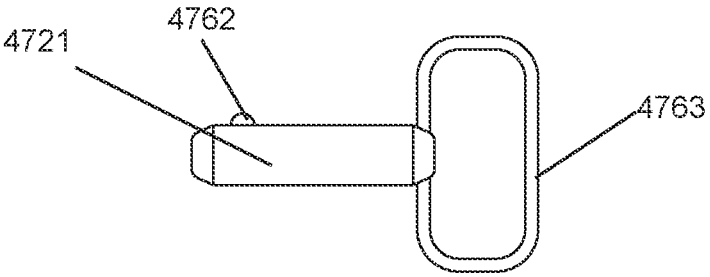

FIGS. 45-47 show weight-retaining pins 4521, 4621, and 4721, respectively. Weight retaining pin 4521 includes spring-loaded ball bearing 4562 and finger grasp 4563. Weight retaining pin 4621 includes spring-loaded ball bearing 4662 and finger ring 4663. Weight retaining pin 4721 includes spring-loaded ball bearing 4762 and finger ring 4763. Weight-retaining pins 4521, 4621, and 4721 can be used in any of the dumbbell systems and barbell systems disclosed herein.

Figure 48:
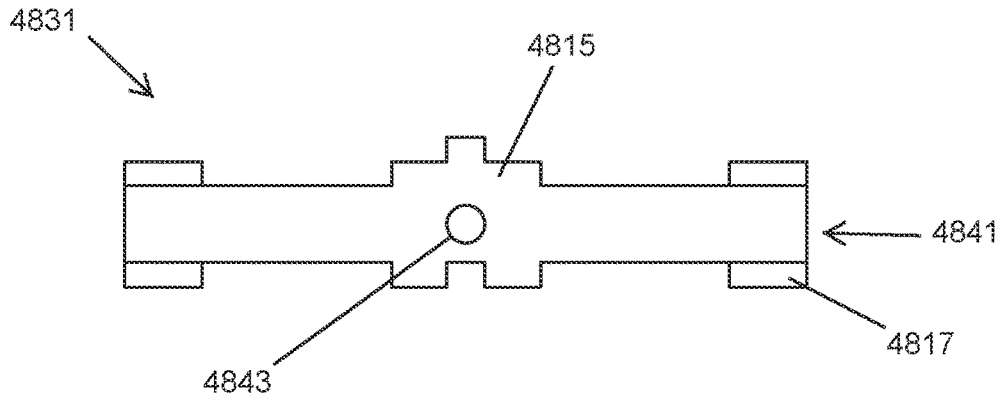
FIGS. 48-49 depict weight plate 4831.
Figure 49:
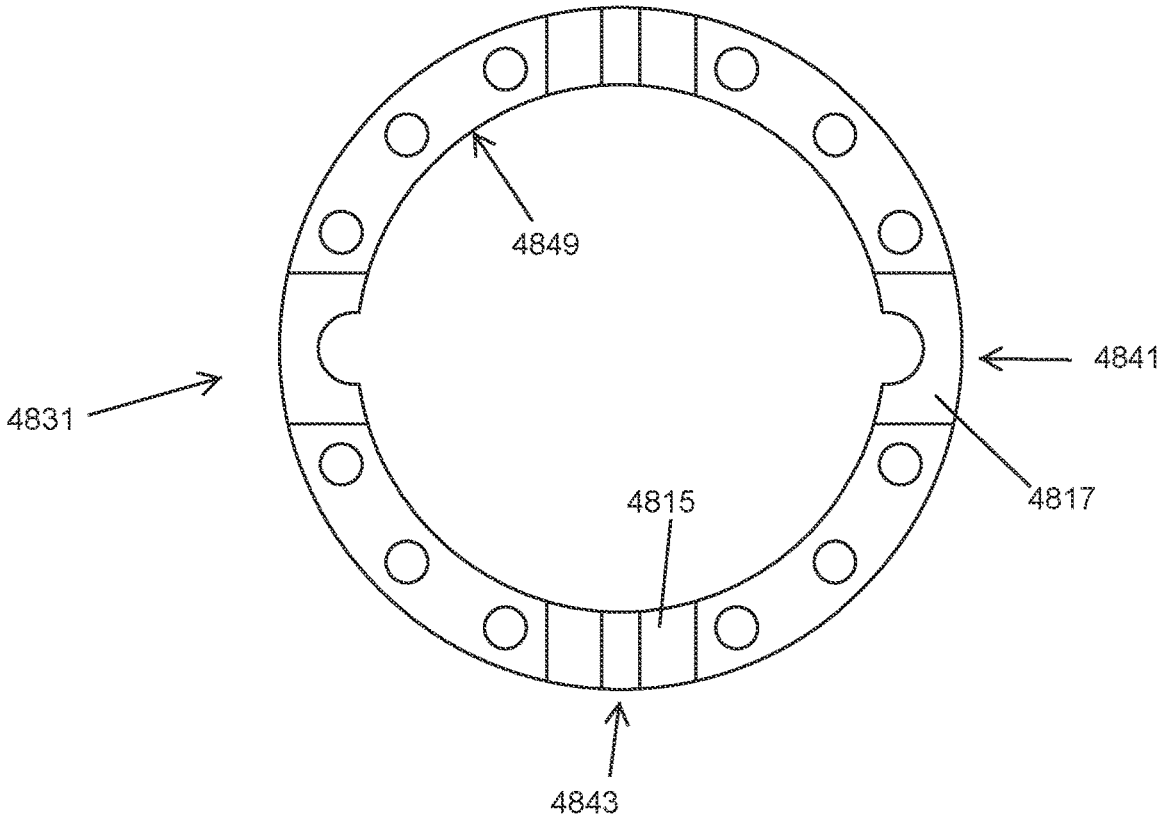

FIGS. 48-49 depict weight plate 4831. FIG. 48 provides a side elevation, and FIG. 49 shows a plan view. Weight plate 4831 has a first interlocking stacking structure 4815, and first flat stacking structure 4817. Grip engagement port 4843 and grip engagement port 4841 (not seen) are adapted to receive any suitable weight-retaining pin (not shown) such as those disclosed herein. It can be seen that weight plate 4831 defines circle 4849. Weight plate 4831 also includes weight stabilizing recesses 4856, 4857, which could engage, for example, weight stabilizing protrusions 4151, 4152 of weight-engagement device 4120, or risers 3622, 3623 of weight-engagement device 3620, for another example.

Figure 50:
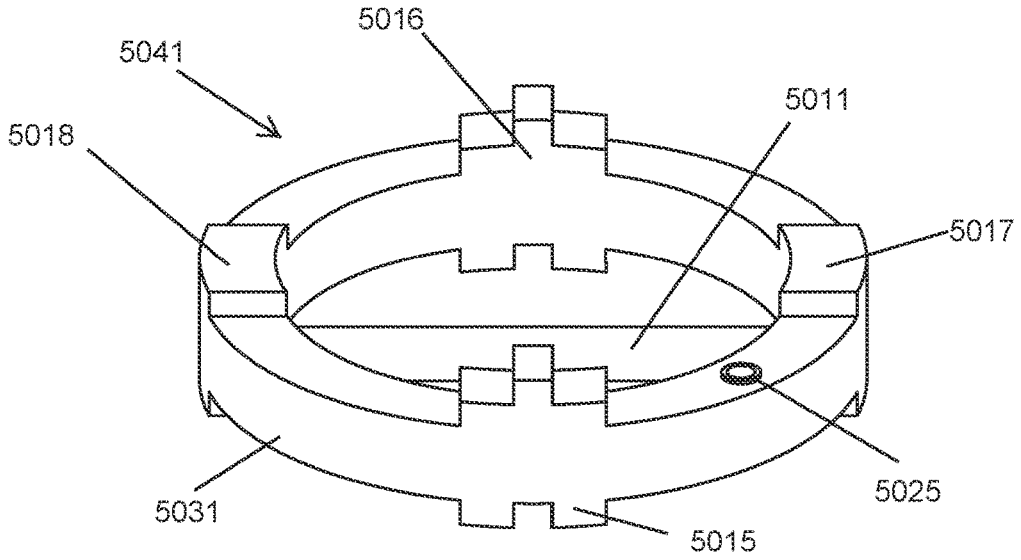
FIGS. 50-52 depict dumbbell 5041.
Figure 51:
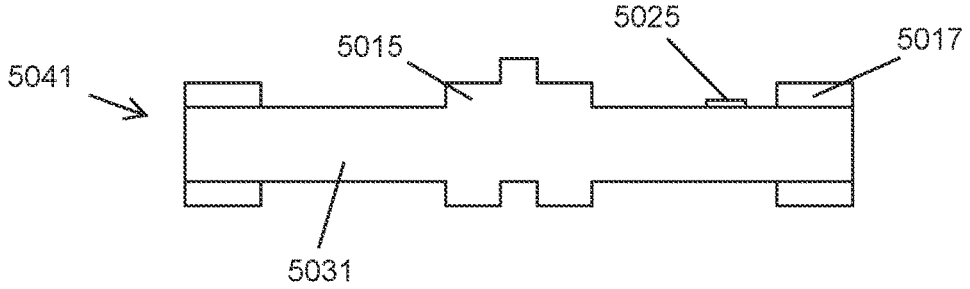
Figure 52:
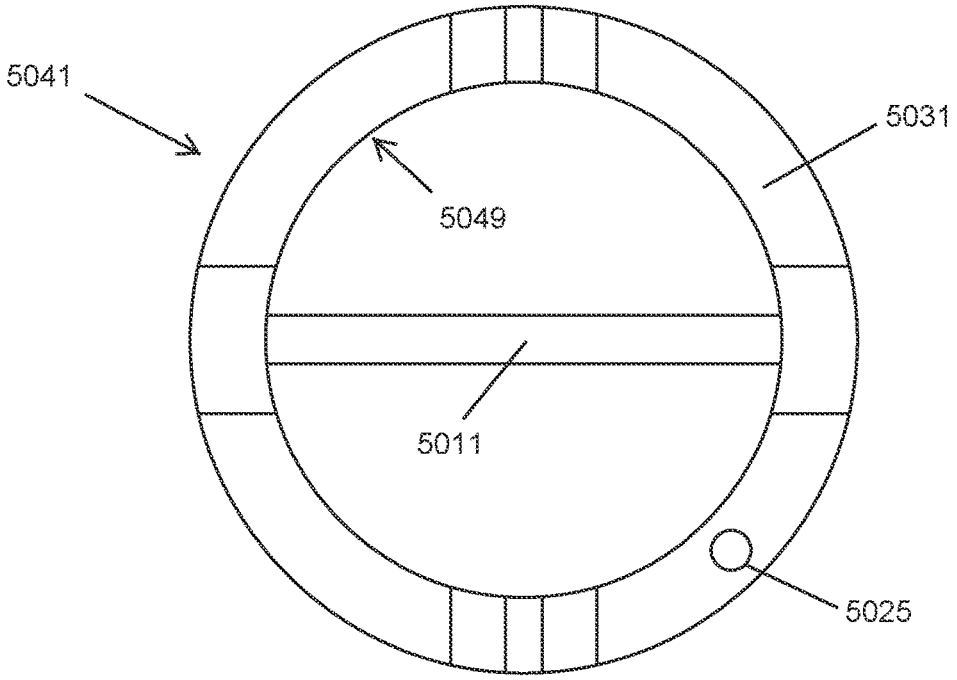

FIGS. 50-52 depict dumbbell 5041. FIG. 50 provides a perspective view; FIG. 51 shows a front elevation view; and FIG. 52 provides a top plan view. Dumbbell 5041 includes grip 5011 and weight plate 5031 permanently affixed to grip 5011. Weight plate 5031 defines a circular opening 5049 about grip 5011 sufficient in size for a human hand (not shown) to grasp grip 5011. Weight plate 5031 also includes interlocking stacking structures 5015, 5016 and flat stacking structures 5017, 5018. Those stacking structures 5015, 5016, 5017, 5018, allow the convenient storage of other dumbbells having complementary stacking structures. Dumbbell 5041 also includes filling port 5025 adapted to receive and retain at least one filling material to impart mass to dumbbell 5041. Weight plate 5031 defines a cylindrical shape.

Figure 53:
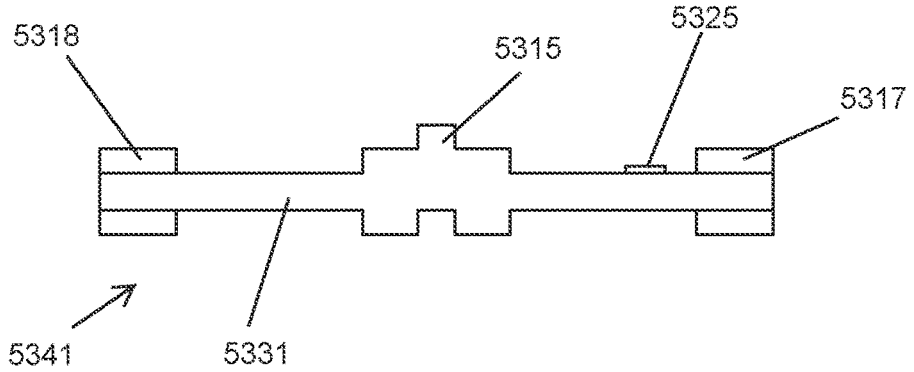
FIGS. 53-55 provide side elevation views of dumbbells 5341, 5441, and 5541, respectively.
Figure 54:
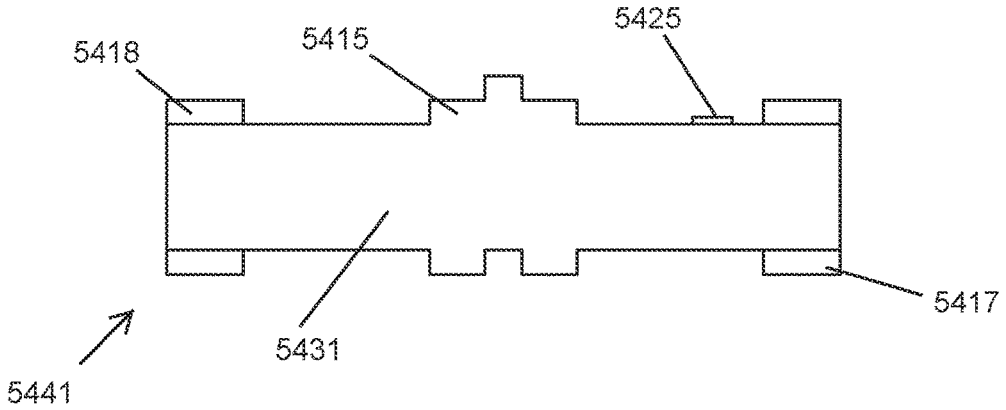
Figure 55:
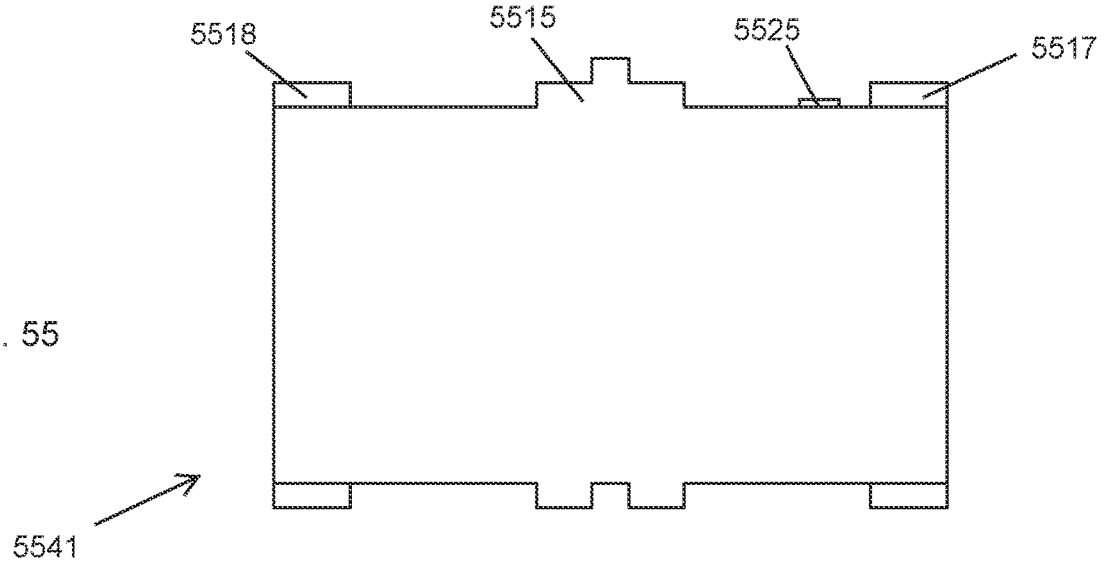

FIGS. 53-55 provide side elevation views of dumbbells 5341, 5441, and 5541, respectively. Dumbbell 5341 includes a grip (not seen), weight plate 5331 permanently affixed to the grip. Weight plate 5331 defines an opening (also not seen) about the grip sufficient in size for a human hand to grasp the grip. Flat stacking structures 5317, 5318, and interlocking stacking structure 5313 can be seen on weight plate 5331. Filling port 5325 is adapted to receive and retain at least one filling material to impart mass to dumbbell 5341. Depending on the materials used to build and/or fill dumbbell 5341, dumbbell 5341 might have an exercise mass of 5 pounds.

Dumbbell 5441 includes a grip (not seen), weight plate 5431 permanently affixed to the grip. Weight plate 5431 defines an opening (also not seen) about the grip sufficient in size for a human hand to grasp the grip. Flat stacking structures 5417, 5418, and interlocking stacking structure 5413 can be seen on weight plate 5431. Filling port 5425 is adapted to receive and retain at least one filling material to impart mass to dumbbell 5441. Depending on the materials used to build and/or fill dumbbell 5441, dumbbell 5441 might have an exercise mass of 15 pounds.

Dumbbell 5541 includes a grip (not seen), weight plate 5531 permanently affixed to the grip. Weight plate 5531 defines an opening (also not seen) about the grip sufficient in size for a human hand to grasp the grip. Flat stacking structures 5517, 5518, and interlocking stacking structure 5513 can be seen on weight plate 5531. Filling port 5525 is adapted to receive and retain at least one filling material to impart mass to dumbbell 5541. Depending on the materials used to build and/or fill dumbbell 5541, dumbbell 5541 might have an exercise mass of 40 pounds.

Figure 56:
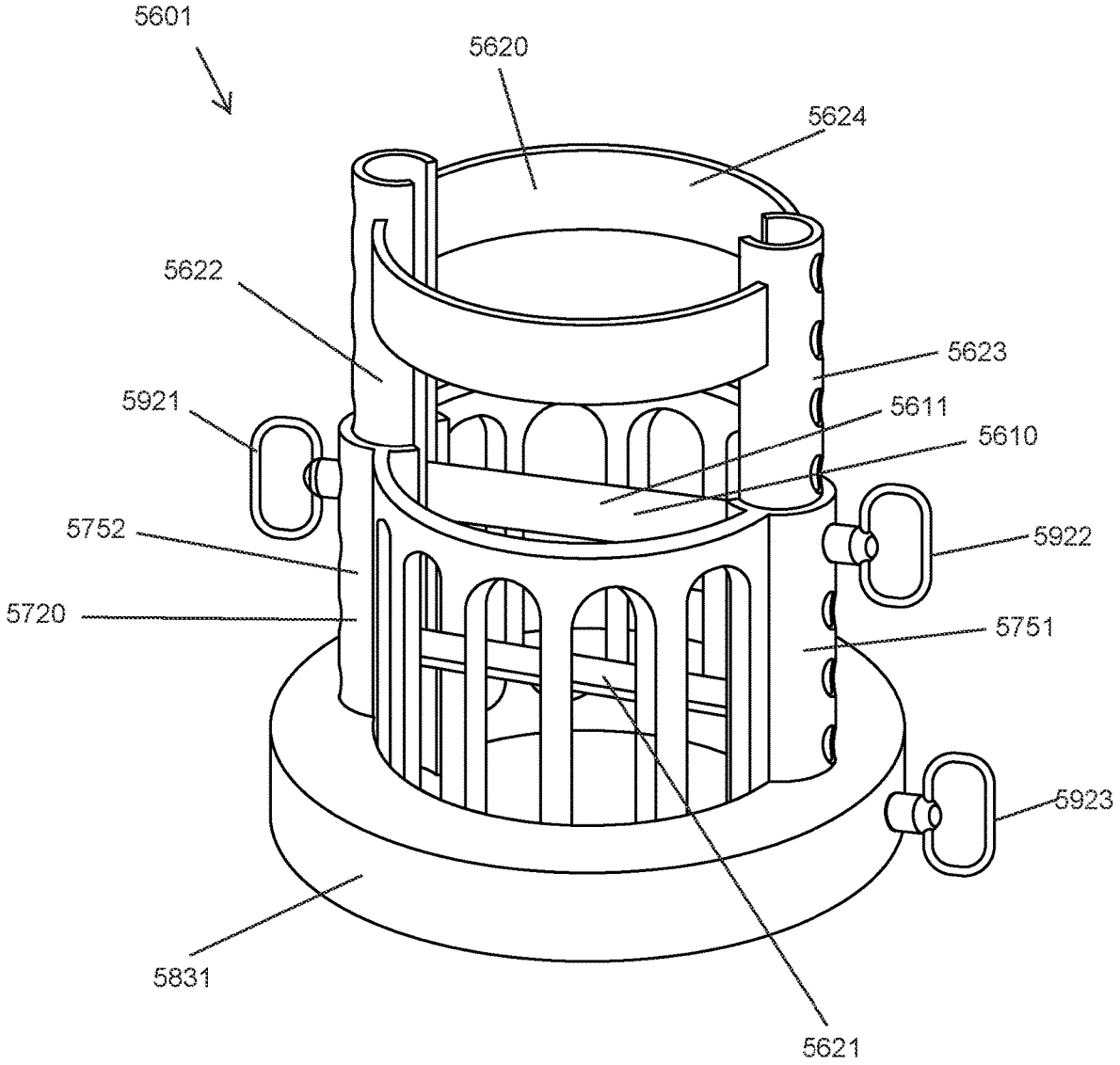
FIGS. 56-66 depict dumbbell system 5601 and components thereof.
Figure 57:
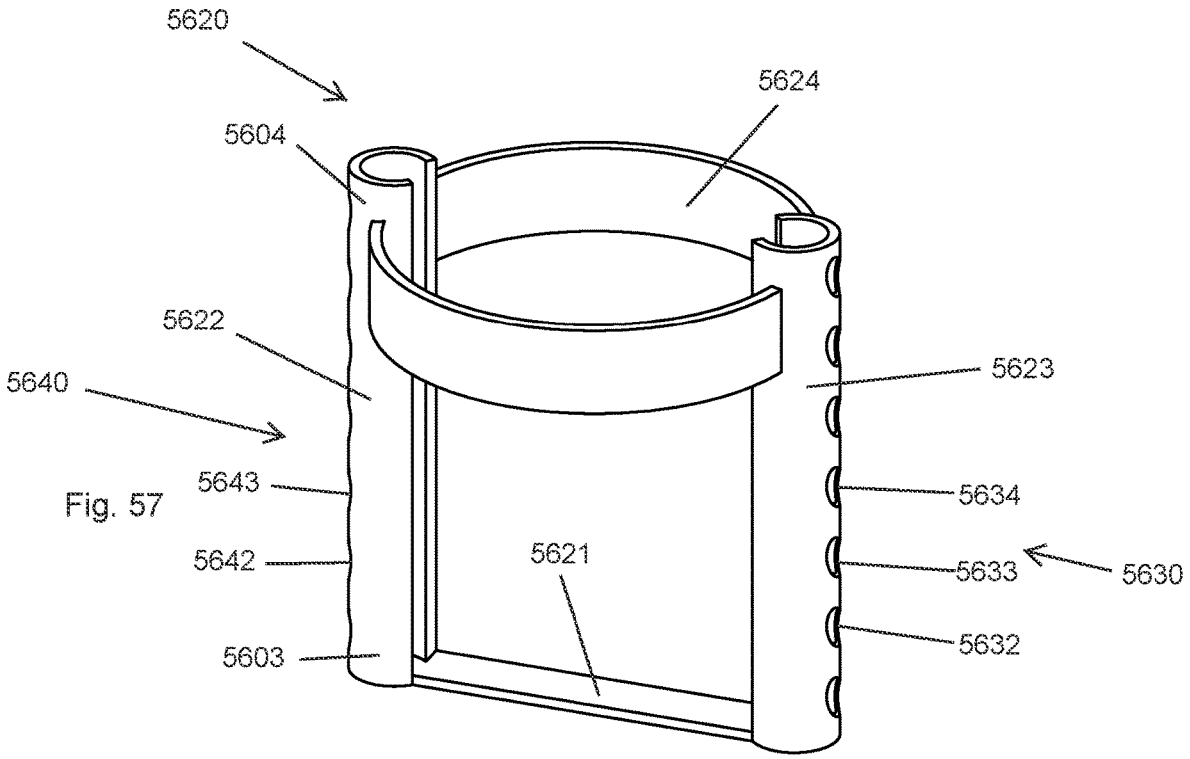
Figure 58:
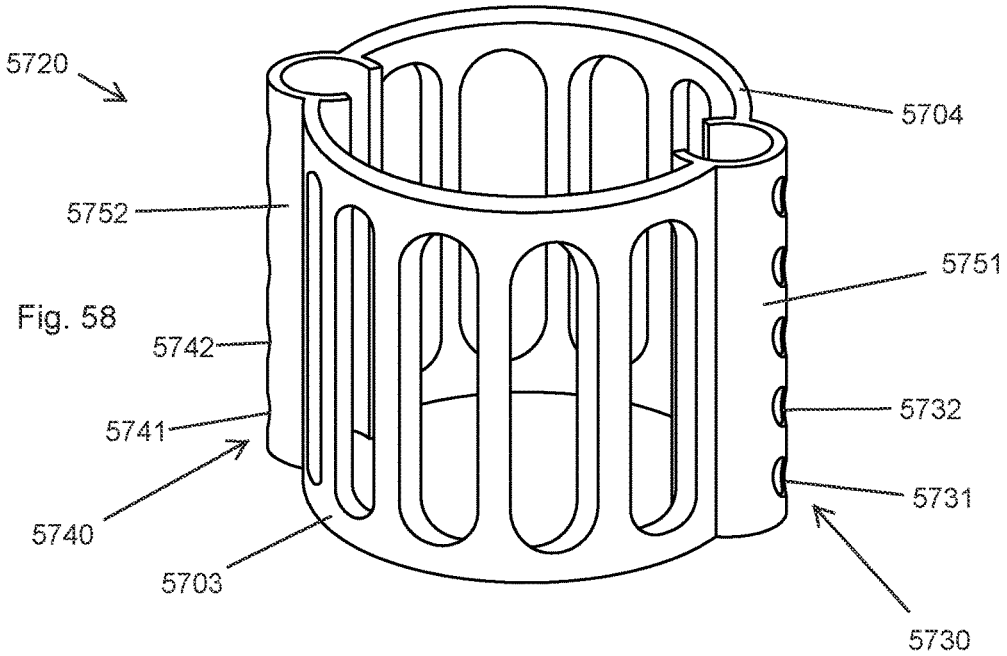
Figure 59:
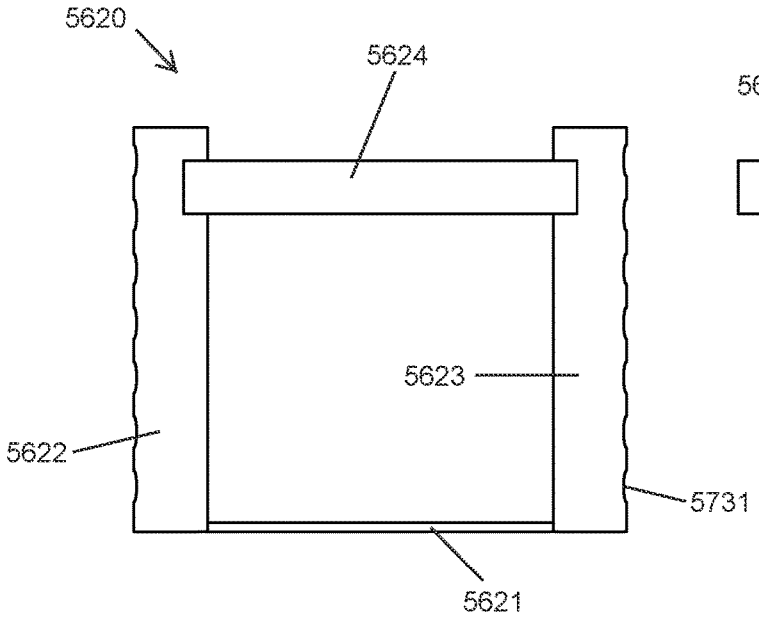
Figure 60:
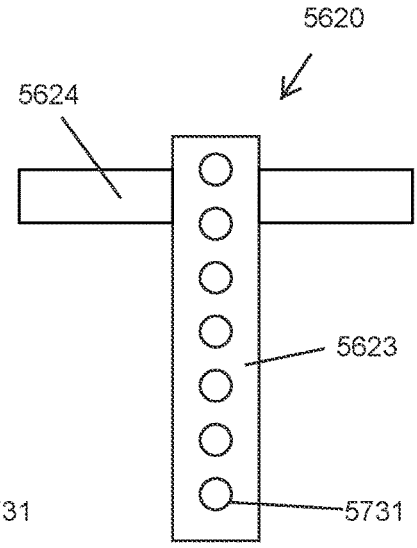
Figure 61:
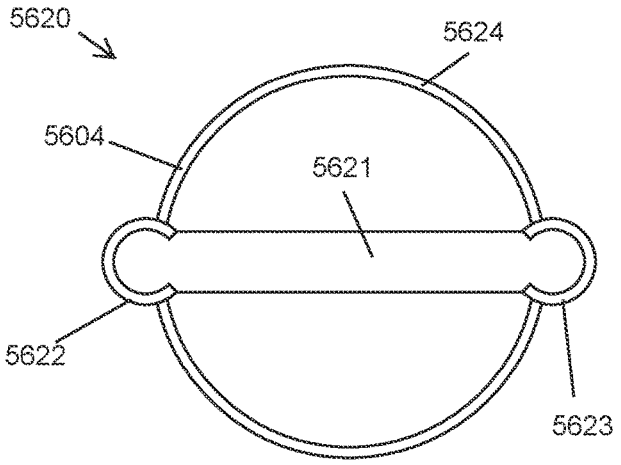
Figure 62:
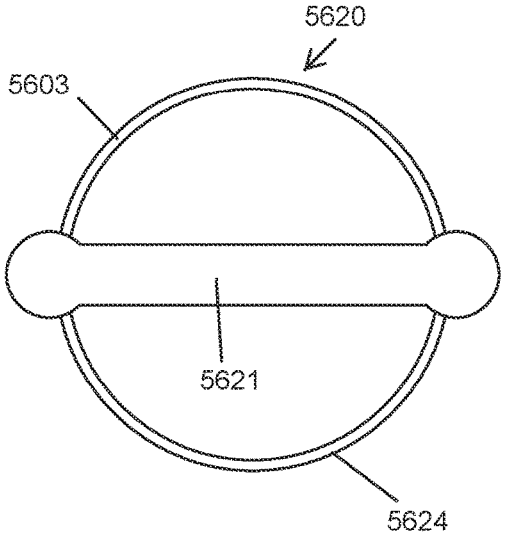
Figure 63:
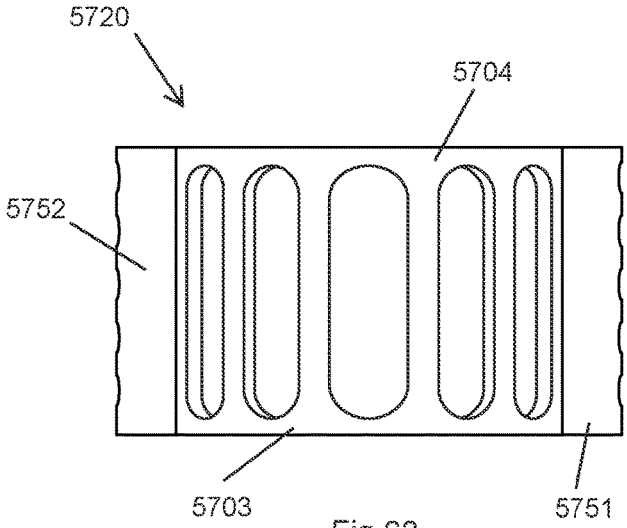
Figure 64:
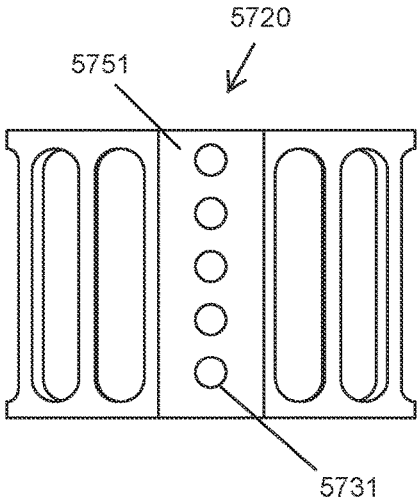
Figure 65:
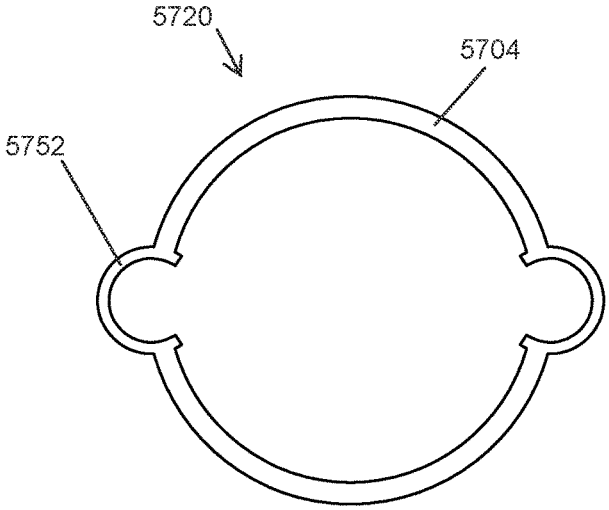
Figure 66:
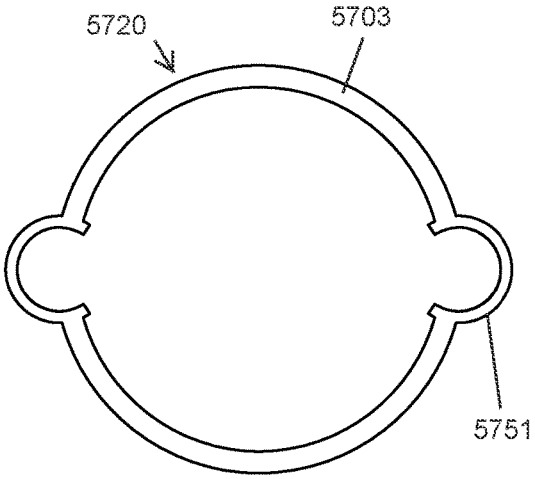

FIGS. 56-66 depict dumbbell system 5601 and components thereof. FIG. 56 provides a perspective view of dumbbell system 5601. FIG. 57 provides a perspective view of inner weight-engagement device 3620. FIG. 58 provides a perspective view of outer weight-engagement device 5720. FIG. 59 provides a front elevation view, FIG. 60 a right-side elevation view, FIG. 61 a top plan view, and FIG. 62 a bottom plan view, all of inner weight-engagement device 5620. FIG. 63 provides a front elevation view, FIG. 64 a right-side elevation view, FIG. 65 a top plan view, and FIG. 66 a bottom plan view, all of outer weight-engagement device 5720. The right-side elevation views (FIGS. 60, 64) are mirror images of their left-side elevation views.

Inner weight engagement device 5620 is adapted to fit incrementally within outer weight-engagement device 5720, and their position relative to each other is secured by grip-retaining pins 5921, 5922 that are also engaging grip 5610 that encloses a pin-receiving portion adapted to receive those grip-retaining pins 5921, 5922. Weight plate 5831 is secured to outer weight-engagement device 5720 by weight retaining pin 5923. Inner weight engagement device 5620 could be replaced by a weight engagement device 3620, for example. Outer weight engagement device could be replaced by weight engagement device 4120, for example. Pins 5921, 5922, 5923 can be replaced with any of the numerous pins also disclosed herein. Weight plate 5831 defines a circle proximate to outer weight-engagement device 5720, and could be replaced, for example, with weight plates 1331, 3641, 4831 as disclosed herein. Second weight plate 1371 could be fitted around weight plate 5831 if desired, allowing for a second plurality of weight plates (not shown).

Inner weight engagement device 5620 has an inner first end 5603 opposite an inner second end 5604. A plurality 5630, 5640 of inner weight-engagement ports are dispersed between the inner first end 5603 and the inner second end 5604, each inner weight-engagement port is configured to receive a weight-retaining pin or a grip-retaining pin such as grip-retaining pins 5921, 5922. Inner weight engagement device 5620 includes a stand having left riser 5622 and right riser 5623. They are joined by horizontal stabilizer 5621 that is proximal to inner first end 5603. In some cases, horizontal stabilizer 5621 could be replaced by a permanently-affixed grip, such as grip 1310. Left plurality 5640 of inner weight-engagement ports 5642, 5643, for example, are opposite right plurality 5630 of inner weight-engagement ports 5632, 5633, 5634. Left inner weight-engagement port 5642 aligns with right inner weight-engagement port 5632. Left riser 5622, and right riser 5623 each exhibit a curved cross-section. Inner weight engagement device 5620 includes a circumferential stabilizer 5624 joining the two risers 5622, 5623 distal from the inner first end 5603.

Grip 5610 comprises a handle portion 5611, which could be replaced by any of the grips 1901, 3610, 4310, and possibly grip 410 in some embodiments. Grip 5610 is adapted to be selectively secured to any of the inner weight-engagement ports in the plurality 5630, 5640 of inner weight-engagement ports. Grip 410 would obviate the need for grip-retaining pins 5921, 5922. Optionally, dumbbell system can be configured so that the location of grip 5610 is not related to the incremental fit of inner weight-engagement device 5620 relative to outer weight engagement device 5720. For example, as mentioned above, horizontal stabilizer 5621 could be replaced by grip 1310. For another example, grip 5610 could be located proximate to inner second end 5604 and circumferential stabilizer 5624, and dumbbell system 5601 is arranged otherwise as shown in FIG. 56. Such a configuration could be useful for kettleball swing-like exercises. In another alternative configuration, inner weight-engagement device 5620 can be positioned entirely within outer weight-engagement device 5720, and a single weight-retaining pin 5923 could secure one or more weight plates like weight plate 5831 and grip 5610, while also maintaining the relative position of inner weigh engagement device 5620 in outer weight-engagement device 5720. A longer pin such as weight-retaining pin 3661 might be well suited to serve in such a configuration. Or two weight-retaining pins 1362, 1363 could do the job.

Outer weight engagement device 5720 includes outer first and 5703 opposite outer second end 5704, and a plurality 5730, 5740 of outer weight-engagement ports dispersed between the outer first end 5703 and the outer second end 5704. The plurality 5730, 5740 of outer weight-engagement ports comprises a left plurality 5740 and a right plurality 5730 of outer weight-engagement ports. Each outer weight-engagement port in the left plurality 5740 aligns with an outer weight-engagement port in the right plurality 5730. For example, left outer weight-engagement port 5741 aligns with right outer weight-engagement port 5731. As can be seen especially in FIG. 58, outer weight-engagement device 5720 comprises a cylindrical device shape. Outer weight engagement device 5720 also comprises a left weight stabilizing protrusion 5752 and a right weight stabilizing protrusion 5751. Right outer weight-engagement ports 5731, 5732 of right plurality 5730 are dispersed on right stabilizing protrusion 5751. Left outer weight-engagement ports 5741, 5742 of left plurality 5740 are dispersed on left stabilizing protrusion 5741. Left stabilizing protrusion 5741 is adapted to receive left riser 5622. Right stabilizing protrusion 5751 is adapted to receive right riser 5623.

Structurally, there may be no difference between a weight-retaining pin or a grip-retaining pin. Different names are used herein only to indicate the function at a given moment. For example, grip-retaining pins 5921, 5922 could also secure a weight plate proximal to grip 5610, whereupon they could be referred to as weight-retaining pins if desired.

CLAUSES

Further understanding of the present invention can be had from the following clauses.

Clause 1. A dumbbell system for exercising with an incrementally-variable mass of weights, comprising:

- a grip, comprising a handle portion and a weight-selecting portion;
- a weight-engagement device, comprising a plurality of weight-engagement ports configured to receive the weight-selecting portion of the grip;
- a plurality of weight plates, each weight plate in the plurality of weight plates comprising a grip-engagement port configured to receive the weight-selecting portion of the grip, wherein each grip-engagement port is adapted to align with a weight-engagement port in the plurality of weight-engagement ports;
- wherein the plurality of weight plates provides the incrementally-variable mass of weights.

Clause 2. The dumbbell system of clause 1, wherein the handle portion of the grip comprises a polymer foam, rubbery material, or a combination thereof.

Clause 3. The dumbbell system of any one of the preceding clauses, wherein the weight-selecting portion of the grip comprises a single retractable rod configured to selectively retract into the handle portion and to selectively emerge from the handle portion to engage a chosen weight-engagement port in the plurality of weight-engagement ports and a grip-engagement port aligned with the chosen weight-engagement port.

Clause 4. The dumbbell system of clause 3, wherein the single retractable rod is spring-loaded.

Clause 5. The dumbbell system of any one of clauses 3-4, wherein the single retractable rod is electromagnetically activated.

Clause 6. The dumbbell system of any one of clauses 3-5, wherein the single retractable rod is activated by rotating a rod deployment mechanism relative to the handle portion.

Clause 7. The dumbbell system of any one of the preceding clauses, wherein the weight-selecting portion of the grip comprises dual retractable rods coaxially arranged and configured to selectively retract into the handle portion and to selectively emerge from the handle portion to engage a chosen pair of weight-engagement ports in the plurality of weight-engagement ports and a pair of grip-engagement ports aligned with the chosen pair of weight-engagement ports.

Clause 8. The dumbbell system of any one of the preceding clauses, wherein the weight-engagement device comprises a cylindrical device shape.

Clause 9. The dumbbell system of any one of the preceding clauses, wherein each weight plate in the plurality of weight plates defines a circle proximate to the weight-engagement device.

Clause 10. The dumbbell system of any one of the preceding clauses, wherein the weight-engagement device comprises a weight-retention rim configured to assist in retaining at least one weight plate of the plurality of weight plates on the weight-engagement device.

Clause 11. The dumbbell system of any one of the preceding clauses, wherein each weight plate in the plurality of weight plates defines a cylindrical weight shape.

Clause 12. The dumbbell system of any one of the preceding clauses, wherein the handle portion comprises an ergonomic shape.

Clause 13. A telescoping dumbbell system for exercising with an incrementally-expandable mass of weights, comprising:

a cylindrical base supporting a grab;

a base weight selecting pin slidably attached to the cylindrical base;

a first plurality of nested weight cylinders, wherein each weight cylinder in the first plurality of nested weight cylinders comprises a first pin engagement port adapted to receive the base weight selecting pin;

wherein each first pin engagement port of each weight cylinder is adapted to align with the first pin engagement ports of the other weight cylinders in the first plurality of nested weight cylinders; and wherein the first plurality of nested weight cylinders provides the incrementally-expandable mass of weights.

Clause 14. The telescoping dumbbell system of clause 13, wherein the cylindrical base comprises a circular bearing race rotationally supporting the grab.

Clause 15. The telescoping dumbbell system of any one of clauses 13-14, wherein the cylindrical base and each weight cylinder in the plurality of nested weight cylinders comprise a barbell engagement port; and wherein the barbell engagement ports of the cylindrical base and of each weight cylinder is adapted to align with each other.

Clause 16. The telescoping dumbbell system of any one of clauses 13-15, wherein the grab comprises a polymer foam, a rubbery material, or a combination thereof.

Clause 17. The telescoping dumbbell system of any one of clauses 13-16, wherein the bearing race comprises ball bearings, cylindrical bearings, conical bearings, or a combination thereof.

Clause 18. The telescoping dumbbell system of any one of clauses 13-17, comprising one, two, three, four, five, or six base weight selecting pins slidably attached to the cylindrical base.

Clause 19. The telescoping dumbbell system of any one of clauses 13-18, wherein the cylindrical base defines an interior surface and an exterior surface, further comprising a barbell engagement pin slidably attached to the interior surface proximal to the barbell engagement port, and adapted to engage a weight engagement port on a barbell present in the barbell engagement port of the cylindrical base.

Clause 20. The telescoping dumbbell system of any one of clauses 13-19, further comprising:

a second weight selecting pin slidably attached to an outermost weight cylinder in the first plurality of nested weight cylinders;

a second plurality of nested weight cylinders, wherein each weight cylinder in the second plurality of nested weight cylinders comprises a second pin engagement port adapted to receive the second weight selecting pin;

wherein each second pin engagement port is adapted to align with other second pin engagement ports of the weight cylinders in the second plurality of nested weight cylinders; and wherein the second plurality of nested weight cylinders adds to the incrementally-expandable mass of weights.

Clause 21. The telescoping dumbbell system of clause 20, wherein each weight cylinder in the second plurality of nested weight cylinders comprises a barbell engagement port adapted to align with each other barbell engagement port in the system.

Clause 22. The telescoping dumbbell system of any one of clauses 13-21, further comprising:

a third weight selecting pin slidably attached to an outermost weight cylinder in the second plurality of nested weight cylinders;

a third plurality of nested weight cylinders, wherein each weight cylinder in the third plurality of nested weight cylinders comprises a third pin engagement port adapted to receive the third weight selecting pin;

wherein each third pin engagement port is adapted to align with other third pin engagement ports of the weight cylinders in the third plurality of nested weight cylinders; and wherein the third plurality of nested weight cylinders adds to the incrementally-expandable mass of weights.

Clause 23. The telescoping dumbbell system of clause 22, wherein each weight cylinder in the third plurality of nested weight cylinders comprises a barbell engagement port adapted to align with each other barbell engagement port in the system.

Clause 24. The telescoping dumbbell system of any one of clauses 13-23, wherein the grab comprises an ergonomic shape.

Clause 25. A dumbbell system for exercising with an incrementally-variable mass of weights, comprising:

a grip comprising a handle portion optionally enclosing a pin-receiving portion;

a weight-engagement device having a first end opposite a second end, comprising a plurality of weight-engagement ports dispersed between the first end and the second end, each weight-engagement port in the plurality of weight-engagement ports being configured to receive a weight-retaining pin;

a first plurality of weight plates, each weight plate in the first plurality of weight plates comprising at least one grip-engagement port configured to also receive the weight-retaining pin, wherein each of the at least one grip-engagement port is adapted to align with a weight-engagement port in the plurality of weight-engagement ports;

wherein the plurality of weight plates provides the incrementally-variable mass of weights.

Clause 26. The dumbbell system of clause 25, wherein the plurality of weight-engagement ports comprises a left plurality of weight-engagement ports opposite a right plurality of weight-engagement ports, wherein each weight-engagement port in the left plurality of weight-engagement ports aligns with a weight-engagement port in the right plurality of weight-engagement ports.

Clause 27. The dumbbell system of any one of clauses 25-26, wherein the weight-engagement device comprises a cylindrical device shape.

Clause 28. The dumbbell system of any one of clauses 25-26, wherein the weight-engagement device comprises a stand comprising a horizontal stabilizer joining two risers providing the plurality of weight-engagement ports; the horizontal stabilizer joining the two risers proximal to the first end.

Clause 29. The dumbbell system of clause 28, wherein the two risers each exhibit a curved cross section.

Clause 30. The dumbbell system of any one of clauses 25-29, wherein the grip is permanently affixed to the weight-engagement device proximal to the first end.

Clause 31. The dumbbell system of any one of clauses 25-29, wherein the grip is adapted to be selectively secured to any of the weight-engagement ports in the plurality of weight engagement ports.

Clause 32. The dumbbell system of any one of clauses 25-31, wherein the grip comprises one or more rotation guides adapted to minimize rotation of the grip within the weight-engagement device.

Clause 33. The dumbbell system of any one of clauses 25-32, wherein each weight plate in the first plurality of weight plates defines a circle proximate to the weight-engagement device.

Clause 34. The dumbbell system of any one of clauses 25-33, wherein each weight plate in the first plurality of weight plates comprises one or more weight-stabilizing recesses proximal to the weight-engagement device.

Clause 35. The dumbbell system of any one of clauses 25-34, wherein at least one weight-engagement port in the plurality of weight-engagement ports comprises a pin support collar.

Clause 36. The dumbbell system of any one of clauses 25-35, further comprising a second plurality of weight plates, each weight plate in the second plurality of weight plates being dimensioned to fit around at least one weight plate in the first plurality of weight plates;

wherein each weight plate in the second plurality of weight plates comprises at least one grip engagement port configured to receive the weight-retaining pin, a secondary weight-retaining pin, or both.

Clause 37. The dumbbell system of any one of clauses 25-36, wherein the weight-retaining pin comprises a spring-loaded ball bearing, a spring-loaded post, or a combination of both.

Clause 38. The dumbbell system of any one of clauses 25-37, wherein the weight-retaining pin comprises a retraction grip for releasing the weight-retaining pin from the at least one grip-engagement port.

Clause 39. The dumbbell system of any one of clauses 36-38, wherein the secondary weight-retaining pin comprises a spring-loaded ball bearing, a spring-loaded post, or a combination of both.

Clause 40. The dumbbell system of any one of clauses 36-39, wherein the secondary weight-retaining pin comprises a retraction grip for releasing the secondary weight-retaining pin from the at least one grip-engagement port.

Clause 41. The dumbbell system of any one of clauses 25-40, wherein the grip comprises an ergonomic shape.

Clause 42. The dumbbell system of any one of clauses 25-41, wherein at least one weight plate in the first plurality of weight plates comprises two or more first stacking structures to support and separate adjacent weight plates in the first plurality of weight plates.

Clause 43. The dumbbell system of any one of clauses 36-42, wherein at least one weight plate in the second plurality of weight plates comprises two or more second stacking structures to separate adjacent weight plates in the second plurality of weight plates.

Clause 44. The dumbbell system of any one of clauses 25-43, wherein the weight engagement device comprises one or more weight stabilizing protrusions, and the weight-engagement ports are dispersed on the one or more weight stabilizing protrusions.

Clause 45. The dumbbell system of any one of clauses 32-44, wherein the one or more rotation guides comprise one or more weight stabilization ports.

Clause 46. A dumbbell system for exercising with an incrementally-variable mass of weights, comprising:

one or more weight engagement rods, each comprising a shaft having a top tip and a bottom tip, and a screw thread along at least a portion of the shaft;

a hold comprising a gripping portion adjacent one or more rod engagement openings, each of the one or more rod engagement openings comprising a complementary screw thread for engaging the screw thread of the one or more weight engagement rods;

a plurality of weight plates, each weight plate comprising one or more rod engagement ports for receiving the one or more weight engagement rods, and an opening dimensioned to receive a human hand grasping the hold.

Clause 47. The dumbbell system of clause 46, wherein the one or more weight engagement rods contains two weight engagement rods.

Clause 48. The dumbbell system of any one of clauses 46-47, further comprising a stabilizing end cap affixed to the bottom tip.

Clause 49. The dumbbell system of clause 48, wherein the stabilizing end cap is removably affixed, permanently affixed, or integrally affixed to the bottom tip.

Clause 50. The dumbbell system of any one of clauses 4-49, further comprising one or more weight keepers, each weight keeper comprising a body with a rod receiving port with keeper screw thread for engaging the screw thread of the one or more engagement rods.

Clause 51. The dumbbell system of clause 50, wherein the body of each of the one or more weight keepers further comprises finger knobs for manipulating the one or more weight keepers.

Clause 52. The dumbbell system of any one of clauses 46-51, wherein at least one weight plate in the plurality of weight plates comprises two or more stacking structures to support and separate adjacent weight plates in the plurality of weight plates.

Clause 53. A dumbbell system for exercising with an incrementally-variable mass of weights, comprising:

(a) an inner weight-engagement device comprising:
an inner first end opposite an inner second end;
a plurality of inner weight-engagement ports dispersed between the inner first end and the inner second end, each inner weight-engagement port in the plurality of inner weight-engagement ports being configured to receive a weight-retaining pin or optionally a grip-retaining pin;

(b) an outer weight-engagement device, wherein the inner weight-engagement device is adapted to fit incrementally within the outer weight-engagement device, the outer weight-engagement device comprising:
an outer first end opposite an outer second end;
a plurality of outer weight-engagement ports dispersed between the outer first end and the outer second end, each outer weight-engagement port in the plurality of outer weight-engagement ports being configured to receive the weight-retaining pin;

(c) a grip comprising a handle portion optionally enclosing a pin-receiving portion adapted to receive the weight-retaining pin or optionally the grip-retaining pin;

(d) a first plurality of weight plates, each weight plate in the first plurality of weight plates comprising at least one pin-engagement port configured to also receive the weight-retaining pin, wherein each of the at least one pin-engagement port is adapted to align with an outer weight-engagement port in the plurality of outer weight-engagement ports or optionally an inner weight-engagement port in the plurality of inner weight-engagement ports;

wherein the plurality of weight plates provides the incrementally-variable mass of weights.

Clause 54. The dumbbell system of clause 53, wherein the plurality of inner weight-engagement ports comprises a left plurality of inner weight-engagement ports opposite a right plurality of inner weight-engagement ports, wherein each inner weight-engagement port in the left plurality of inner weight-engagement ports aligns with an inner weight-engagement port in the right plurality of inner weight-engagement ports.

Clause 55. The dumbbell system of any one of clauses 53-54, wherein the plurality of outer weight-engagement ports comprises a left plurality of outer weight-engagement ports opposite a right plurality of outer weight-engagement ports, wherein each outer weight-engagement port in the left plurality of outer weight-engagement ports aligns with an outer weight-engagement port in the right plurality of outer weight-engagement ports.

Clause 56. The dumbbell system of any one of clauses 53-55, wherein the outer weight-engagement device comprises a cylindrical device shape.

Clause 57. The dumbbell system of any one of clauses 53-56, wherein the inner weight-engagement device comprises a stand comprising a horizontal stabilizer joining two risers providing the plurality of inner weight-engagement ports; the horizontal stabilizer joining the two risers proximal to the inner first end.

Clause 58. The dumbbell system of clause 57, wherein the two risers each exhibit a curved cross section.

Clause 59. The dumbbell system of anyone of clauses 57-58, wherein the inner weight-engagement device comprises a circumferential stabilizer joining the two risers distal from the inner first end.

Clause 60. The dumbbell system of any one of clauses 53-59, wherein the grip is permanently affixed to the weight-engagement device proximal to the first end.

Clause 61. The dumbbell system of any one of clauses 53-59, wherein the grip is adapted to be selectively secured to any of the inner weight-engagement ports in the plurality of inner weight-engagement ports.

Clause 62. The dumbbell system of any one of clauses 53-61, wherein the grip comprises one or more rotation guides adapted to minimize rotation of the grip within the inner weight-engagement device.

Clause 63. The dumbbell system of any one of clauses 53-62, wherein each weight plate in the first plurality of weight plates defines a circle proximate to the outer weight-engagement device.

Clause 64. The dumbbell system of any one of clauses 53-63, wherein each weight plate in the first plurality of weight plates comprises one or more weight-stabilizing recesses proximal to the outer weight-engagement device.

Clause 65. The dumbbell system of any one of clauses 53-64, wherein at least one outer weight-engagement port in the plurality of outer weight-engagement ports comprises a pin support collar.

Clause 66. The dumbbell system of any one of clauses 53-65, further comprising a second plurality of weight plates, each weight plate in the second plurality of weight plates being dimensioned to fit around at least one weight plate in the first plurality of weight plates;

wherein each weight plate in the second plurality of weight plates comprises at least one secondary pin engagement port configured to receive the weight-retaining pin, a secondary weight-retaining pin, the grip-retaining pin, or a combination thereof.

Clause 67. The dumbbell system of any one of clauses 53-66, wherein at least one of the weight-retaining pin, the grip-retaining pin, and the secondary weight-retaining pin comprises a spring-loaded ball bearing, a spring-loaded post, or a combination of both.

Clause 68. The dumbbell system of any one of clauses 53-67, wherein at least one of the weight-retaining pin, the grip-retaining pin, and the secondary weight-retaining pin comprises a retraction grip for releasing the weight-retaining pin, the grip-retaining pin, and the secondary weight-retaining pin.

Clause 69. The dumbbell system of any one of clauses 53-68, wherein the secondary weight-retaining pin comprises a spring-loaded ball bearing, a spring-loaded post, or a combination of both.

Clause 70. The dumbbell system of any one of clauses 66-69, wherein the secondary weight-retaining pin comprises a retraction grip for releasing the secondary weight-retaining pin from the at least one secondary pin-engagement port.

Clause 71. The dumbbell system of any one of clauses 53-70 wherein the grip comprises an ergonomic shape.

Clause 72. The dumbbell system of any one of clauses 53-71 wherein at least one weight plate in the first plurality of weight plates comprises two or more first stacking structures to support and separate adjacent weight plates in the first plurality of weight plates.

Clause 73. The dumbbell system of any one of clauses 66-72, wherein at least one weight plate in the second plurality of weight plates comprises two or more second stacking structures to separate adjacent weight plates in the second plurality of weight plates.

Clause 74. The dumbbell system of any one of clauses 53-73, wherein the outer weight-engagement device comprises one or more weight stabilizing protrusions, and the outer weight-engagement ports are dispersed on the one or more weight stabilizing protrusions.

Clause 75. The dumbbell system of any one of clauses 62-74, wherein the one or more rotation guides comprise one or more weight stabilization ports.

Clause 76. A dumbbell comprising: a grip;

a weight plate permanently affixed to the grip, the weight plate defining an opening about the grip sufficient in size for a human hand to grasp the grip; and two or more stacking structures on the weight plate.

Clause 77. The dumbbell of clause 76, further comprising a filling port adapted to receiving and retaining at least one filling material to impart mass to the dumbbell.

Clause 78. The dumbbell of any one of clauses 76-77, wherein the at least one filling material is chosen from sand, powder, pellets, pebbles, liquids, and combinations thereof.

Clause 79. The dumbbell of any one of clauses 76-78, wherein the at least one filling material is chosen from metal, ceramic, cement, rock, glass, polymer, water, oil, and combinations thereof.

Clause 80. The dumbbell of any one of clauses 76-79, wherein the weight plate comprises metal, ceramic, cement, polymer, or a combination of two or more thereof.

Clause 81. The dumbbell of any one of clauses 76-80, wherein the grip comprises an ergonomic shape.

Clause 82. The dumbbell of any one of clauses 76-81, wherein the opening defines a circular shape about the grip.

Clause 83. The dumbbell of any one of clauses 76-82, wherein the weight plate defines a cylindrical shape.

Clause 84. The dumbbell of any one of clauses 76-83, wherein the dumbbell has a mass of at least one pound, at least 3 pounds, at least 5 pounds, at least 10 pounds, at least 15 pounds, at least 20 pounds, at least 25 pounds, at least 30 pounds, at least 40 pounds, at least 50 pounds, at least 60 pounds, at least 70 pounds, at least 80 pounds, at least 90 pounds, or at least 100 pounds.

Clause 85. The dumbbell of any one of clauses 76-84, wherein the dumbbell has a mass of no more than one pound, no more than 3 pounds, no more than 5 pounds, no more than 10 pounds, no more than 15 pounds, no more than 20 pounds, no more than 25 pounds, no more than 30 pounds, no more than 40 pounds, no more than 50 pounds, no more than 60 pounds, no more than 70 pounds, no more than 80 pounds, no more than 90 pounds, or no more than 100 pounds.

Clause 86. A barbell system for exercising with an incrementally-variable mass of weights, comprising:

a barbell comprising a first barbell end opposite a second barbell end, and a gripping portion disposed between the first barbell end and the second barbell end;

wherein the first barbell end is configured to engage the dumbbell system of any one of clauses 1-12, clauses 25-45, clauses 46-52, clauses 53-75, the dumbbell of clauses 76-85, the telescoping dumbbell system of clauses 13-24, or a combination thereof; and wherein the second barbell end is configured to engage the dumbbell system of anyone of clauses 1-12, clauses 25-45, clauses 46-52, clauses 53-75, the dumbbell of clauses 76-85, the telescoping dumbbell system of clauses 13-24, or a combination thereof.

Clause 87. The barbell system of clause 86, wherein the first barbell end comprises at least one first dumbbell engagement port adapted to receive at least one first dumbbell engagement pin; and wherein the second barbell end comprises at least one second dumbbell engagement port adapted to receive at least one second dumbbell engagement pin.

Clause 88. The barbell system of any one of clauses 86-87, wherein the first barbell end comprises at least one first dumbbell engagement dock adapted to receive at least one first dumbbell engagement lock; and wherein the second barbell end comprises at least one second dumbbell engagement dock adapted to receive at least one second dumbbell engagement lock.

Clause 89. The barbell system of clause 88, wherein the at least one first dumbbell engagement lock comprises a dumbbell locking post, and the at least one first dumbbell engagement dock comprises a dumbbell locking groove adapted to receive the dumbbell locking post.

Clause 90. The barbell system of any one of clauses 88-89, wherein the at least one first dumbbell engagement dock comprises a dumbbell locking post, and the at least one first dumbbell engagement lock comprises a dumbbell locking groove adapted to receive the dumbbell locking post.

As previously stated, detailed embodiments of the present invention are disclosed herein; however, it is to be understood that the disclosed embodiments are merely exemplary of the invention that may be embodied in various forms. It will be appreciated that many modifications and other variations stand within the intended scope of this invention as claimed below. Furthermore, the foregoing description of various embodiments does not necessarily imply exclusion. For example, "some" embodiments may include all or part of "other" and "further" embodiments within the scope of this invention. In addition, "a" does not mean "one and only one;" "a" can mean "one and more than one."

I claim:

1. A dumbbell system for exercising with an incrementally-variable mass of weights, comprising:

(a) an inner weight-engagement device comprising:

an inner first end opposite an inner second end;

a plurality of inner weight-engagement ports dispersed between the inner first end and the inner second end, each inner weight-engagement port in the plurality of inner weight-engagement ports being configured to receive a weight-retaining pin or optionally a grip-retaining pin;

(b) an outer weight-engagement device, wherein the inner weight-engagement device is adapted to fit incrementally within the outer weight-engagement device, the outer weight-engagement device comprising:

an outer first end opposite an outer second end;

a plurality of outer weight-engagement ports dispersed between the outer first end and the outer second end, each outer weight-engagement port in the plurality of outer weight-engagement ports being configured to receive the weight-retaining pin;

(c) a grip comprising a handle portion enclosing a pin-receiving portion adapted to receive the weight-retaining pin or optionally the grip-retaining pin, wherein the grip is adapted to be secured within at least one of the plurality of inner weight-engagement ports;

(d) a first plurality of weight plates, each weight plate in the first plurality of weight plates comprising at least one pin-engagement port configured to also receive the weight-retaining pin, wherein each of the at least one pin-engagement port is adapted to align with an outer weight-engagement port in the plurality of outer weight-engagement ports or optionally an inner weight-engagement port in the plurality of inner weight-engagement ports;

wherein the plurality of weight plates provides the incrementally-variable mass of weights.

2. The dumbbell system of claim 1, wherein the plurality of inner weight-engagement ports comprises a left plurality of inner weight-engagement ports opposite a right plurality of inner weight-engagement ports, wherein each inner weight-engagement port in the left plurality of inner weight-engagement ports aligns with an inner weight-engagement port in the right plurality of inner weight-engagement ports.

3. The dumbbell system of claim 1 wherein the plurality of outer weight-engagement ports comprises a left plurality of outer weight-engagement ports opposite a right plurality of outer weight-engagement ports, wherein each outer weight-engagement port in the left plurality of outer weight-engagement ports aligns with an outer weight-engagement port in the right plurality of outer weight-engagement ports.

4. The dumbbell system of claim 1 wherein the outer weight-engagement device comprises a cylindrical device shape.

5. The dumbbell system of claim 1 wherein the inner weight-engagement device comprises a stand comprising a horizontal stabilizer joining two risers providing the plurality of inner weight-engagement ports; the horizontal stabilizer joining the two risers proximal to the inner first end.

6. The dumbbell system of claim 5, wherein the two risers each exhibit a curved cross section.

7. The dumbbell system of claim 5, wherein the inner weight-engagement device comprises a circumferential stabilizer joining the two risers distal from the inner first end.

8. The dumbbell system of claim 1, wherein the grip is permanently affixed to the inner weight-engagement device proximal to the inner first end.

9. The dumbbell system of claim 1, wherein the grip is adapted to be selectively secured to any of the inner weight-engagement ports in the plurality of inner weight-engagement ports.

10. The dumbbell system of claim 1 wherein the grip comprises one or more rotation guides adapted to minimize rotation of the grip within the inner weight-engagement device.

11. The dumbbell system of claim 1, wherein each weight plate in the first plurality of weight plates defines a circle proximate to the outer weight-engagement device.

12. The dumbbell system of claim 1, wherein each weight plate in the first plurality of weight plates comprises one or more weight-stabilizing recesses proximal to the outer weight-engagement device.

13. The dumbbell system of claim 1, wherein at least one outer weight-engagement port in the plurality of outer weight-engagement ports comprises a pin support collar.

14. The dumbbell system of claim 1, further comprising a second plurality of weight plates, each weight plate in the second plurality of weight plates being dimensioned to fit around at least one weight plate in the first plurality of weight plates;

wherein each weight plate in the second plurality of weight plates comprises at least one secondary pin engagement port configured to receive the weight-retaining pin, a secondary weight-retaining pin, the grip-retaining pin, or a combination thereof.

15. The dumbbell system of claim 14, wherein the secondary weight-retaining pin comprises a retraction grip for releasing the secondary weight-retaining pin from the at least one secondary pin-engagement port.

16. The dumbbell system of claim 1, wherein at least one of the weight-retaining pin, the grip-retaining pin, and the secondary weight-retaining pin comprises a spring-loaded ball bearing, a spring-loaded post, or a combination of both.

17. The dumbbell system of claim 1, wherein at least one of the weight-retaining pin, the grip-retaining pin, and the secondary weight-retaining pin comprises a retraction grip for releasing the weight-retaining pin, the grip-retaining pin, and the secondary weight-retaining pin.

18. The dumbbell system of claim 1, wherein the secondary weight-retaining pin comprises a spring-loaded ball bearing, a spring-loaded post, or a combination of both.

19. The dumbbell system of claim 1, wherein the grip comprises an ergonomic shape.

20. The dumbbell system of claim 1, wherein at least one weight plate in the first plurality of weight plates comprises two or more first stacking structures to support and separate adjacent weight plates in the first plurality of weight plates.

* * * * *